United States Patent [19]

Matsuo et al.

[11] Patent Number: 5,005,055

[45] Date of Patent: Apr. 2, 1991

[54] COPYING APPARATUS PROVIDED WITH AUTOMATIC DOCUMENT FEEDER

[75] Inventors: Hirokazu Matsuo; Hiroyasu Nagato, both of Osaka, Japan

[73] Assignee: Minolta Camera Kabushiki Kaisha, Osaka, Japan

[21] Appl. No.: 428,026

[22] Filed: Oct. 27, 1989

Related U.S. Application Data

[63] Continuation of Ser. No. 188,555, Apr. 29, 1988, abandoned.

[30] Foreign Application Priority Data

| | | | |
|---|---|---|---|
| May 1, 1987 | [JP] | Japan | 62-108624 |
| May 18, 1987 | [JP] | Japan | 62-121647 |
| May 18, 1987 | [JP] | Japan | 62-121648 |
| May 18, 1987 | [JP] | Japan | 62-121649 |
| May 18, 1987 | [JP] | Japan | 62-121650 |

[51] Int. Cl.[5] ..... G03G 15/00

[52] U.S. Cl. ..... 355/311; 271/256

[58] Field of Search ..... 355/203, 204, 206, 308, 355/309, 311, 313, 314, 319; 271/256, 3, 10, 227

[56] References Cited

U.S. PATENT DOCUMENTS

| | | | |
|---|---|---|---|
| 3,288,459 | 11/1966 | Hitchcock et al. | 271/10 |
| 4,052,054 | 10/1977 | Cardwell et al. | 271/227 |
| 4,277,165 | 7/1981 | Wada et al. | 355/55 |
| 4,575,227 | 3/1986 | Ito et al. | 355/56 |
| 4,607,946 | 8/1986 | Uchiyama et al. | 355/308 |
| 4,615,610 | 10/1986 | Yoshiura | 355/203 |
| 4,634,263 | 1/1987 | Miwa | 355/308 |
| 4,657,375 | 4/1987 | Watanabe et al. | 355/308 |
| 4,721,381 | 1/1988 | Matsuo | 355/308 |
| 4,727,401 | 2/1988 | Partilla et al. | 355/308 |
| 4,731,637 | 3/1988 | Acquaviva et al. | 355/308 |
| 4,734,739 | 3/1988 | Inuzuka et al. | 355/308 |
| 4,763,172 | 8/1988 | Tsubota | 355/308 X |
| 4,775,139 | 10/1988 | Honjo et al. | 355/311 |
| 4,777,511 | 10/1988 | Takahashi | 355/308 |
| 4,788,575 | 11/1988 | Ito et al. | 355/308 |
| 4,814,825 | 3/1989 | Johdai et al. | 355/203 |

FOREIGN PATENT DOCUMENTS

| | | |
|---|---|---|
| 60-2942 | 1/1985 | Japan . |
| 60-93463 | 5/1985 | Japan . |
| 60-84945 | 6/1985 | Japan . |
| 62-47264 | 8/1985 | Japan . |

*Primary Examiner*—R. L. Moses

*Attorney, Agent, or Firm*—Burns, Doane, Swecker & Mathis

[57] ABSTRACT

A copy apparatus provided with an automatic document feeder having a function for sequentially feeding a pair of documents and serially placing them onto a platen in the document feeding direction. In the copying apparatus, the image forming operation is inhibited when the sizes of a pair of documents are different, the size of a first document is larger than the half of the platen, either of document is a size where the longer side thereof in parallel to the longer side of the platen, either of document size is a larger than the half of the platen, the value calculated by adding the size of a first document and the minimum size of document transportable is larger than the size of the platen, or the value calculated by adding the size of a first and second documents is larger than the size of the platen. In the above conditions, the copying apparatus is capable of discharging the documents from the platen.

25 Claims, 28 Drawing Sheets

COPYING APPARATUS PROVIDED WITH AUTOMATIC DOCUMENT FEEDER

This application is a continuation of application Ser. No. 188,555, filed Apr. 29, 1988.

BACKGROUND OF THE INVENTION

1. Field of the Invention

The present invention relates to a copying apparatus provided with an automatic document feeder capable of serially placing a pair of original documents at a specified position on a platen, and discharging them from the platen after the completion of exposure.

2. Description of the Prior Art

To reduce a time for replacing original documents or to eliminate type procedure for the document replacement, various copying apparatuses provided with an automatic document feeder (hereinafter abbreviated as ADF) have been recently developed and commercially available. Such an ADF constitutes means for reducing indirect costs (time and labor). In contrast, to reduce direct costs (supplies, such as copy sheets and toner), several methods available are as follows: a duplex copying method, wherein two documents are copied to both sides of one copy sheet; and a method for reducing and copying two documents to one side of a copy sheet having the same size as each original document (two-document, single-face copying mode). In the former method, a pair of documents are unchangedly copied to one side of a copy sheet, while toner making for two copies is consumed. In contrast, the latter method is economical in that a copy sheet and toner each for only one sheet of document is consumed per two duplicates. Furthermore, when the above two methods combined, the result is extreme economization, since four documents are copied using both sides of one copy sheet.

Various conventional ADFs, however, feed documents one by one onto a platen. Accordingly, to perform two-document, one side copying, an operator is supposed to replace documents and place them on the platen per sheet of document, thus time and labor are not reduced.

To solve such disadvantages, for example, an ADF for feeding two documents serially onto a platen in the direction of the document feeding has been disclosed in Japanese Patent Laid Open Publication Nos. 60-2942, 60-84945 and 60-93452. A copying machine provided with this type of ADF, however, has the following disadvantages. When a dual document feeding mode is selected, if the sizes of a first and second documents is different, a blank is inevitably formed on a copy sheet when these two documents are copied on one sheet, regardless of the magnification designated. In the same way, if at least one of the two documents is longitudinal orientation i.e. the longer side thereof has been set in the document feeding direction, or is longer than the half of the platen, this is, the entire exposure area (document image scanning area with an optical system), the total length of the two documents may exceed the entire exposure area, upon placing them on the platen. In this case, images of the two documents are not properly formed on one copy sheet no matter what magnification has been specified, resulting in an incomplete duplicate with a part of image missing. Although the images of the two documents may duplicate on one sheet, a blank is inevitably formed on the sheet.

As for the document size, the ADF disclosed in said Japanese Patent Laid Open Publication No. 60-93462 is known in the art, wherein an operator can select a relevant document size by select means on a control panel, from the following three document size types: the first size where two documents can be set on the platen, such as in the case of latitudinal positioned A4 size, B5 size, letter size and A5 size: the second size where the documents are placed on the platen so that the longer sides of the documents are set in the document feeding direction, such as in the case of longitudinal positioned A4 size and B5 size; and third size in which only one document is set on the platen, such as in the case of A3 size, B4 size, legal size and leisure size. Yet such document size selection is complicated of the part of an operator, thus an accident mis-copying cannot be positively prevented.

SUMMARY OF THE INVENTION

In view of the above-mentioned problems, an object of the present invention is to provide a copying apparatus wherein imaging failure is prevented in a dual document feeding mode; a partially missing image or unproportionally large blank area is prevented.

To realize the above object a copying apparatus according to the present invention, comprises transporting means for sequentially feeding a pair of original documents and serially placing them onto a platen in the document feeding direction, image forming means for copying the image of the documents serially placed on the platen to a copy sheet, detect means for detecting the sizes of documents fed by the transporting means, and inhibition means. And the inhibition means inhibits the image forming operation when the sizes of a pair of documents are different, or the size of a first document is larger than the half of the platen. The copying apparatus further comprises means for discharging a pair of documents from the platen when the sizes of the pair of documents are different. In the copying apparatus, the discharging means discharges a first document from the platen when the size of the first document is larger than the half of the platen.

Furthermore, the inhibition means inhibits the image forming operation when either of document is a size where the longer side thereof in parallel to the longer side of the platen. In the same way, the inhibition means inhibits the operation of feeding a second document onto the platen when a first document is a size where the longer side thereof in parallel to the longer side of the platen. And the discharging means discharges a first document from the platen when the first document is a size where the longer side thereof in parallel to the longer side of the platen. In the same way, the discharging means discharges a pair of documents when a second document is a size where the longer side thereof in parallel to the longer side of the platen.

Furthermore, the inhibition means inhibits the image forming operation when either of document size is a larger than the half of the platen. In the same way, the inhibition means inhibits the operation of feeding a second document onto the platen when the size of a first document is larger than the half of the platen. And the discharging means discharges a first document from the platen when the size of the first document is larger than the half of the platen. In the same way, the discharging means discharges a pair of documents when the size of a second document is larger than the half of the platen.

Furthermore, the inhibition means inhibits the image forming operation or the second document feeding operation when the value calculated by adding the size of a first document and the minimum size of document transportable by the transporting means is larger than the size of the platen. In the same way, the inhibition means inhibits the image forming operation when the value calculated by adding the sizes of a first and second documents is larger than the size of the platen. And the discharging means discharges a first document when the value calculated by adding the size of a first document and the minimum size of document transportable by the transporting means is larger than the size of the platen. In the same way, the discharging means discharges a pair of documents when the value calculated by adding the sizes of a first and second documents is larger than the size of the platen.

BRIEF DESCRIPTION OF THE DRAWINGS

These and other objects and features of the present invention will become apparent from the following description taken in conjunction with the preferred embodiments thereof with the reference of the accompanying drawings, in which:

FIG. 1 through FIG. 19 show a first embodiment of the present invention;

FIG. 1 is a schematic diagram showing the general constitution of a copying machine provided with an ADF;

FIG. 2 is a perspective view showing the constitution of the ADF;

FIG. 6 is a plan view showing a control panel;

FIG. 8 is a flow chart showing a main routine of a first CPU;

FIG. 9 is a flow chart showing a subroutine for the document feeding mode switch processing;

FIG. 11 is a flow chart showing a main routine of a second CPU;

FIG. 12 is a flow chart showing a subroutine for the ADF start processing;

FIG. 13 is a flow chart showing a subroutine for the leading edge registering processing;

FIG. 14 is a flow chart showing a subroutine for the document size detection processing;

FIG. 15 is a flow chart showing a subroutine for the document feeding process (1);

FIG. 17 is a flow chart showing a subroutine for the document discharge process (1);

FIG. 18 is a flow chart showing a subroutine for the document discharge process (2);

FIG. 19 is a flow chart showing a subroutine for another document discharge process (2);

DETAILED DESCRIPTION OF THE INVENTION [First Embodiment]

The preferred this embodiment of a copying apparatus provided with an ADF, according to the invention are hereunder described referring to the attached drawings. First, the constitution of the copying machine 1 is hereunder described.

(Constitution and Operation of Copying Machine)

Figure 1:
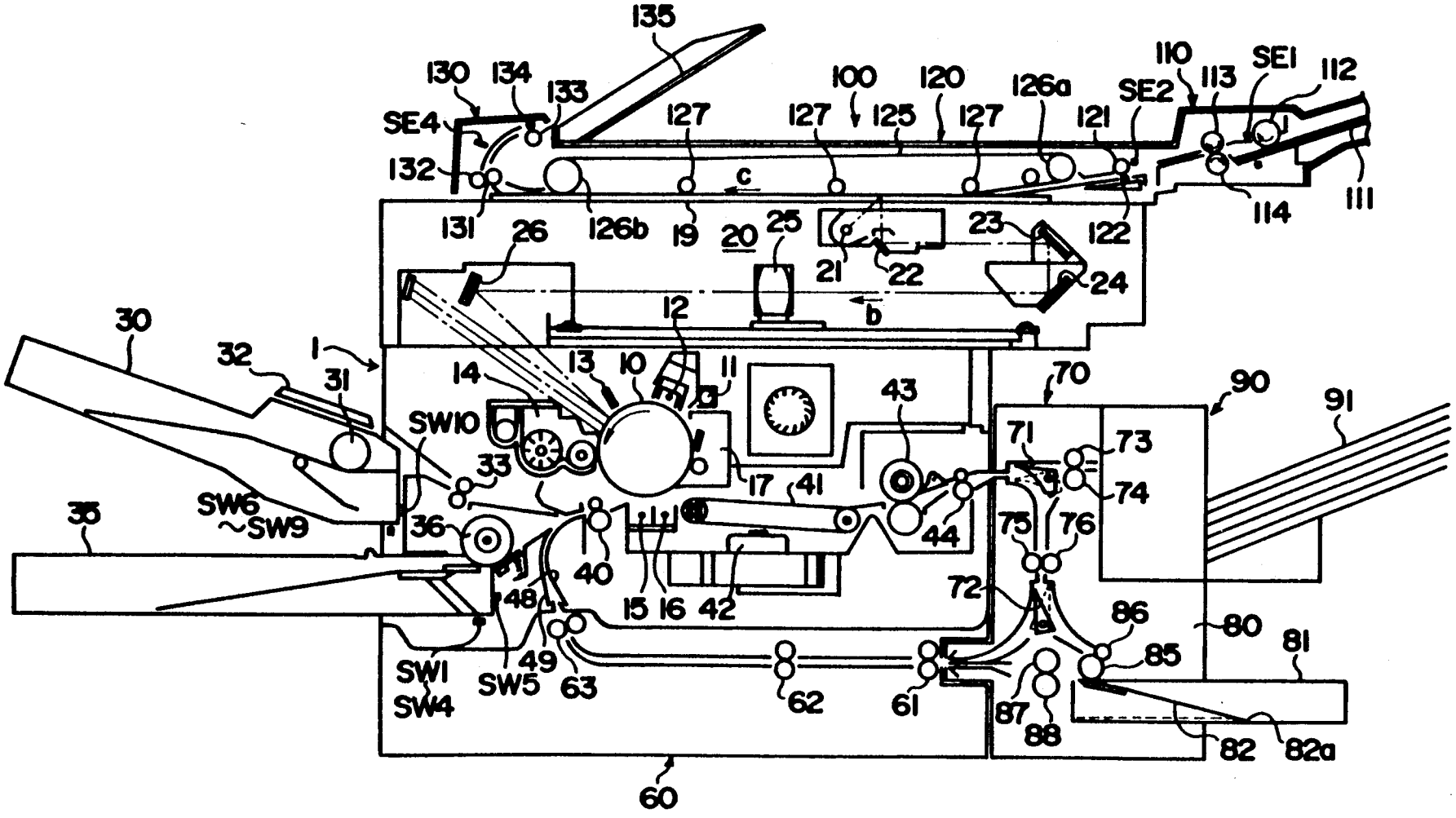

As illustrated in FIG. 1, the electro-photographic copying machine 1 is mounted on a re-fed sheet passing box 60, that is flanked by sheet feeding portions on the left, and by a duplex-composite copying unit 70, and a sorter 90 on the right.

In the approximate middle of the copying machine 1 is disposed a photosensitive drum 10 rotatable in the direction of an arrow a at a predetermined peripheral velocity V. Around the photosensitive drum 10 are sequentially disposed a main eraser 11, an electrifying charger 12, a suberaser 13, a magnetic brush-type developing unit 14, a transfer charger 15, a sheet separation charger 16 and a blade-type cleaning unit 17. During each copying operation, while rotating in the direction of the arrow a, the photosensitive drum 10, having a well-known photosensitive layer on the surface thereof, is neutralized and electrified by the main eraser 11 and the electrifying charger 12, has its unnecessary portions then neutralized by the suberaser 13, and is further subjected to imagewise exposing from an optical system 20 to form an electrostatic latent image. The electrostatic latent image becomes a toner image using the developing unit 14.

The optical system 20 capable of scanning an original image is disposed under a platen glass 19 and comprises an exposure lamp 21, a first mirror 22, a second mirror 23, a third mirror 24, an image-projecting lens 25, and a fourth mirror 26. The exposure lamp 21 and the first mirror 22 are integrally constituted and can move in the direction of an arrow b at a velocity of V/m (m: copying magnification) relative to the peripheral velocity V of the photosensitive drum 10 (constant regardless of whether the current magnification is an equal magnification or a modified magnification). The second mirror 23 and the fourth mirror 24 are integrally constituted and can move in the direction of the arrow b at a velocity of V/2m. In modifying a copying magnification, the lens 25 moves along the optical axis, accompanying the movement and oscillation of the fourth mirror 26 so as to correct the optical path.

On the other hand, copy sheets are stored in a stationary, automatic feeding cassette 30 and a detachable automatic feeding cassette 35, which are both disposed on the left side of the copying machine 1. The copy sheets are fed one by one by selectively rotating either of feeding rollers 31 or 36. Further, the top side of the cassette 30 is a manual feeding portion 32 from which copy sheets are fed one by one. A sheet fed from the cassette 30 or the manual feeding portion 32 is transported to a pair of timing rollers 40 through a transport roller 33; or a sheet fed from the cassette 35 is transported directly to the pair of timing rollers 40, where the sheet stops once. The sheet at the pair of timing rollers 40 is synchronized with the image formed on the surface of the photosensitive drum 10 and transported to a transfer portion to come in close contact with the photosensitive drum 10 where a toner image is transferred onto the sheet by means of the corona discharge of the transfer charger 15 Then, the sheet is separated from the photosensitive drum 10 by means of the AC corona discharge of the separation charger 16. Further, the sheet is drawn onto a transport belt 41, which is provided with an air suction unit 42, and transported to a fixing unit 43 where the toner image is fixed to the sheet; the sheet is then ejected through a pair of ejection rollers 44.

On the other hand, the post-transfer photosensitive drum 10 has residual toner and charge on the surface thereof removed by the cleaning unit 17 and the main eraser 11 in preparation for the next transfer process.

(Detection of Copy Sheet Size)

The above-mentioned sheet feeding portions are provided with microswitches SW1 through SW4, SW5, SW6 through SW9 and SW10. Microswitches SW1 through SW4 and SW6 through SW9 turn on or off based on the positions of a width regulating plate and the like for regulating the position of copy sheets, whereby based on the 4-bit configured codes respectively representing a combination of ON or OFF statuses of these microswitches, the size and feeding direction (longitudinal or latitudinal) of sheets stored in the cassettes 35 and 30 are detected. "longitudinal positioned" is defined that copy sheets have been set the longer side thereof in the sheet feeding direction. "latitudinal positioned" is defined that copy sheets have been set the shorter side thereof in the sheet feeding direction.

Copy sheet sizes applicable to this copying machine 1, that is, sizes capable of being stored in the cassettes 30 and 35 are, for example, A3 size, A4 size, A5 size, A6 size, B4 size, B5 size and B6 size; and for sheets of A4 size, A5 size and B5 size, longitudinal or latitudinal positioned are available. Microswitches SW1 through SW4 also detect the attachment and detachment of the cassette 35. Table 1 shows one example of code table based on microswitches SW1 through SW4. In this table 1, "0" indicates that a microswitch is in "OFF" status; and "1" indicates that a microswitch is in "OFF" status. All the four microswitches in "OFF" status means that the cassette 35 has not been attached to the sheet feeding portion. The other group of microswitches SW6 through SW9 perform similar detection.

Microswitches SW5 and SW10 respectively disposed on the sheet feeding portions directly detect the presence and absence of sheets in the cassettes 35 and 30 respectively

TABLE 1

| Binary Codes | | | | | Decimal |
|---|---|---|---|---|---|
| SW4 | SW3 | SW2 | SW1 | Sheet Size | Codes |
| 0 | 0 | 0 | 0 | | 0 |
| 0 | 0 | 0 | 1 | A6 Longitudinal Positioned | 1 |
| 0 | 0 | 1 | 0 | B6 Longitudinal Positioned | 2 |
| 0 | 0 | 1 | 1 | A5 Longitudinal Positioned | 3 |
| 0 | 1 | 0 | 0 | B5 Longitudinal Positioned | 4 |

TABLE 1-continued

| Binary Codes | | | | | Decimal |
|---|---|---|---|---|---|
| SW4 | SW3 | SW2 | SW1 | Sheet Size | Codes |
| 0 | 1 | 0 | 1 | A4 Longitudinal Positioned | 5 |
| 0 | 1 | 1 | 0 | B4 Longitudinal Positioned | 6 |
| 0 | 1 | 1 | 1 | A3 Longitudinal Positioned | 7 |
| 1 | 0 | 0 | 0 | A6 Latitudinal Positioned | 8 |
| 1 | 0 | 0 | 1 | B6 Latitudinal Positioned | 9 |
| 1 | 0 | 1 | 0 | A5 Latitudinal Positioned | 10 |
| 1 | 0 | 1 | 1 | B5 Latitudinal Positioned | 11 |
| 1 | 1 | 0 | 0 | A4 Latitudinal Positioned | 12 |
| 1 | 1 | 0 | 1 | B4 Latitudinal Positioned | 13 |
| 1 | 1 | 1 | 0 | A3 Latitudinal Positioned | 14 |
| 1 | 1 | 1 | 1 | Cassette Empty | 15 |

(Mechanism and Sheet Passing for Duplex and Composite Copying)

The duplex-composite copying unit 70 generally comprises a first switching tongue 71, a second switching tongue 72, ejection rollers 73 and 74, transport rollers 75 and 76, sheet guide plates correspondingly located around there, and a sheet re-feeding device 80. And the unit 70 is disposed a sorter 90 at the back thereof, including a plurality of bins 91.

The sheet re-feeding device 80 comprises a detachable re-feeding cassette 81; a pick up roller 85 used both receiving and re-feeding sheets; a collection roller 86 that is in contact with the pick up roller 85 and turns as a follower to the latter; a feeding roller 87; and a separation roller 88. The re-feeding cassette 81 is provided with a base plate 82 that is rockable on its rear end **82*a*** and movable upward by an unshown elevating mechanism from a position shown with a dotted line to a position shown with a solid line.

The re-fed sheet passing box 60 comprises pairs of transport rollers 61, 62 and 63, and guide plates that surround the rollers to provide a transport path for copy sheets. A copy sheet re-fed from the unit 70 is transported by the pairs of rollers 61, 62, and 63 and through guide plates 48 and 49 in the copying machine 1 to the pair of timing rollers 40.

Sheet transport modes available in the unit 70 are a discharge mode, a duplex copying mode, and a composite copying mode. The sheet transport configuration relevant to each mode is set by the switching tongues 71 and 72. In the discharge mode, the tongue 71 is in a position shown by a dotted line as in FIG. 1, thereby a sheet is ejected to the sorter bin 91. In the duplex copying mode, the tongues 71 and 72 respectively take a position shown by a solid line, thereby a sheet with an image on one side is transported into the re-feeding cassette 81 as described previously. In the composite copying mode, the tongue 72 takes a position shown by a dotted line, thereby a sheet with an image on one side is immediately transported to the re-fed sheet passing box 60.

(Constitution and Operation of ADF)

Figure 7A:
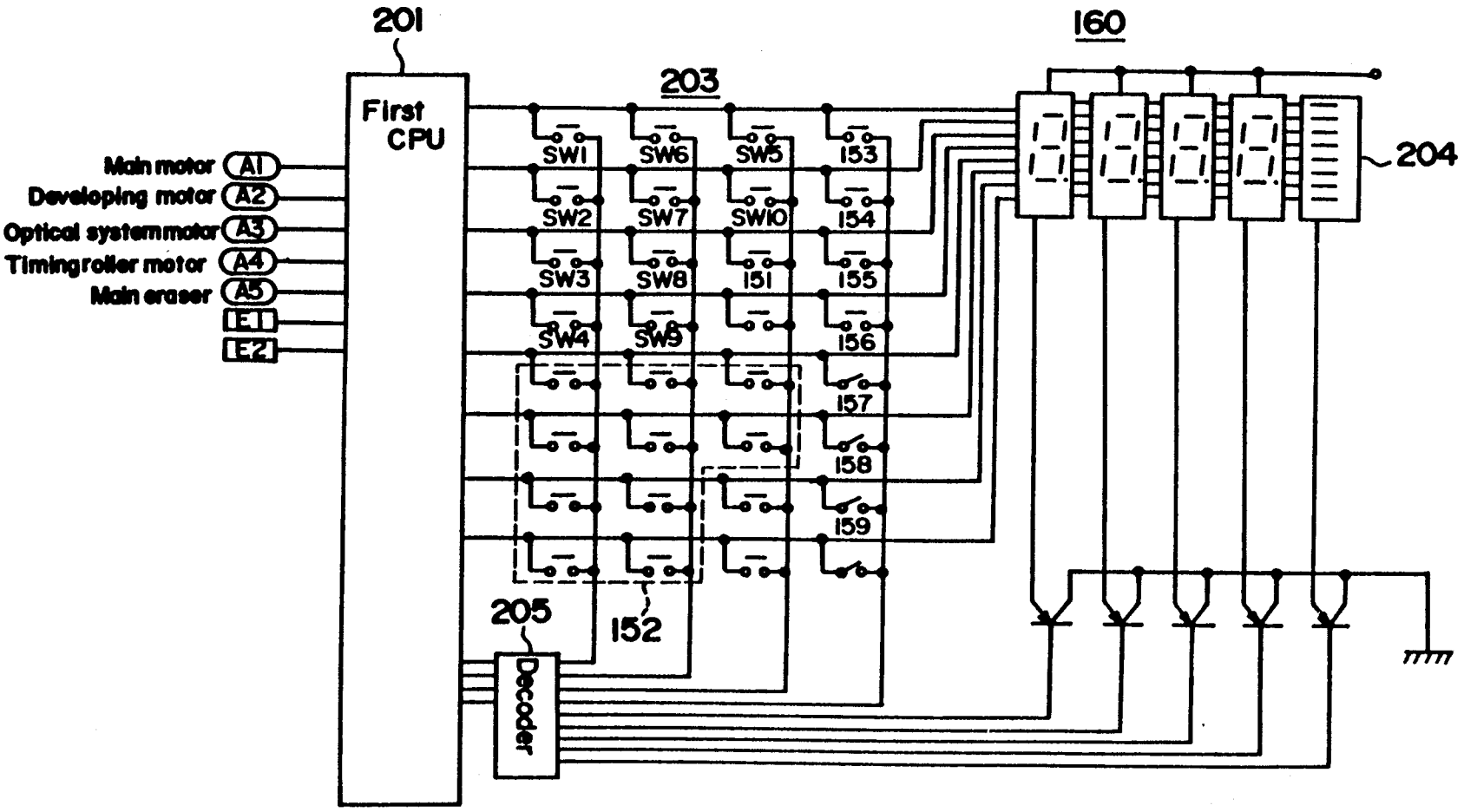
FIGS. 7*a* and 7*b* are block diagram showing a control circuit.
Figure 7B:
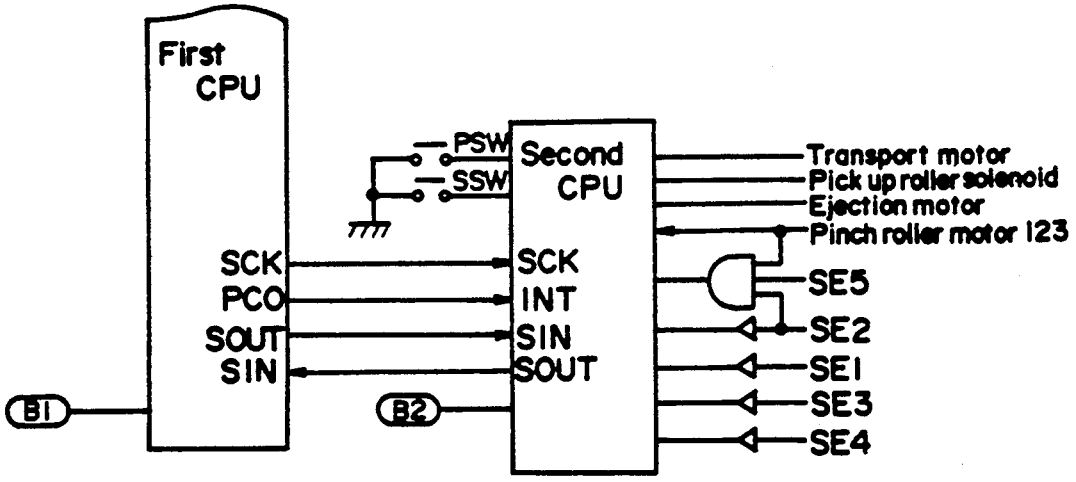

The ADF 100 principally comprises a document feeding unit 110, a document transporting unit 120 and a document discharging unit 130, wherein the ADF 100 is capable of being opened up, as a whole, as supported on the rear portion thereof. The ADF 100, mounted on the platen glass 19 as illustrated in FIG. 1, can automatically feed documents to a specified position on the platen glass 19 as hereunder described. The feeding may be performed one by one; or pairs of documents may be automatically and serially transported to the specified position on the platen glass 19. Otherwise, an operator may lift the ADF 100 and place a document on the platen glass 19 in order to perform copying. Whether the ADF 100 is in the "up" position or "down" position is detected by a switch PSW (refer to FIG. 7*b*), thereby based on a detection signal generated, the ADF 100 and the copying machine 1 are synchronously controlled.

The document feeding unit 110 comprises a document tray 111, a pick up roller 112, a document separation roller 113 that rotates in the forward direction, a reverse roller 114, a feeding motor (not shown) for driving these rollers 112, 113 and 114, and a document detection sensor SE1. The document tray 111 is equipped with a sliding plate (not shown) that positions documents relative to document width direction. Documents are stacked on the document tray 111 with their faces down, and this state is detected by the sensor SE1. The vertically movable pick up roller 112 remains in an upper position while the ADF 100 is inactive Once documents are stacked on the document tray 111, and the sensor SE1 turns on, and when an operator turns on a ADF switch SSW (refer to FIG. 7*b*), the pick up roller 112 comes down, presses the documents, and feeds the uppermost document by revolution.

The roller 113 rotates toward the direction of document feeding, while the roller 114 rotates in the reverse direction. As described previously, the separates rollers 113 and 114 are driven in conjunction with the pick up roller 112, only the uppermost document is fed into the document transporting unit 120 by the roller 113, and other documents are fed back into the document tray 111 by the reverse roller 114.

Figure 2:
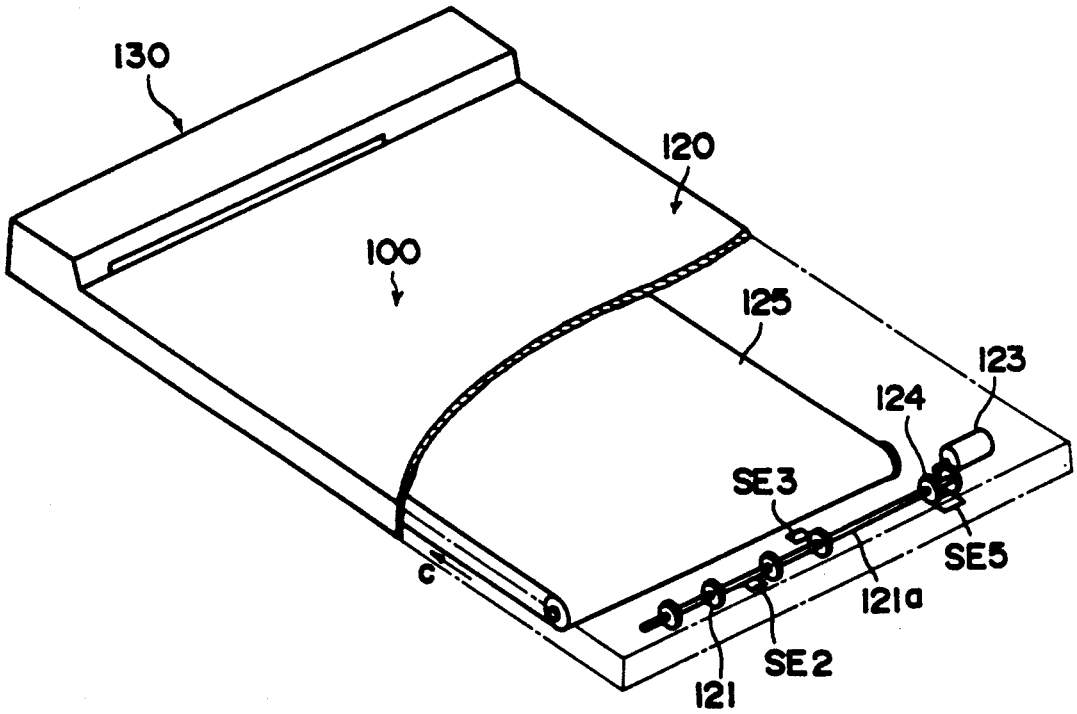

The document transporting unit 120 comprises pinch rollers 121 and 122, a motor 123 (refer to FIG. 2) for driving these pinch rollers, a transport belt 125, a motor (not shown) for driving the transport belt 124, and document detection sensors SE2 and SE3.

The transport belt 125 is an endless loop belt spanning between two support rollers 126*a* and 126*b* and pressed onto the platen glass 19 by presser rollers 127, whereby the transport belt 125 is capable of turning both in the forward direction indicated by an arrow c, and in the reverse direction.

When the sensor SE2 detects the leading edge of a document fed from the document feeding unit 110, the pick up roller 112, rollers 113, and 114 stop the rotations slightly after the detection By this arrangement, the leading edge of this document comes into contact with the nip portion between the pinch rollers 121 and 122 and forms a loop in the upper stream side of the nip portion. This process corrects skew on the document.

The document is further transported onto the platen glass 19 by the rotation of the pinch rollers 121, 122, in conjunction with the forward travel of the transport belt 125 which transports the document in the direction of the arrow c. When the trailing edge of the document is detected by the sensor SE2, a timer is automatically started, thereby at the completion of the counting with the timer, the transport belt 125 temporarily stops. This arrangement enables the document to be set on a specified position on the platen glass 19.

Then, the ADF 100 outputs a copy start signal to the copying machine 1, thereby the copying machine 1 starts the copying operation Once the previously mentioned optical system 20 completes the image exposure-scanning for predetermined number of copies, the copying machine 1 outputs a document replace signal to the ADF 100, thereby the transport belt 125 resumes transporting the document forward in the direction of the arrow c and discharges the document, from the platen glass 19.

In this process, the length of a document is measured by referring to signal pulses from a sensor SE5 that outputs the pulses based on the rotation of a disc 124 installed on an axle 121*a* of the pinch roller 121. More specifically, the output from the sensor SE5 is, in conjunction with the logical sum of the output from the sensor SE5 that detects a passing document and the output of the pinch roller 121, loaded into a second CPU 202 (refer to FIG. 7*b*), thereby the document span signal is generated by counting signal pulses generated while the documents passes the sensor SE2.

At the same time, the width of a document is detected and categorized by a sensor SE3. In this first embodiment, the sensor SE3 is disposed in a position where it is actuated (turns on) by an A4 or B5 document transported in a latitudinal orientation, and not actuated (off status) when an A4 or B5 document is transported in a longitudinal orientation. By this arrangement, the data not available based on the document span signal alone, that is, the size such as A4, A5, B4 and B6, and the orientation of a document being transported (latitudinal or longitudinal), are detected.

"Longitudinal orientation" is defined that a document is transported the longer side thereof in the document transporting direction, or a document is a size where the longer side thereof in parallel to the longer side of the platen glass 19. "Latitudinal orientation" is defined that a document is transported the shorter side thereof in the document transporting direction, or a document is a size where the shorter side thereof in parallel to the longer side of the platen glass 19.

The document discharging unit 130 comprises discharge rollers 131, 132, 133 and 134; guide plates correspondingly located around these rollers, a discharge tray 135, a motor for driving these rollers, and a document detection sensor SE4.

Once the previously mentioned optical system 20 has completed the image exposure-scanning for a pre-determined number of copies and the copying machine 1 outputs a document replace signal, the transport belt 125 resumes driving forward and the discharge rollers 131 through 134 resume rotating, thereby the document is transported from the platen glass 19 out onto the discharge tray 135. The document discharge movement stops a predetermined duration after the output of a trailing edge detection signal from the sensor SE4 i.e. the movement stops when the document is discharged onto the discharge tray 135.

When the sensor SE4 outputs the trailing edge detection signal and the sensor SE1 detects a document remaining on the document tray 111, the ADF 110 repeats the previously mentioned document feeding, setting and discharging procedures.

(Movement of Dual Feeding Mode for Document)

In this first embodiment, two selective modes are available with the ADF 100: an ordinary single feeding mode, wherein the ADF 100 sets a document one by one onto the specified position on the platen glass 19, and after image exposure-scanning, discharges the document therefrom; in a dual feeding mode, a pair of documents are sequentially fed onto the platen glass 19 and set serially, and discharged after simultaneous image exposure-scanning.

(1) Document feeding movement

The document feeding operation in the dual feeding mode is hereunder described referring to FIG. 3*a* through FIG. 3*i*.

Once the dual feeding mode is selected and the ADF start switch SSW turns on, documents on the document tray 111 are fed starting from the uppermost document. A couple of documents are separated by the separation rollers 113 and 114 as mentioned previously, and fed out of the feeding unit 110 (refer to FIG. 3*a*).

Figure 3A:
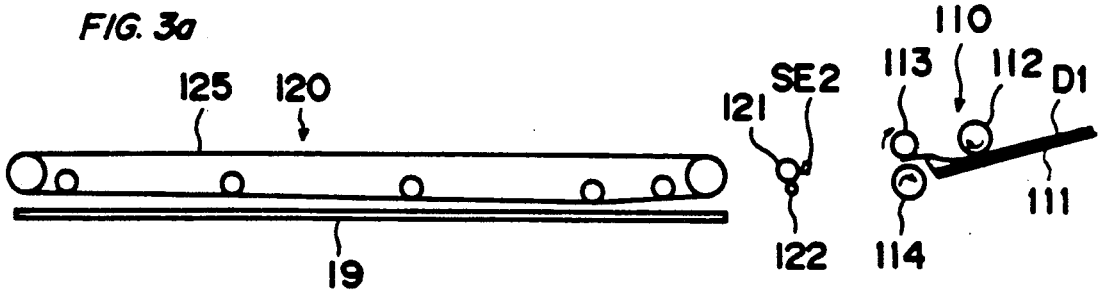
FIG. 3*a* through FIG. 3*i* are explanatory drawings showing the document feeding operation.
Figure 3B:
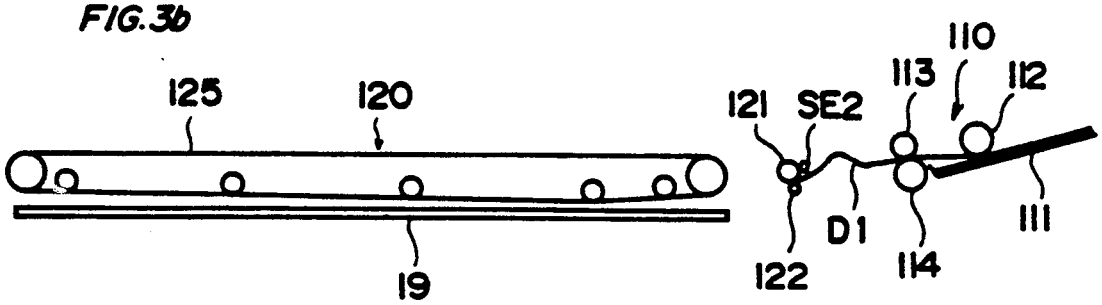

When the leading edge of a first document D1 touches the nipping portion between the pinch rollers 121 and 122, the document D1 forms a loop in the upstream side of the nipping portion (refer to FIG. 3*b*). This treatment is hereinafter called the leading edge registering.

Figure 3C:
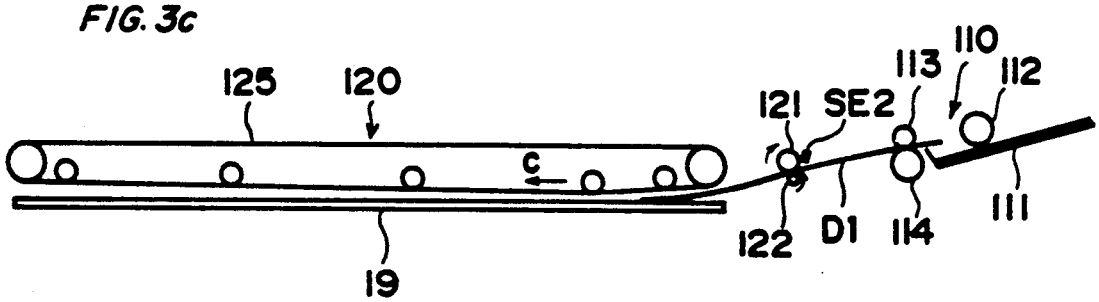

The first document D1 is then transported toward the platen glass 19 by the rotation of the pinch rollers 121 and 122 as well as by the forward movement of the transport belt 125 in the direction of the arrow c (refer to FIG. 3*c*).

Figure 3D:
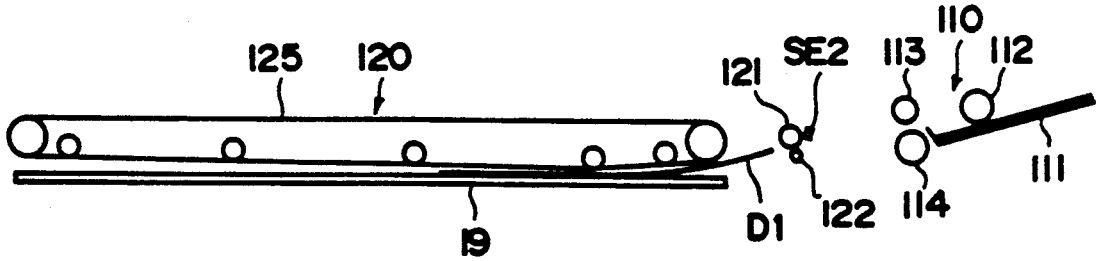
Figure 3E:
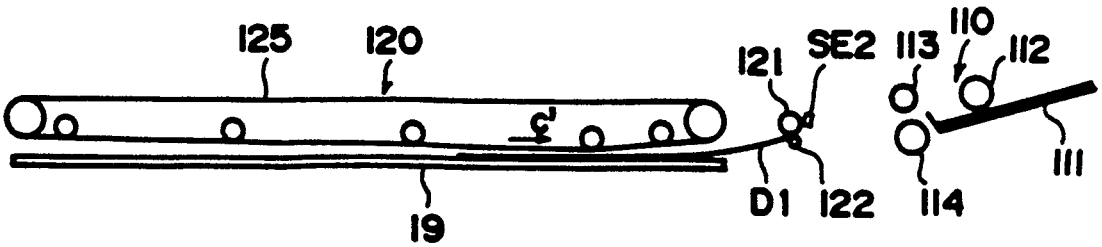
Figure 3F:
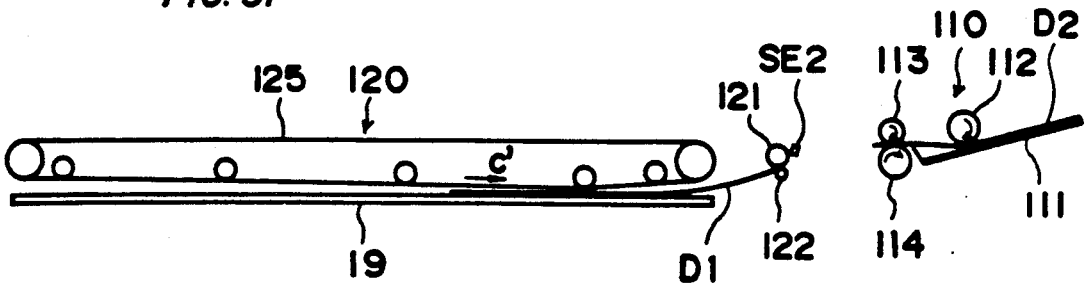

When the trailing edge of the first document D1 passes through the pinch rollers 121 and 122, the rotation of the pinch rollers 121, 122 and the transport belt 125 temporarily stop (refer to FIG. 3*d*). Then, the transport belt 125 moves reverse until the trailing edge of the first document D1 touches the nipping portion between the pinch rollers 121 and 122 (refer to FIG. 3*e*). This treatment is hereinafter called the trailing edge registering.

Figure 3G:
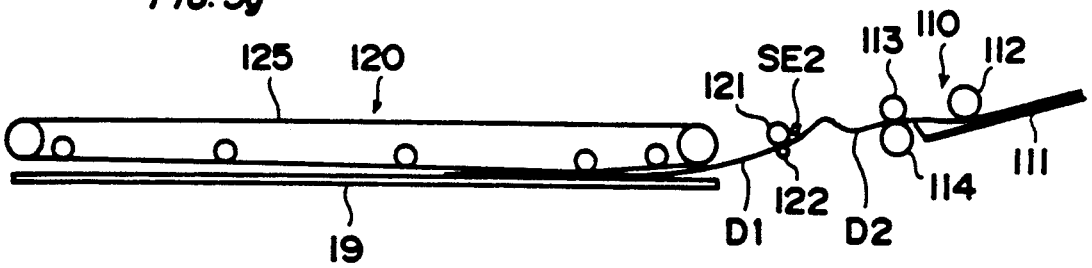

While the first document D1 is in a status where the trailing edge thereof being registered, a second document D2 is fed (refer to FIG. 3*f*) and treated for the leading edge registering (refer to FIG. 3*g*). As a result, a pair of the documents D1 and D2 are serial-sequentially set with one registered its trailing edge and the other registered its leading edge by the pinch rollers 121 and 122.

Figure 3H:
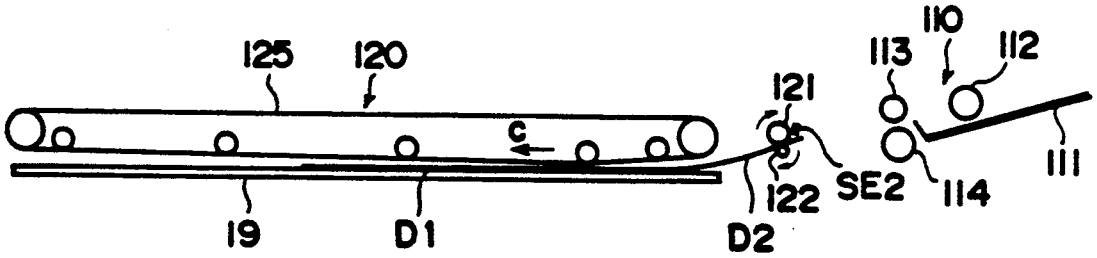
Figure 3I:
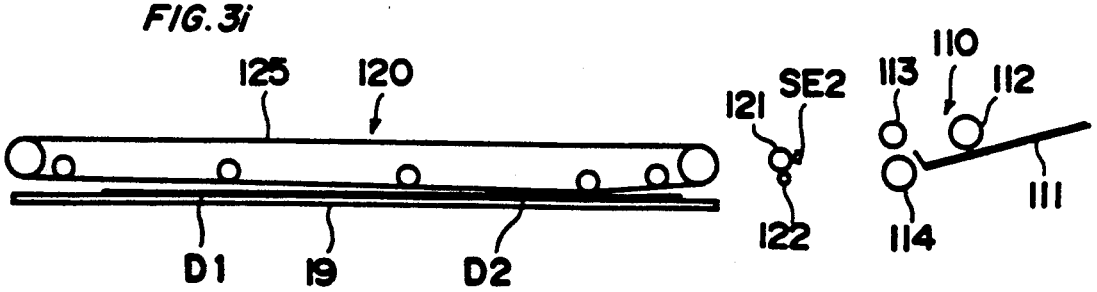

The pair of documents D1 and D2 thus set serial-sequentially are transported simultaneously onto the platen 19 by the forward rotation of the pinch rollers 121, 122 and the transport belt 125 (refer to FIG. 3*h*). When the trailing edge of the second document D2 is set to the specified position on the platen glass 19 i.e. the starting position of exposure by the optical system 20, the pinch rollers 121, 122 and the transport belt 125 stop (refer to FIG. 3*i*). The pair of documents D1 and D2 are thus set serial-sequentially at the specified position of the platen glass 19.

(2) Document discharge movement

In the dual feeding mode, wherein a pair of documents are serial-sequentially set without an opening between them, the leading edge of the second document pushes the trailing edge of the first document when discharged, possibly resulting in mis-alignment or page disorder on the discharge tray 135.

Therefore, in the dual feeding mode, an arrangement is made so that a pair of documents are discharged onto the discharge tray 135 with an interval in order to ensure document alignment on the discharge tray 135. Such document discharge movement is available in the following three methods.

In the first method, when the first document reaches the discharge rollers 131 and 132, the transport belt 125 temporarily stops so as to keep the second document remain on the platen glass 19 until the proper interval forms between the documents. The transport belt 125 resumes driving forward after this step.

More specifically, upon reception of the document replace signal, the transport belt 125 moves forward and the discharge rollers 131 through 134 drive (refer to FIG. 4*a*), thereby the documents D1 and D2 start discharge movement in the direction of the arrow c. When the leading edge of the first document D1 is detected by the sensor SE4, the transport belt 125 stops temporarily (refer to FIG. 4*b*). The first document D1 is further transported by the discharge rollers 131 through 134, while the second document D2 remains on the platen glass 19 so that an appropriate interval forms between the pair of documents D1 and D2 (refer to FIGS. 4*c* and 4*d*).

When the sensor SE4 detects the trailing edge of the first document D1, the transport belt 125 resumes forward movement so as to carry the second document D2 (refer to FIG. 4*e*), and the pair of documents D1 and D2 are discharged onto the discharge tray 135 with an appropriate interval between them.

In the second method, the document transport speed of the discharge rollers 131 through 134 is set somewhat larger than that of the transport belt 125 so that an appropriate interval is incorporated between two documents.

Figure 5A:
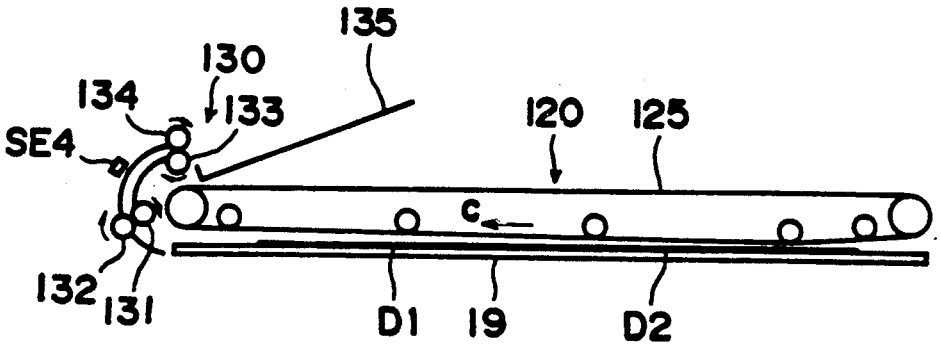
FIG. 5*a* through FIG. 5*c* are explanatory drawings showing another document discharging operation.

More specifically, upon reception of the document replace signal, the transport belt 125 moves forward, and the discharge rollers 131 through 134 rotate, whereby the document transport speed of the discharge rollers 131 through 134 are set somewhat larger than that of the transport belt 125 (refer to FIG. 5*a*). Due to this difference in speeds, the gradually increasing interval is incorporated between the pair of documents D1 and D2 (refer to FIGS. 5*b* and 5*c*), and, accordingly, the pair of documents D1 and D2 are discharged onto the discharge tray 135 with an appropriate interval.

In the third method, the document discharge operation is controlled by the following arrangement. The discharge operation with the transport belt 125 is interrupted once the sensor SE4 detected the trailing edge of the first document, thereby the first document is discharged onto the document tray 135 by the discharge rollers 131 through 134. Then, the second document is left stationarily on the platen glass 19. Subsequently, the second document is discharged after a predetermined duration by re-starting the discharge operation of the transport belt 125.

Concerning the setting of the speeds described above, the speed of the discharge rollers 131 and 132 in the upstream side may be equal to that of the transport belt 125. In this case, however, the speed of the discharge rollers 133 and 134 is set larger than that of the discharge rollers 131 and 132, which are designed to serve as followers to the rotations of the discharge rollers 133 and 134 while a document is transported by the discharge rollers 133 and 134.

(Single Feeding in Dual Feeding Mode)

In the above-mentioned dual feeding mode, if the number of documents is an odd number, a single document remains for the last copying cycle as the result of feeding documents pair by pair. Accordingly, in the last cycle, the sensor SE1 outputs a document empty signal when the last document is fed, thereby the final document is subjected to the processing under the single feeding mode.

(Automatic Magnification Setting Function (AMS))

The copying machine 1 is provided with the automatic magnification setting function (hereinafter referred to as AMS), thereby the relevant magnification for copying is automatically designated so as not to produce an image with a part missing, when an operator specifies a copy sheet size and a original document size.

Once the AMS mode is selected, the second CPU 202 judges a document size, which is then encoded and transmitted to the first CPU 201. The first CPU 201 arithmetically determines the relevant magnification based on the document size code, and on the size code of copy sheets stored in the cassette 30 or 35 that is selected by an operator, thereby if the determined magnification is within the specified scope for the copying machine 1, this magnification is enabled; if the determined magnification is not within the specified scope, the first CPU 201 warns the operator that the relevant magnification cannot be automatically designated and that manual setting is required.

Table *2a* below exhibits the correlation between the relevant magnifications calculated from the sheet size and the document size in the AMS mode in conjunction with the ordinary single feeding mode (one-by-one document feeding).

Otherwise, in the dual feeding mode wherein two documents are fed as a pair, as described below, copying operation is inhibited when the size of the second document is different from that of the first document. Thus, the size of the first and second documents are compulsorily identical. Accordingly, when performing copying by the AMS mode in conjunction with the dual feeding mode, the optimum magnification is a value determined by dividing the half length of the copy sheet in its transporting direction by the length of the first document in its feeding direction. The following Table *2b* exhibits the correlation among the document sizes, copy sheet sizes in the case of the AMS mode performed in conjunction with the dual feeding mode, as well as the magnifications determined based on the document sizes and copy sheet sizes.

For example, when the size of a copy sheet is the longitudinal positioned A4 and that of a document is the latitudinal orientation A4, the optimum magnification in the dual feeding mode arithmetically determined is 0.707 and this magnification is designated. When the size of a copy sheet is the longitudinal positioned B6 and that of a document is the latitudinal orientation A4, the optimum magnification cannot be reached, and the system encourages an operator to manually set a magnification.

TABLE 2a

| | Single Feeding Mode, By AMS | | | | | | | | | |
|---|---|---|---|---|---|---|---|---|---|---|
| | Sheet Size selected by Operator | | | | | | | | | |
| | A6 | B6 | A5R Lo.P. | A5 La.P. | B5R Lo.P. | B5 La.P. | A4R Lo.P. | A4 La.P. | B4 | A3 |
| Document Size | | | | | | | | | | |
| A5 Longitudinal Orientation | 0.707 | 0.866 | 1.000 | 0.707 | 1.225 | 0.866 | 1.414 | 1.000 | 1.420 | 1.420 |
| A5 Latitudinal Orientation | M | M | 0.707 | 1.000 | 0.866 | 1.225 | 1.000 | 1.414 | 1.225 | 1.414 |
| B5 Longitudinal Orientation | M | 0.707 | 0.816 | M | 1.000 | 0.707 | 1.154 | 0.816 | 1.414 | 1.420 |
| B5 Latitudinal Orientation | M | M | M | 0.816 | 0.707 | 1.000 | 0.816 | 1.154 | 1.000 | 1.154 |
| A4 Longitudinal Orientation | M | M | 0.707 | M | 0.866 | M | 1.000 | 0.707 | 1.225 | 1.414 |
| A4 Latitudinal Orientation | M | M | M | 0.707 | M | 0.866 | 0.707 | 1.000 | 0.866 | 1.000 |
| B4 | M | M | M | M | 0.707 | M | 0.816 | M | 1.000 | 1.154 |
| A3 | M | M | M | M | M | M | 0.707 | M | 0.866 | 1.000 |

Effective Magnification on Machine Ranges 0.640–1.430
(M shows manual mode)
(Lo.P. shows longitudinal positioned)
(La.P. shows latitudinal positioned)

TABLE 2b

| | Duel Feeding Mode, By AMS | | | | | | |
|---|---|---|---|---|---|---|---|
| | Sheet Size selected by Operator | | | | | | |
| | A6 Lo.P. | B6 Lo.P. | A5 Lo.P. | B5 Lo.P. | A4 Lo.P. | B4 Lo.P. | A3 Lo.P. |
| First Document Size | | | | | | | |
| A5 Longitudinal Orientation | M | M | M | M | 0.707 | 0.866 | 1.000 |
| A5 Latitudinal Orientation | M | M | 0.707 | 0.866 | 1.000 | 1.225 | 1.414 |
| B5 Latitudinal Orientation | M | M | M | 0.707 | 0.816 | 1.000 | 1.154 |
| A4 Latitudinal Orientation | M | M | M | M | 0.707 | 0.866 | 1.000 |

Effective Magnification on Machine Ranges 0.640–1.430
(M shows manual mode)
(Lo.P. shows longitudinal positioned)

(Automatic Paper Size Setting Function (APS))

The copying machine 1 is provided with the automatic paper size setting function (hereinafter referred to as APS), whereby when an operator specifies a document size and a magnification, a cassette storing a relevant size of sheets is automatically designated so as not to form an image of its part missing.

Once the APS mode is selected, the second CPU 202 judges a document size, which is then encoded and transferred to the first CPU 201. The first CPU 201 arithmetically determines the relevant sheet size based on the entered document size code, and on the magnification selected by an operator, and then, selects either cassette 30 or 35, in which sheets of the determined magnification are stored. If sheets of a relevant size are not stored in either cassette 30 or 35, nor a relevant size is within the specified scope of the copying machine 1, the first CPU 201 warns the operator that the sheets of a relevant are not available, and that either the manual setting of a sheet feeding cassette or the manual resetting of magnification is required.

Table 3a below exhibits the correlation among the document sizes, magnifications, and the relevant sheet sizes calculated from the document sizes and magnifications in the APS mode in conjunction with the ordinary single feeding mode in which documents are fed one by one.

Otherwise, in the dual feeding mode, the sizes of the first and second documents are identical, as mentioned for the AMS mode. Therefore, when copying by the APS mode in conjunction with the dual feeding mode, the size of the optimum copy sheet is determined by multiplying the value twice as large as the first document length in its feeding direction by the magnification. Table 3b given below exhibits the correlation among the document sizes, magnification, as well as the copy sheet sizes that are determined and designated based on the document sizes and the magnification, relative to the operation in the APS mode in conjunction with the dual feeding mode.

For example, when the size of the document is the latitudinal orientation B5 and the magnification is 0.816, the optimum copy sheet size in the dual feeding mode is determined as the longitudinal positioned A4, and the sheet feeder storing the longitudinal positioned A4 copy sheets is automatically selected. When the document size is the latitudinal orientation A4, the optimum size cannot be found, even if the magnification of 1.008 to 1.430 is designated, thus the system encourages an operator to manually select a relevant sheet feeder.

TABLE 3a

| | Single Feeding Mode, By APS | | | | | | |
|---|---|---|---|---|---|---|---|
| | Magnification selected by Operator | | | | | | |
| | 0.640–0.711 | 0.712–0.823 | 0.824–0.871 | 0.872–1.007 | 1.008–1.159 | 1.160–1.231 | 1.232–1.420 |
| Document Size | | | | | | | |
| A5 Longitudinal Orientation | A6 Lo.P. | B6 Lo.P. | B6 Lo.P. | A5 Lo.P. | B5 Lo.P. | B5 Lo.P. | A4 Lo.P. |
| A5 Latitudinal Orientation | A5 La.P. | A5 La.P. | A5 La.P. | A5 La.P. | B5 La.P. | B5 La.P. | A4 La.P. |
| B5 Longitudinal Orientation | B6 Lo.P. | A5 Lo.P. | B5 Lo.P. | B5 Lo.P. | A4 Lo.P. | B4 Lo.P. | B4 Lo.P. |
| B5 Latitudinal Orientation | A5 La.P. | A5 La.P. | B5 La.P. | B5 La.P. | A4 La.P. | M | M |
| A4 Longitudinal Orientation | A5 Lo.P. | B5 Lo.P. | B5 Lo.P. | A4 Lo.P. | B4 Lo.P. | B4 Lo.P. | A3 Lo.P. |
| A4 Latitudinal Orientation | A5 La.P. | B5 La.P. | B5 La.P. | A4 La.P. | M | M | M |
| B4 Longitudinal Orientation | B5 Lo.P. | A4 Lo.P. | B4 Lo.P. | B4 Lo.P. | A3 Lo.P. | M | M |
| A3 Longitudinal Orientation | A4 Lo.P. | B4 Lo.P. | B4 Lo.P. | A3 Lo.P. | M | M | M |

Effective Magnification on Machine Ranges 0.640–1.420
(M shows manual mode)
(Lo.P. shows longitudinal positioned)
(La.P. shows latitudinal positioned)

TABLE 3b

| | Duel Feeding Mode, By APS | | | | | | |
|---|---|---|---|---|---|---|---|
| | Magnification selected by Operator | | | | | | |
| | 0.640–0.711 | 0.712–0.823 | 0.824–0.871 | 0.872–1.007 | 1.008–1.159 | 1.160–1.231 | 1.232–1.430 |
| First Document Size | | | | | | | |
| A5 Longitudinal Orientation | A4 Lo.P. | B4 Lo.P. | B4 Lo.P. | A3 Lo.P. | M | M | M |
| A5 Latitudinal Orientation | A5 Lo.P. | B5 Lo.P. | B5 Lo.P. | A4 Lo.P. | B4 Lo.P. | B4 Lo.P. | A3 Lo.P. |
| B5 Latitudinal Orientation | B5 Lo.P. | A4 Lo.P. | B4 Lo.P. | B4 Lo.P. | A3 Lo.P. | M | M |
| A4 Latitudinal Orientation | A4 Lo.P. | B4 Lo.P. | B4 Lo.P. | A3 Lo.P. | M | M | M |

Effective Magnification on Machine Ranges 0.640–1.430
(M shows manual mode)
(Lo.P. shows longitudinal positioned)

(Correlation among Document Size, Magnification and Copy Sheet Size under Dual Feeding Mode)

When the ADF 100 is actuated in the dual feeding mode to copy images of a pair of documents to one side of a copy sheet, the correlation among a document size, magnification and a copy sheet size is as described hereunder. If two A4 size documents are positioned latitudinally and a magnification is set to [1.000], A3 size sheet is selected so that images on a pair of documents are copied adequately to one sheet. Additionally, if a designated magnification is [0.707], a longitudinally positioned A4 size sheet is selected. Similarly, if a pair of two A4 size documents are positioned latitudinally and A3 size sheet is specified, a magnification is set to [1.000] and if a longitudinally positioned A4 size sheet is selected, a magnification is set to [0.707].

As described above, the execution of the dual feeding mode by the ADF 100 enables the transfer of images on a pair of documents onto one sheet, resulting in economization in terms of both sheet and copy time. In addition, the dual feeding mode, when used together with the duplex copying mode, enables the transfer of images on four documents onto one sheet. Further, the copying machine 1 may be provided with a page divisional copying function where two pages on a book are individually subjected to exposure scanning. Accordingly, the combined use of the dual feeding mode, the page divisional copying mode, and the duplex copying mode, can copy a pair of documents to the respective sides of one sheet. Such copying modes enable further economization in terms of both sheet and copy time.

(Operational Panel)

Figure 6:
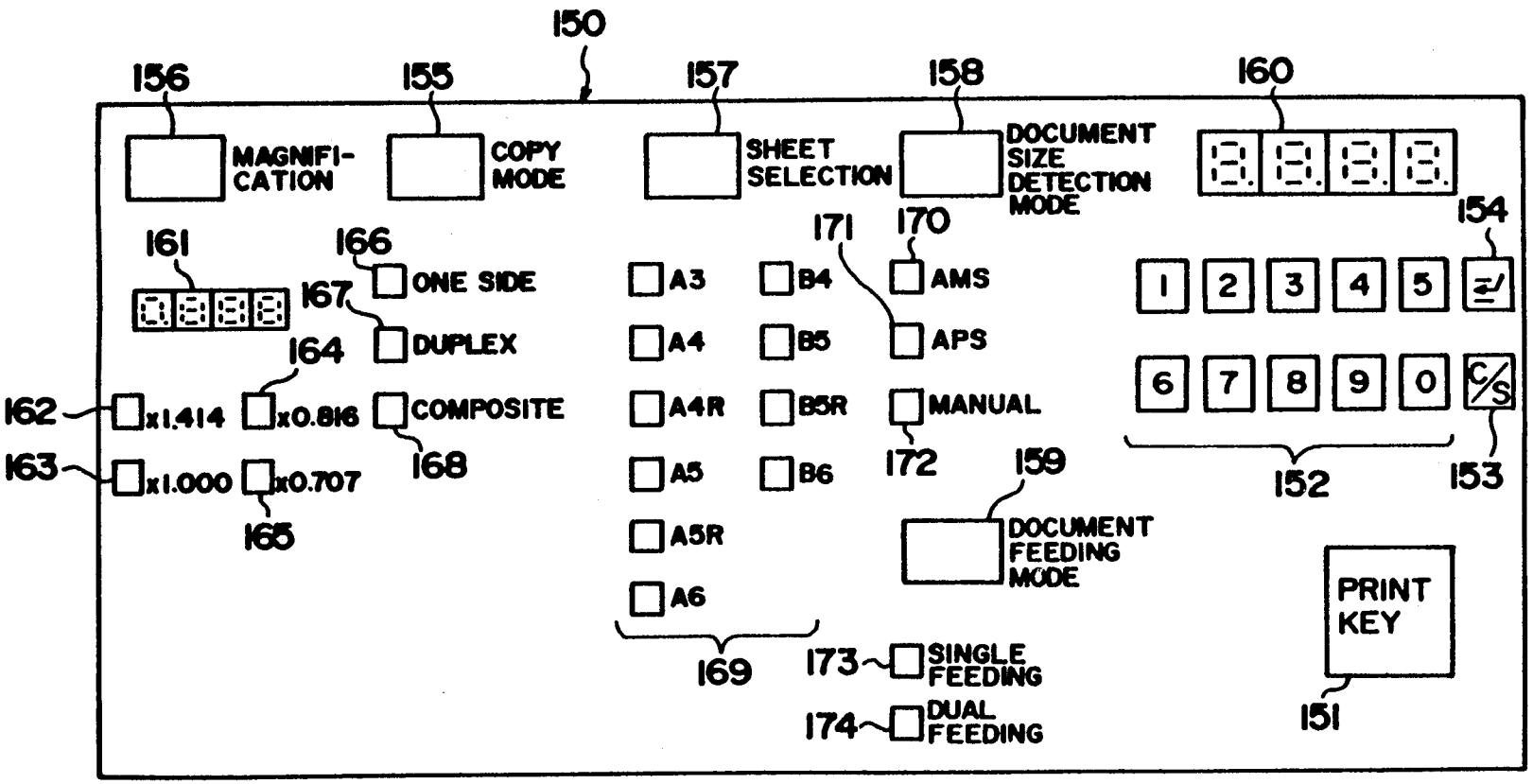

As illustrated in FIG. 6, an operation panel 150 on the main body of the copying machine 1 is provided with keys and indicators hereunder described; each key internally has a switch that is turned on when pressed.

Numeral 151 represents a print key for starting a copying operation; 152, a ten key portion for entering numerical data such as a number of copies; 153, a clear/-stop key 153 for terminating multi-copying and for clearing entered numerical data; 154, an interruption key 154 for executing an interruption copy; 155, a selector key for selecting a mode being executed from the ordinary one side copying mode, the duplex copying mode, and the composite copying mode; 156, a magnification selector key for selecting a preset magnification or for designating an arbitrary magnification; 157, a copy sheet selection key for selecting a sheet size; 158, a document size detection mode selector key for selecting any of the previously mentioned AMS, APS, and manual modes; 159, a document feeding mode selector key for selecting a document feeding mode between a single feeding mode and a dual feeding mode.

The operation panel 150 is also provided with indicating means hereunder described.

Numeral 160 represents a 4-position display segment 160 for indicating, for example, a number of copies; 161, a 4-position display segment for indicating a manually designated magnification; 162 through 165, LEDs for indicating a preset copy magnification; 166, an LED for indicating the ordinary one side copying mode; 167, an LED for indicating the duplex copying mode; 168, an LED for indicating the composite copying mode; 169, LEDs for indicating a copy sheet size; 170, an LED for indicating the AMS mode; 171, an LED for indicating the APS mode; 172, an LED for indicating the manual mode; 173 for indicating the single feeding mode; 174, an LED for indicating the dual feeding mode. The indication of the LEDs described above increments or decrements step by step every time being pressed.

(Control Circuit)

FIGS. *7a* and *7b* show the input/outputs of the first CPU 201 that controls the copying machine 1, as well as of the second CPU 202 that controls the ADF 100, wherein the CPUs 201 and 202 are connected with each other to enable synchronized operation.

To the input/output ports on the first CPU 201 are connected the key switches 151 through 159 on the operation panel, as well as a switch matrix 203 including the microswitches SW1 through SW10 on the sheet feeding portion; and via the switch matrix 203 and a decoder 205, the display segment 160 and a matrix 204 of the indication LEDs. From the output ports on the first CPU 201 are output on/off signals to a main motor, a developing motor and the like within the copying machine 1. A pulse signal of the main motor is input to a terminal 81.

To the input ports on the second CPU 202 are connected the detection switch PSW that detects elevating of the ADF 100, the ADF start switch SSW, the sensors SE1 through SE4 that detect document feeding, and the sensor SE5 that detects the rotation of the pinch roller motor 123. To the output ports on the second CPU 202 are connected the pick up roller 112, a feeding motor that drives the separation rollers 113 and 114, a transport motor that drives the transport belt 125, a solenoid that moves, the upper pick up roller 112 vertically, a discharge motor that drives the discharge rollers 131 through 134. A pulse signal of the transport motor is input to a terminal B2.

A clock terminal SCK for data sampling and outputting, an interruption output terminal PCO, a data output terminal SOUT and a data input terminal SIN, each on the first CPU 201 are connected, correspondingly, to a clock input terminal SCK, an interruption input terminal INT, a data input terminal SIN and a data output terminal SOUT, each on the second CPU 202.

(Control Procedure)

The control procedure of the first embodiment is hereunder described in detail referring to the attached FIG. 8 through FIG. 19.

Figure 8:
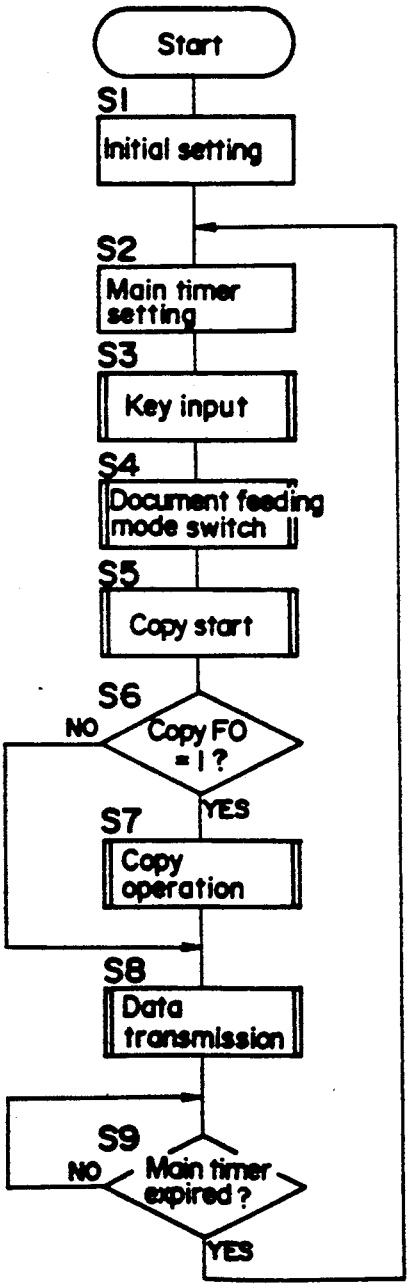

In the following paragraphs, the term "on-edge" is defined as change in status, where the switch, sensor, signal or the like changes from the OFF status to the ON status. In contrast, the term "off-edge" represents change in status, where the switch, sensor, signal or the like changes from the ON status to the OFF status FIG. 8 is a flow chart showing a main routine of the first CPU 201, wherein the copying machine 1 is controlled.

When the first CPU 201 is reset, the program is started. At step S1, the first CPU 201 clears the random access memory and various registers built in it, and sets the initial mode for each device.

First, the flags used in the routines hereunder described are as follows:

Copy flag F0: a flag that indicates the copying machine 1 is in operation, and remains at "1" during a period from the completion of copy start process and until the completion of copying.

Mode flag F1: a flag that indicates a document feeding mode on the ADF 100, and is set by the feeding mode selection key 159, where the flag indicates the single feeding mode when is reset to "0", and the dual feeding mode when is set to "1".

Feeding flag F2: a flag that indicates the number of documents actually transported to the platen glass 19; indicates one document when is reset to 0, and indicates two documents when is set to "1"; even under the dual feeding mode, if a total number of documents is an odd number, the status of this flag F2 is "0" while a final document is transported; the feeding flag F2 is set by a signal from the second CPU 202 for a number of fed document.

Arithmetic flag F20: a flag used, in the APS or AMS mode, for arithmetically determining the type of copy sheets and magnifications, and is set based on the document feeding mode and a number of documents actually fed, wherein the flag F20 is reset to "0" instructs the arithmetic operation in conjunction with the single feeding mode, and, when is set to "1", instructs the similar operation in conjunction with the dual feeding mode.

The next routines are hereunder described. At step S2, a main timer on the first CPU 201 is set. The main timer counts the time required for the main routine. The count of the main timer is preset by the initialization, at step S1.

Subroutines at steps S3 through S5 are sequentially called. Step S3 is a subroutine for processing key input, where data are entered with the ten key portion 152, the size data for copy sheets in the cassettes 30 and 35 are stored into the internal RAM, the copy mode selection with the copy mode selection key 155, and the magnification setting with the magnification setting key 156. Step S4 is a subroutine for processing the switching of document feeding mode, wherein the selection of the document feeding mode of the ADF 100 by the feeding mode selection key 159 is treated. Step S5 is a subroutine for processing copy start, wherein the initiation of copying operation is processed.

At step S6, whether the copy flag F0 is set to "1" is judged. If the flag F0 is reset to "0", the processing proceeds to step 88; if the flag F0 has been reset to "1", the processing proceeds to step S7 where a subroutine for carrying out actual copying operation is executed and the processing proceeds to step S8. At step S8, data transmission to and from the second CPU 202 is processed. The signals transmitted during step S8 are as follows: signals from the first CPU 201 to the second CPU 202 are copying operation in progress signal, document feeding mode signal, and document replace signal that is generated at the completion of image exposure scanning for a designated number of copying cycles From the second CPU 202 to the first CPU 201, the following signals are transmitted.

ADF mode signal: a signal to be set to "1" when documents are in the document tray 111, and reset to "0" when a final document has been ejected, under the condition that copying operation is in progress and the ADF 100 not in operation.

Setting complete signal: a signal being output once a document is fed to and placed on the specified position on the platen glass 19.

Document size signal: a code signal for document size detected by the sensors SE3 and SE5 on ADF 100.

Feeding number signal: a signal that indicates a number of documents fed onto the platen glass 19.

Inhibition signal: a signal being output when a size of document being fed is irrelevant for copying.

Once the processing in the above subroutines is complete, the processing proceeds to step S9, where the duration of previously mentioned main timer elapses, and then, the processing returns to step S2. The duration of the one routine is used as a standard for the counting cycles of various times used in the respective timers. In other words, the completion of counting cycle of the respective timers are judged based on how many times this one routine has been repeated.

Figure 9:
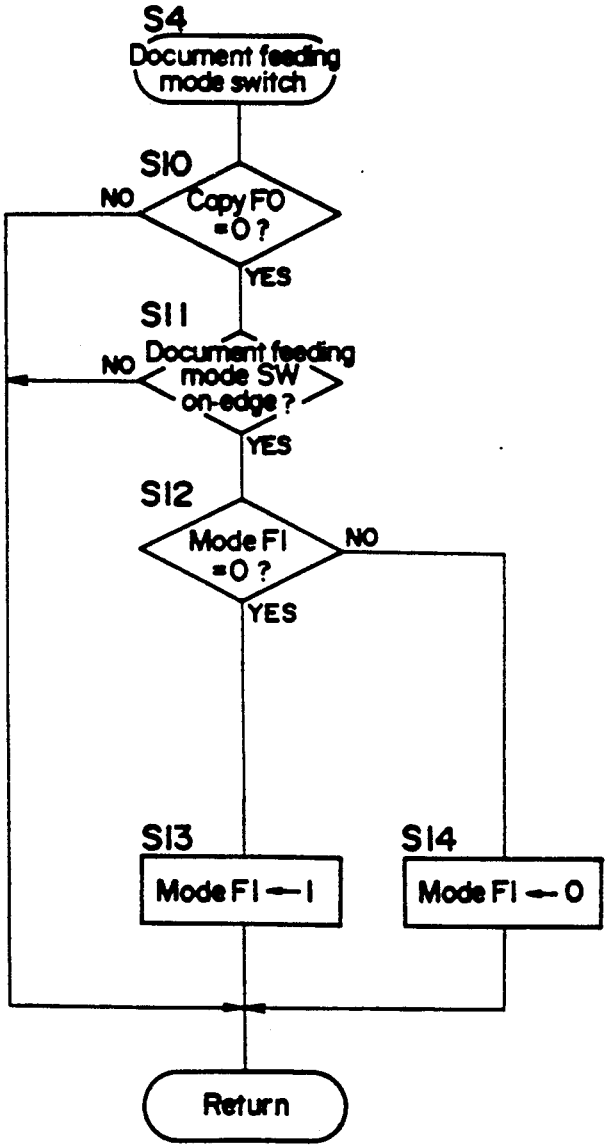

FIG. 9 is a flow chart showing the subroutine at step S4 in the main routine, where processing for switching document feeding mode is executed.

At step S10, whether the copy flag F0 is reset to "0" is judged; if the copy flag F0 is set to "1" i.e. the copying operation is in progress, the processing returns to the mainroutine; if the flag F0 is reset to "0", the processing proceeds to step S11, where whether the status of the document feeding mode selection switch 159 is "on-edge" is judged. If the current status is not "on-edge", the processing returns to the main routine. When the status has been "on-edge", the processing proceeds to step S12, where whether the status of the mode flag F1 is at "0" is judged. If the mode flag F1 has been reset to "0", that is, the single feeding mode has been designated, the processing proceeds to step S13, where the mode flag F1 is set to "1" i.e. the dual feeding mode has been designated. If the mode flag F1 is judged to be at "1", the mode flag F1 is reset to "0" at step S14, which means that the single feeding mode is selected.

Figure 10A:
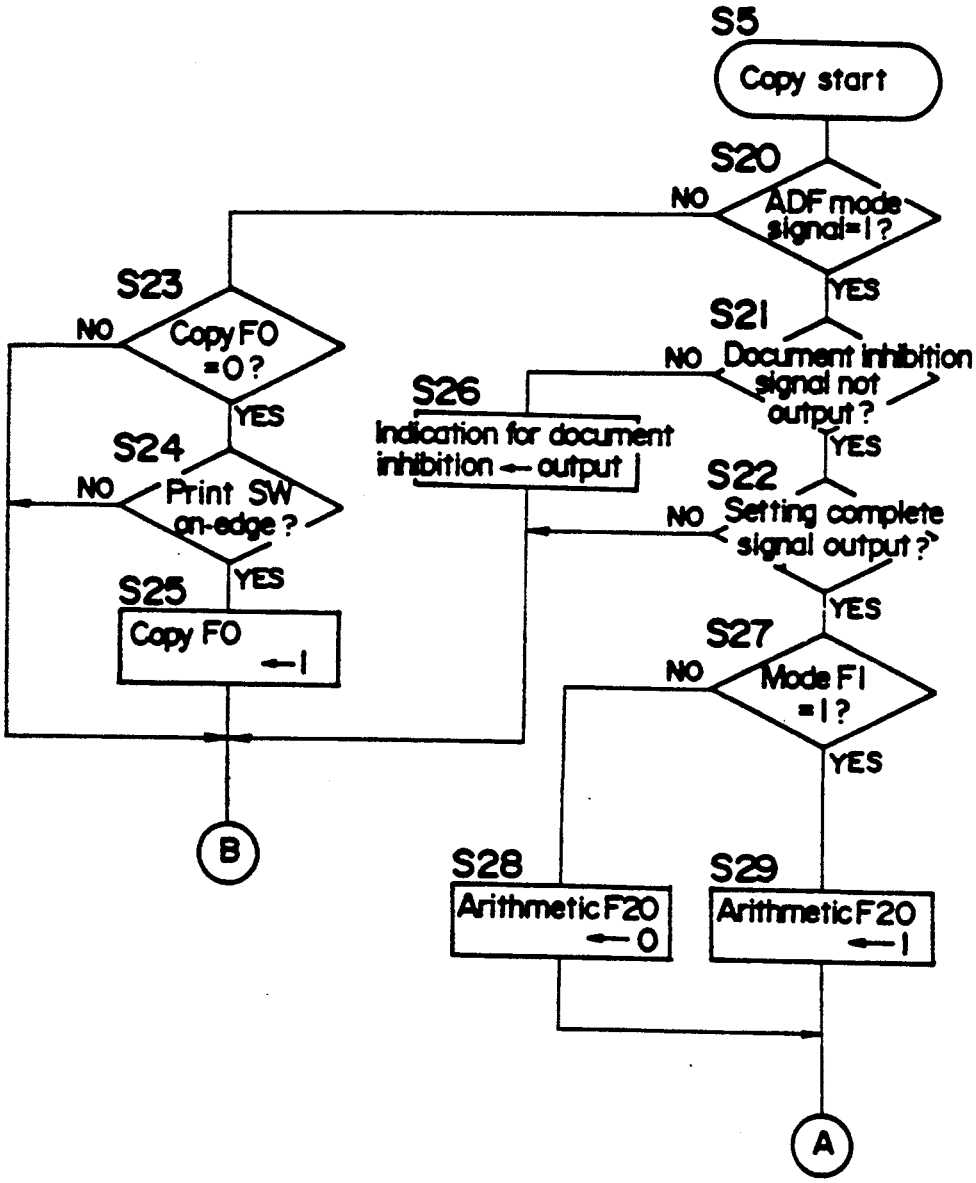
FIGS. 10*a* and 10*b* are flow charts showing a subroutine for the copy start processing.
Figure 10B:
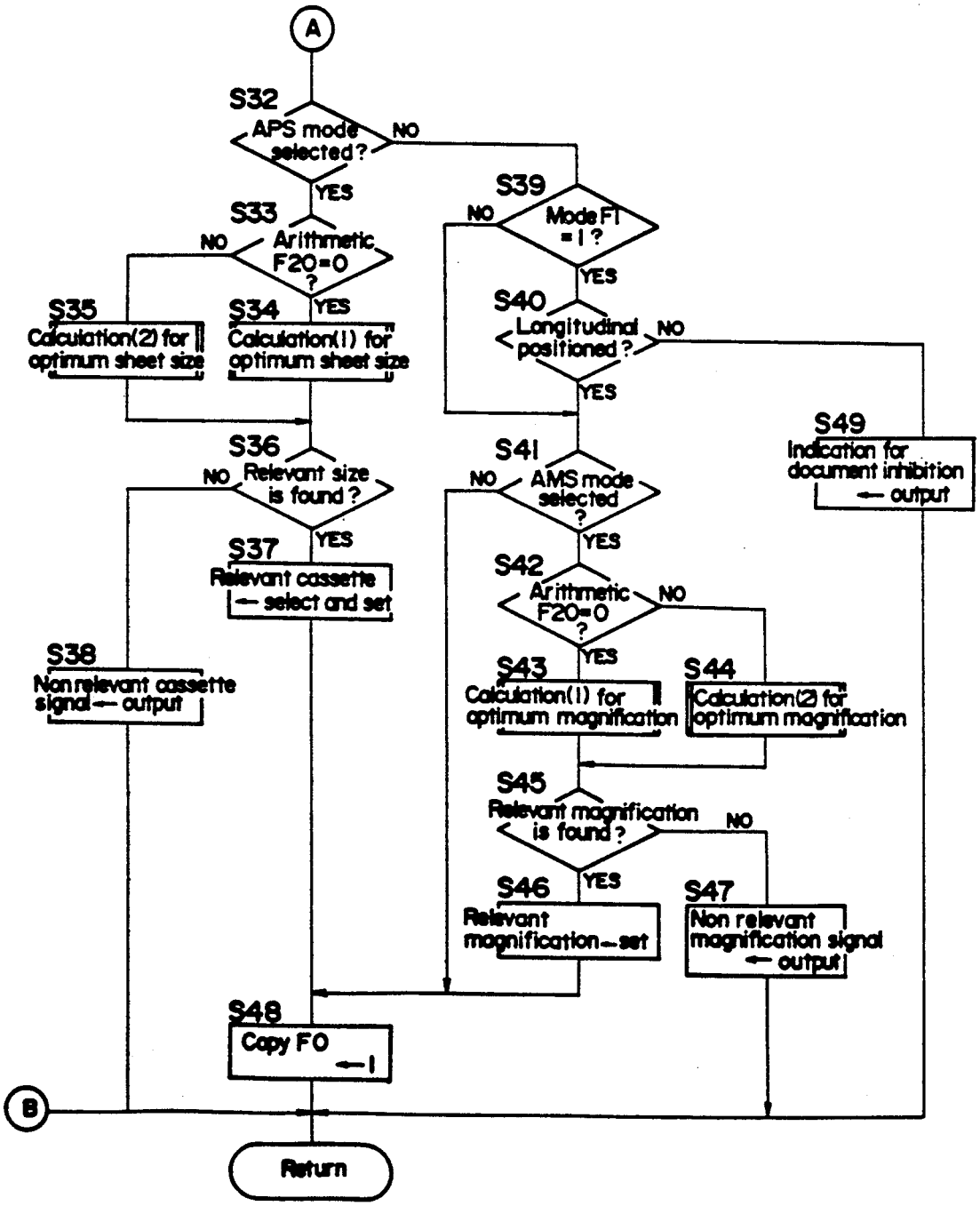

FIGS. 10*a* and 10*b* are flow charts showing the subroutine at step S5 in the main routine, where processing for copy start is executed. In this subroutine, processing in the APS and AMS modes are concurrently executed.

At step S20, whether the status of ADF mode signal is at "1" is judged. If this signal has been set to "1" i.e. the copying operation using the ADF 100 has been selected (refer to step S123), the processing proceeds to step S21, where whether the document inhibition signal is not being output is judged. If the document inhibition signal has not been output, whether the setting complete signal is being output is judged at step S22. If the setting complete signal is not being output, the processing changes to the standby status; once this signal has been output i.e. a document is placed onto the specified position on the platen glass 19 (refer to steps S170 and S212), whether the status of the mode flag F1 is at "1" is judged at step S27. If the mode flag F1 is reset to "0"; at step S28, the arithmetic flag F20 is reset to "0", the processing proceeds to step S32. If the mode flag F1 is set to "1", the arithmetic flag F20 is set to "1" at step S29, the processing proceeds to step S32.

At step S21, if the document inhibition signal is judged to be output (refer to step S206), the inhibition indication is output and the copying operation is inhibited at step S26.

At step S20, if the ADF mode signal is judged to be reset to "0", then, at step S23, after the confirmation of the copy flag F0 being reset to "0", whether the status of the print switch 151 is "on-edge" is judged at step S24 Once the status of the print switch 151 has changed to "on-edge", the copy flag F0 is set to "1" at step S25, the processing returns to the main routine.

Next, at step S32, whether the APS mode has been selected is judged. If the APS mode has been selected, whether the status of the arithmetic flag F20 is at "0" is subsequently judged at step S33. If the arithmetic flag F20 has been reset to "0" i.e. if the APS mode has been selected in conjunction with the single feeding mode, calculation processing (1) for the optimum copy sheet size is performed, at step S34, based on the above-mentioned table 3*a*. Then, the processing proceeds to step S36. If the arithmetic flag F20 has been set to "1" i.e. if the APS mode has been selected in conjunction with the dual feeding mode, calculation processing (2) for the optimum copy sheet size is performed, at step S35, based on the above-mentioned table 3*b*. Then, the processing proceeds to step S36.

Next, at step S36, whether the copy sheets with the size arithmetically determined at step S34 or S35 have been stored in either of the cassette is judged. If there are relevant copy sheets, the relevant cassette is selected and activated at step S37. Subsequently, the copy flag F50 is set to "1" at step S48, and the processing returns to the main routine. If a relevant cassette is not found, the indication showing that the copy sheets of the optimum size have not been stored in either of the cassette is generated at step S38 in order to warn an operator via appropriate display means (e.g. display segment 160).

At the above-mentioned S32, if the APS mode has not been selected, whether the status of the mode flag F1 is at "1" is judged at S39, the mode flag F1 is reset to "0" i.e. if the single feeding mode is executed, the processing proceeds to step S41. The mode flag F1 is set to "1" i.e. if the dual feeding mode is executed, whether the sheet selected now is longitudinal positioned is judged at step S40. If the sheet is longitudinal positioned, the processing then proceeds to step S41, but if the sheet is latitudinal positioned, the inhibition signal is output at step S49 to inhibit the start of copying operation. This arrangement is provided due to the following reason: If the sheets are latitudinal positioned, and when the dual feeding mode has been selected, setting an appropriate magnification for copying serially placed a pair of documents to one copy sheet is impossible, regardless of the size of the documents placed onto the platen glass 19 (in this embodiment, the sizes of the documents are limited to the same sizes). Even if copying operation is inhibited, however, an operator can select the longitudinal positioned sheets.

Next, at step S41, whether the AMS mode has been selected is judged. If the AMS mode has not been selected, the copy flag F0 is set to "1" at step S48, the processing returns to the main routine. If the AMS mode has been selected, whether the status of the arithmetic flag F20 is at "0" is judged at step S42. If the arithmetic flag F20 has been reset to "0", calculation processing (1) for the optimum magnification is performed, at step S43, based on the above-mentioned table 2*a*. Then, the processing proceeds to step S45. If the arithmetic flag F20 has been set to "1", calculation processing (2) for the optimum magnification is performed, at step S44, based on the above-mentioned table 2*b*. Then the processing proceeds to step S45.

Subsequently, at step S45, whether the magnification arithmetically determined the previous step S43 or S44 is within the scope of the specification of the copying machine 1 is determined. If the magnification is in compliance with the specification, the magnification determined at step S46 is designated, and at step S48, the copy flag F0 is set to "1". Subsequently, the processing returns to the main routine. In contrast, if the magnification is irrelevant, the signal indicating the calculated magnification not in compliance with the specification is generated at step S47, and the indication warns an operator via the appropriate display means (e.g. display segment 160).

As described above, setting the copy flag F0 to "1" at step S25 or S48 starts copying processing above-mentioned step S8. Since the control operation of copying processing, and that of the APS mode and AMS mode are well known in the art, the details of these functions are not particularly described here.

Figure 11:
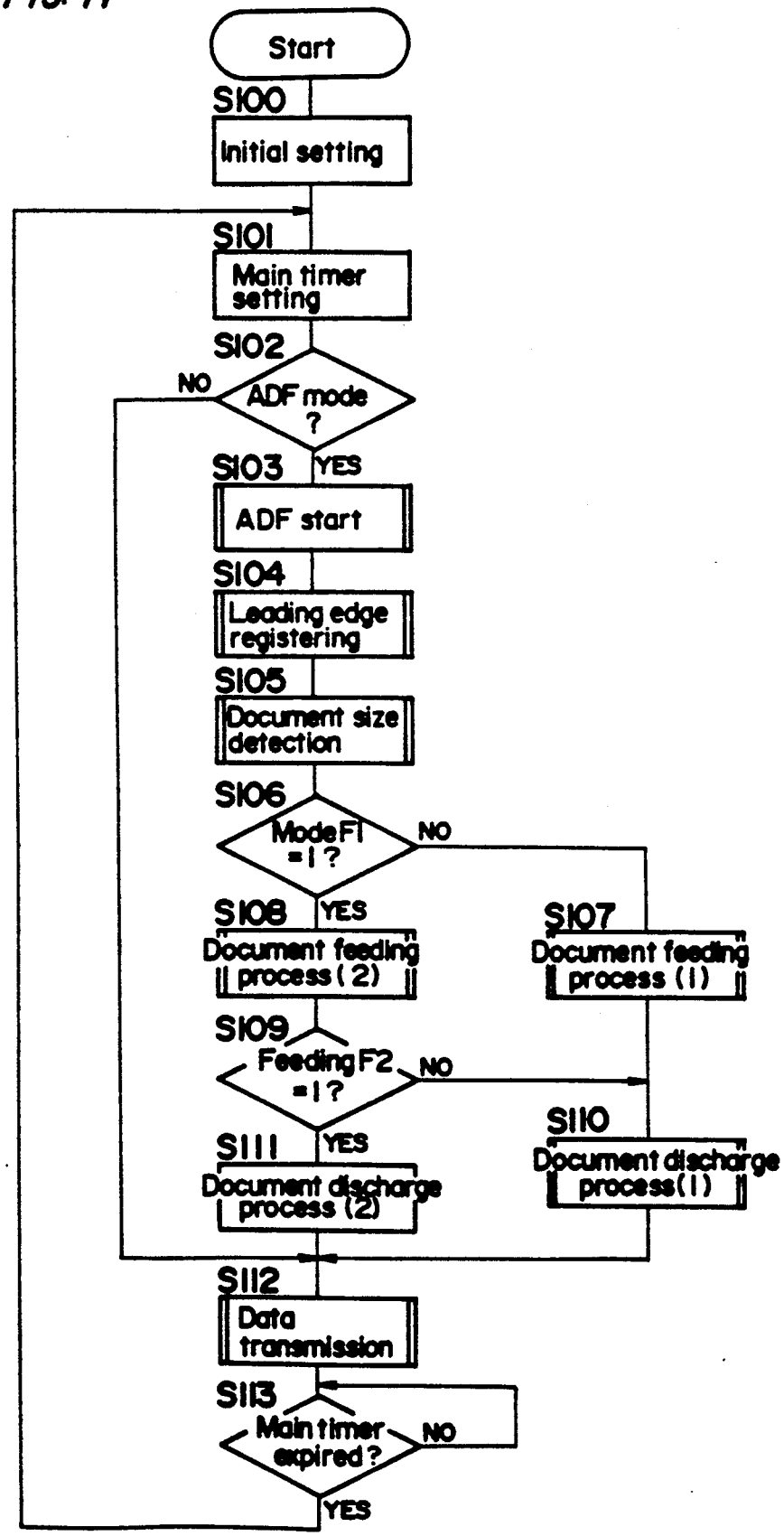

FIG. 11 is a flow chart showing a main routine of the second CPU 202, wherein the ADF 10 is controlled.

When the second CPU 202 is reset, the program is started. At step S100, the second CPU 202 clears the random access memory and various registers built in it, and sets the initial mode for each device.

The flags used in the routines hereunder described are as followed.

The copy flag F0, the mode flag F1, and the feeding flag F2 identical with those used for controlling the first CPU 201.

ADF operation flag F3: a flag that indicates that the ADF 100 is in operation, and remains at "1" after the initiation of document feeding, until the discharge of a final document.

ADF feeding flag F4: a flag that indicates that the ADF 100 is feeding a document, and remains at "1" after the initiation of document feeding, until the placement of document to the specified position on the platen glass 19.

Leading edge register flag F5: a flag that indicates that the leading edge is being registered, and remains at "1" after the initiation of feeding for the first and second documents, until the completion of the leading edge registering.

Leading edge register start flag F6: a flag that indicates timing to initiate the leading edge registering, and remains at "1" after the initiation of feeding for the first and second documents, until the feed motor and the pick up roller 112 are actuated.

Wait flag F7: a flag that indicates that a document stays at the leading edge registering position, and remains at "1" after the completion of the leading edge registering process, until the resumption of document feeding toward the platen glass 19.

Setting complete flag F8: a flag that indicates that a document fed from the document tray 111 is positioned in the specified position on the platen glass 19, and remains at "1" after the completion of feeding to the platen glass 19, until the initiation of a document discharge from the platen glass 19.

Discharge flag F9: a flag that indicates that a document is being discharged from the platen glass 19 to the discharge tray 135, and remains at "1" after the output of the document replace signal, until the completion of document discharge.

Document flag F10: a flag that indicates that whether a document being fed in the dual feeding mode is the first or second document, wherein if the status of the flag is at "0", the document is the first document in the pair; and if "1", the document is the second document in the pair.

The next routines are hereunder described. At step S102, whether the current mode is the ADF mode is judged. If "NO", the processing proceeds to step S112; if "YES", the subroutines at steps S103 through S105 are called sequentially. At step S103, a process for detecting the "on-edge" of ADF start switch SSW is detected so as to initiate the operation of the ADF 100. At step S104, the leading edge registering i.e. a process for feeding a document from the document tray 111 to the leading edge registering position on the pinch rollers 121 and 122, is executed. At step S105, a process for detecting a size of document fed from the document tray 111 is executed.

At step S106, whether the status of the mode flag F1 is at "1" is judged. If the mode flag F1 is reset to "0" i.e. the current mode is the single feeding mode, the subroutines at steps S107 and S110 are called, and the processing proceeds to step S112. At step S107, a process to feed documents one by one to the platen glass 19 is executed. At step S110, a process to discharge one document to the discharge tray 135 is executed.

If the mode flag F1 is judged to be at "1" at step S106 i.e. the current mode is the dual feeding mode, the subroutine at step S108 is executed, thereby a process for feeding a pair of documents is sequentially onto the platen glass 19 is executed. At step S109, whether the status of the feeding flag F2 is at "1" is judged. If the current status is at "1", the subroutine at step S111 is executed, thereby a pair of documents are sequentially discharged onto the discharge tray 135, and the processing proceeds to step S112. If the feeding flag F2 is reset to "0", the subroutine at the above-mentioned step S110 is executed and the processing proceeds to step S112.

At step S112, input/output data to and from the first CPU 201 are processed. The signals transmitted at step S112 are identical with those described in the processing at the above-mentioned step S8.

Upon completing these subroutines, the processing returns to step S101 once the previously mentioned main timer completes the counting cycle. The duration of the one routine is used as a standard for the counting cycles of various times used in the respective times.

Figure 12:
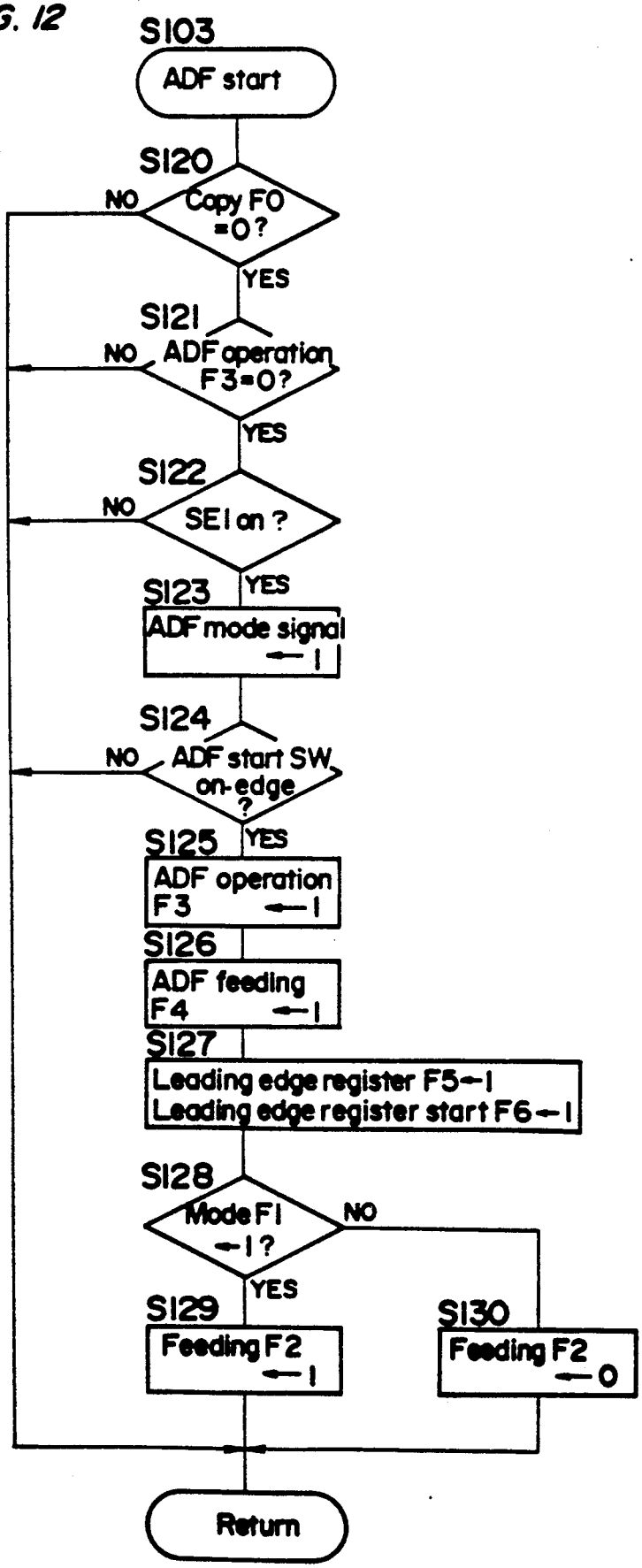

FIG. 12 is a flow chart showing the subroutine at step S103 in the main routine of the second CPU 202, where the ADF start process is executed.

First, at step S120, whether the copy flag F0 is reset to "0" is judged; at step S121, whether the ADF operation flag F3 is reset to "0" is judged; at step S122, whether the status of the sensor SE1 on the document tray 111 is at on is judged. If any one of the above three criteria is judged to be "0" or "NO", the processing immediately returns to the main routine. If all three of the above criteria are judged to be "1" or "YES" i.e. the copying operation is not in progress, ADF 100 is not operating, and a document to be fed is remaining on the document tray 111, the ADF mode signal is set to "1" at step S123.

At step S124, once the status of the ADF start switch SSW becomes "on-edge", then, at step S125, the ADF operation flag F3 is set to "1"; at step S126, the ADF feeding flag F4 is set to "1"; at step S127, the leading edge register flag F5 and the leading edge register start flag F6 are set to "1". At step S128, whether the status of the mode flag F1 is at "1" is judged. If judged to be "1", the feeding flag F2 is set to "1" at step S129; if judged to be "0", the feeding flag F2 is reset to "0" at step S130, thus terminating this subroutine.

Figure 13:
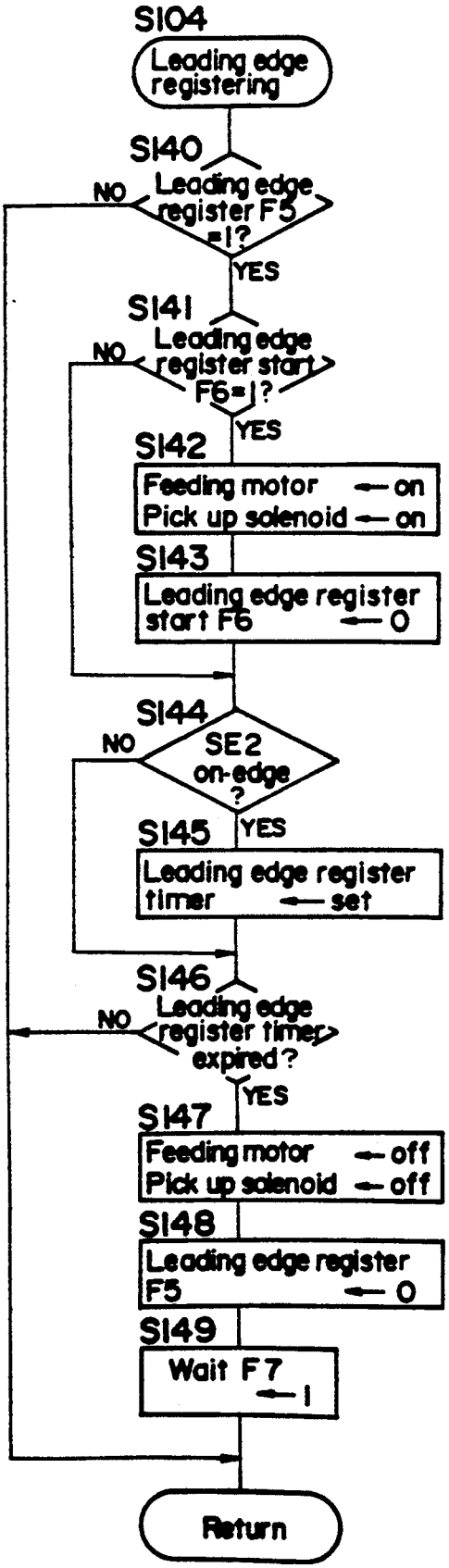

FIG. 13 is a flow chart showing the subroutine at step S104 in the main routine of the second CPU 202, wherein leading edge registering is executed.

At step S140, whether the status of the leading edge register flag F5 is at "1" is judged. If the flag F5 is reset to "0", the processing immediately returns to the main routine; then, if the status is set to "1", whether the status of the leading edge register start flag F6 is at "1" is judged at step S141. If the flag F6 is reset to "0", the processing proceeds to step S144. If the status of this flag F6 is at "1", the feeding motor and pick-up solenoid are activated at step S142, thereby the pick up roller 112 comes into contract with the uppermost document and rotates, and, at the same time, the separation rollers 113 and 114 start rotation, and the uppermost document only is fed out from the document tray 111 (refer to FIG. 3*a*). Next, at step S143, the leading edge register start flag F6 is reset to "0" and the processing proceeds to step S144.

At step S144, whether the status of the sensor SE2 is "on-edge" is judged. If the status is not "on-edge", the processing proceeds to step S146; if the status has been "on-edge", the leading edge register timer is set at step S145 and the processing proceeds to step S146. The predetermined counting duration of the timer corresponds with a period where the leading edge of a document is detected by the sensor SE2, and, then, the leading edge of the documents comes into contact with the nipping portion between the pinch rollers 121 and 122 and forms a loop. Accordingly, at step S147, the feeding motor and the pick up solenoid are turned off, once the leading edge register timer completes the counting cycle at step S146. At the same time, at step S148, the leading edge register flag F5 is reset to "0", and at step S149, the wait flag F7 is set to "1", thus terminating this subroutine. By the above process, the leading edge of a document fed from the document tray 111 comes into contact with the nipping portion between the pinch rollers 121 and 122, thereby its skew is corrected, and the document temporarily remains stationary in the upstream side of the nipping portion (refer to FIG. 3*b*).

Figure 14:
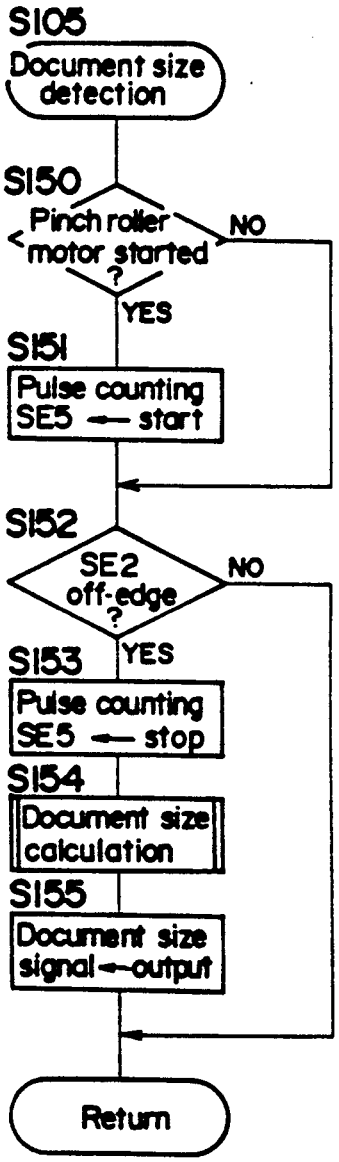

FIG. 14 is a flow chart showing the subroutine at step S105 in the main routine of the second CPU 202, wherein the detection of a document size is processed. This subroutine is executed during a period where a document is fed from the leading edge registering position to the specified position on the platen glass 19, thereby the longitudinal length of document is detected by counting pulses using the sensor SE5, and, in conjunction with the counting results, count, the on/off status of the sensor SE3 for detecting the latitudinal width of document is used to detect the document size.

First, at step S150, whether the pinch roller motor 123 has started is judged. The motor 123 is turned on later, at step S164. If the motor 123 has not yet started, the processing proceeds to step S152. If the motor 123 has started, the pulse counting with the sensor SE5 is started at step S151 and the processing proceeds to step S152. If the sensor SE2 is judged to have been "off-edge", at step S152, the pulse counting is stopped at step S153, thereby at step S154, the document size is arithmetically determined based on the pulse count result and the on/off signal of the sensor SE4. At step S155, the determined document size is output as the document size signal, thus this subroutine is completed.

Figure 15:
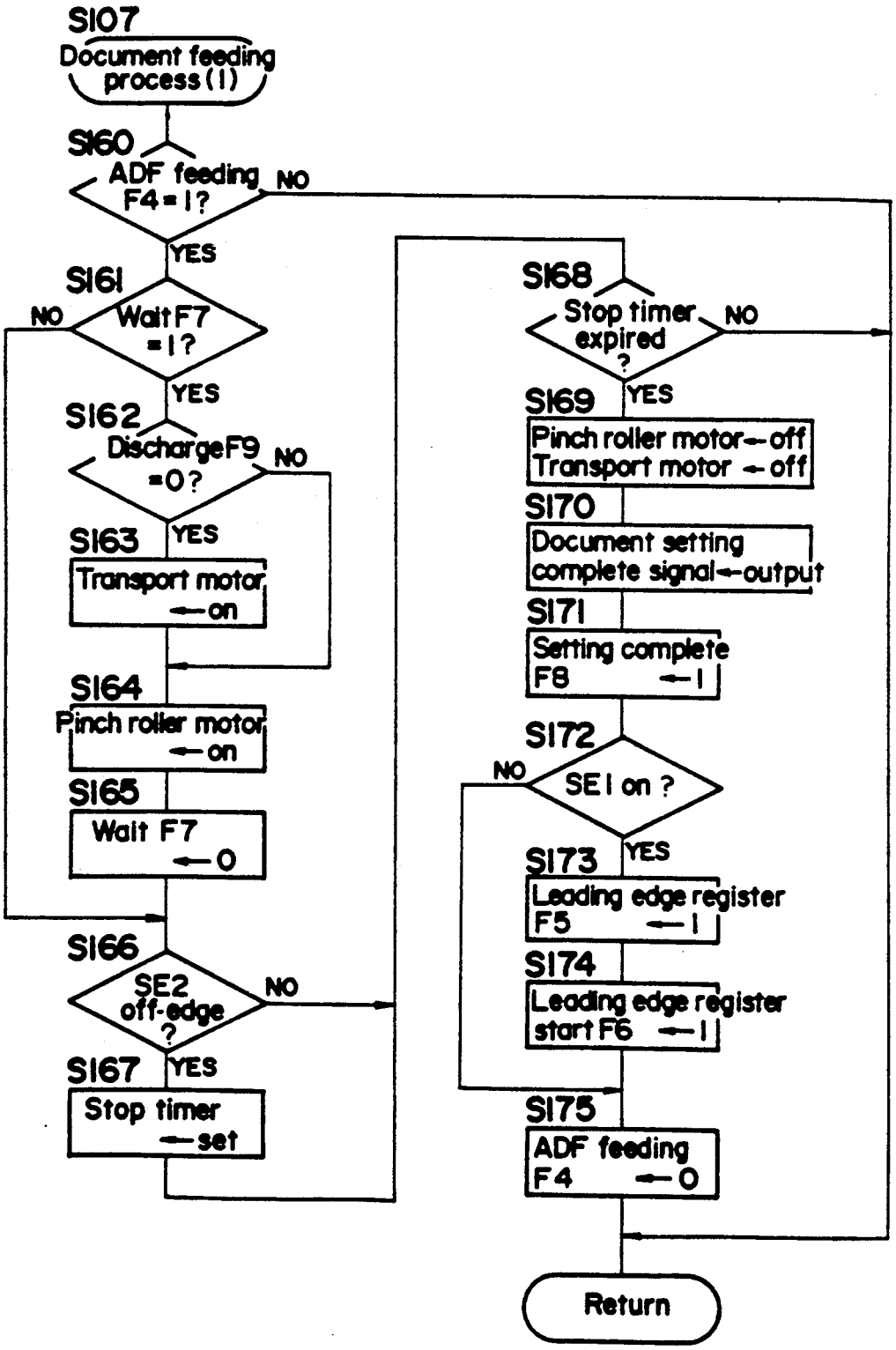

FIG. 15 is a flow chart showing the subroutine at step S107 in the main routine of the second CPU 202, wherein the document feeding process (1) in the single feeding mode is executed.

At step S160, whether the status of the ADF feeding flag F4 is at "1" is judged. If the flag F4 has been reset to "0", the processing immediately returns to the main routine. If the current status of the flag F4 is at "1" i.e. once the ADF start switch SSW is turned on, whether the the status of the wait flag F7 is at "1" is judged at step S161. If the wait flag F7 has been reset to "0", the processing proceeds to step S166. If the status of this flag F4 is at "1" i.e. the leading edge of a document has been registered by the pinch rollers 121 and 122, then, whether the status of the discharge flag F9 is at "0" is judged at step S162. If the discharge flag F9 has been already set to "1", the processing proceeds to step S164. If the flag F9 has been reset to "0", a transport motor is turned on at step S163; the pinch roller motor 123 is turned on at step S164; the wait flag F7 is reset to "0" at step S165; and the processing proceeds to step S166. Thus, the document feeding from the leading edge registering position toward the platen glass 19 is resumed.

At step S166, whether the status of the sensor SE2 is "off-edge" is judged. If the current status of SE2 is not "off-edge", the processing proceeds to step S168; if the status of the sensor SE2 is "off-edge", the stop timer is set at step S167 and the processing proceeds to step S168. One counting duration of the stop timer corresponds with a duration from when the trailing edge of a document passes the sensor SE2 when the document reaches the initial exposing position on the platen glass 19. Accordingly, at step S168, once the counting duration of the stop timer elapses, then, at step S169, the pinch roller motor 123 and the transport motor are turned off; at step S170, the document setting complete signal is output to the first CPU 201; and at step S171, the setting complete flag F8 is set to "1". Thus, a documents is fed and placed onto the specified position on the platen glass 19.

At step S172, whether the status of the sensor SE1 is on is judged. If the status is on i.e a next document to be copied is on the document tray 111, the leading edge register flag F5 is set to "1" at step S173 in order to execute the leading edge registering process with this document. At step S174, the leading edge register start flag F6 is set to "1"; at step S175, the ADF feeding flag F4 is reset to "0", thus this subroutine is completed. At the above-mentioned step S172, if the sensor SE1 is off i.e. document tray 111 is empty; at step S175, the ADF feeding flag F4 is reset to "0", thus this subroutine is completed.

Figure 16A:
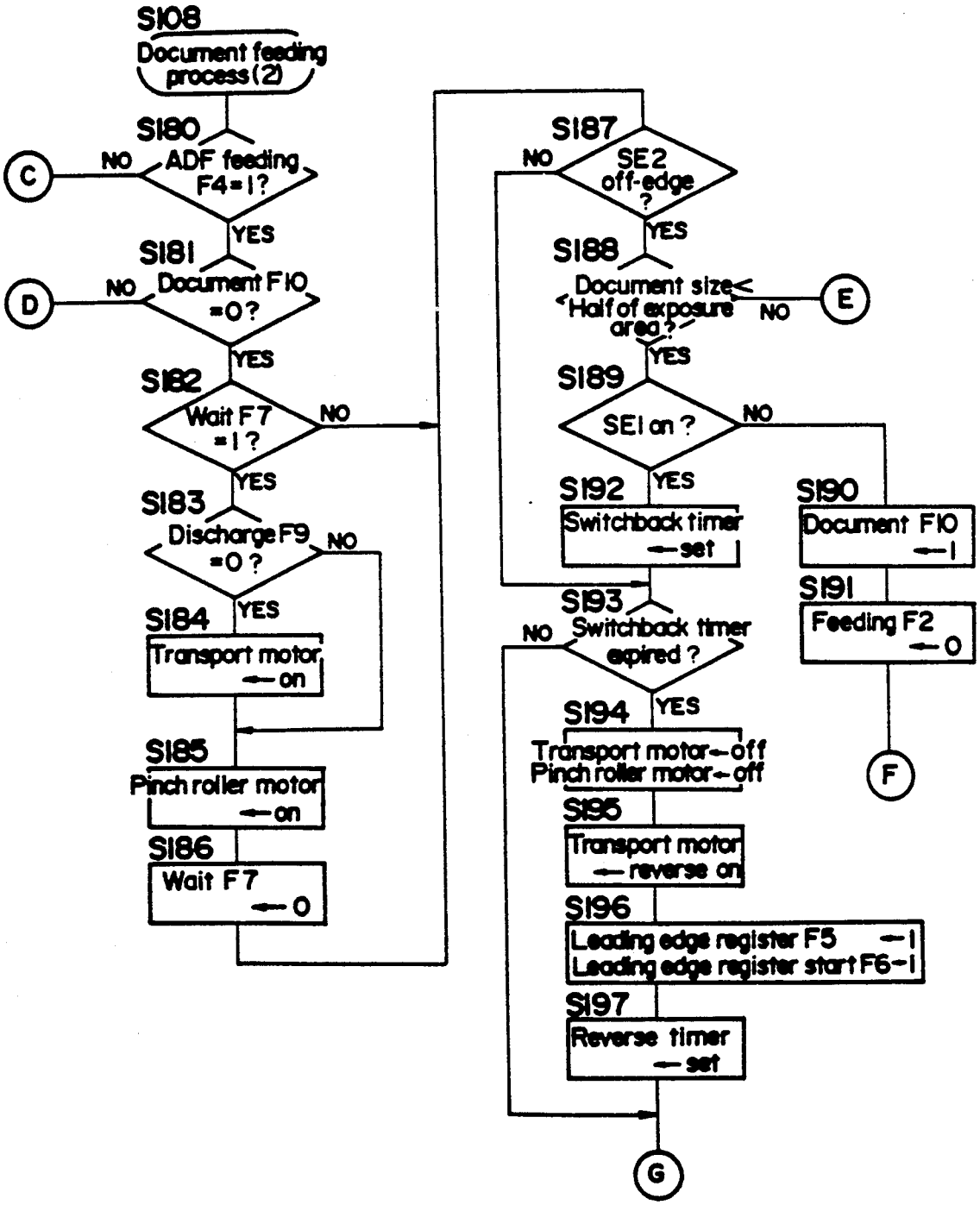
FIGS. 16*a* and 16*b* are flow charts showing a subroutine for the document feeding process (2)
Figure 16B:
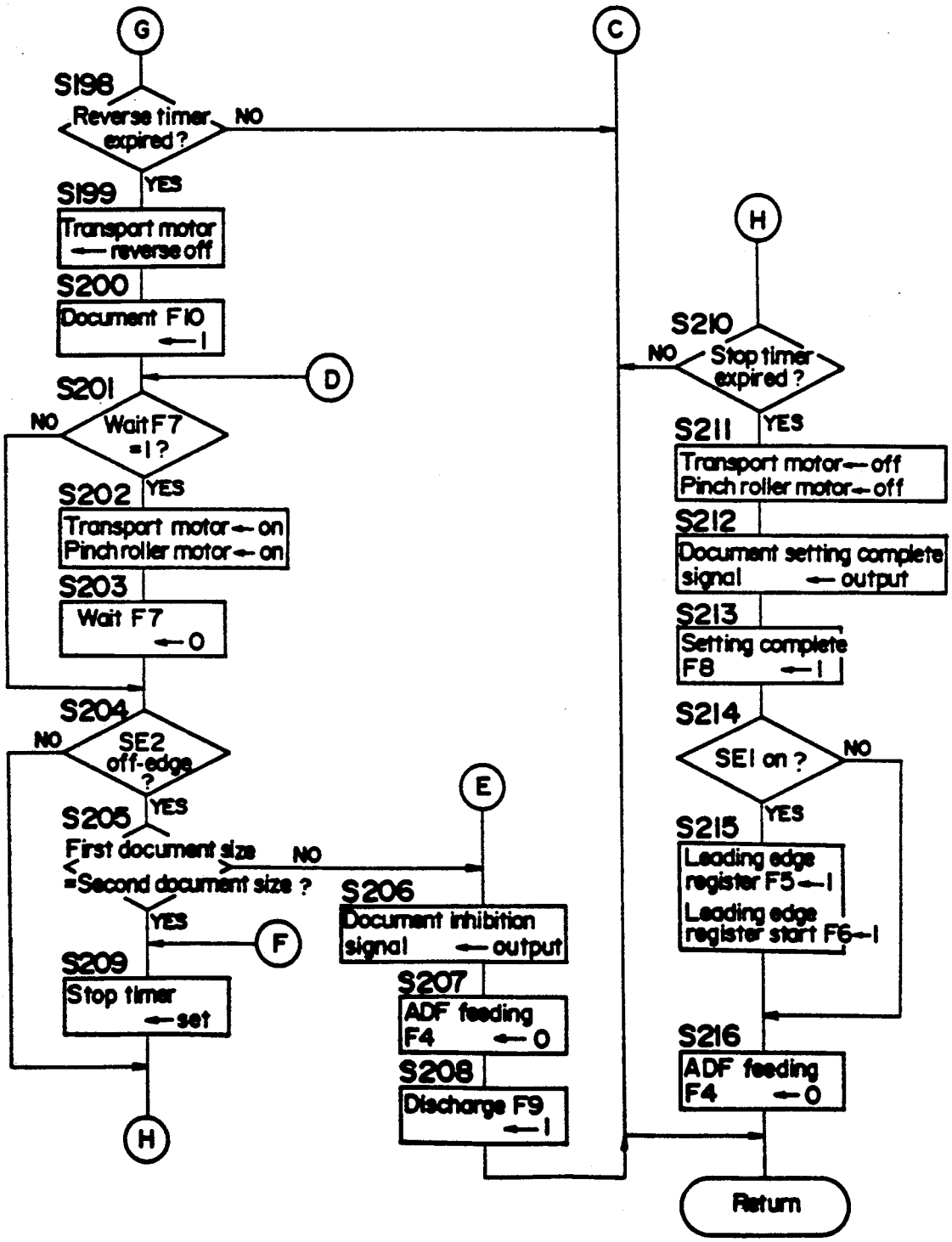

FIGS. 16*a* and 16*b* are flow chart showing the subroutine at step S108 in the main routine of the second CPU 202, wherein the document feeding process (2) in the dual feeding mode is executed. In this subroutine, the dual feeding process is executed only when the first and second documents are of a common size and both are smaller than the half of the entire exposure area (the maximum document image scanning area which can be scanned by the optical system 20). When documents of other sizes are fed, the copying operation is inhibited and the documents are discharged.

First, at step S180, whether the status of the ADF feeding flag F4 is at "1" is judged. If the flag F4 is reset to "0", the processing immediately returns to the main routine. If the current status of the flag F4 is at "1" i.e. once the ADF start switch SSW is turned on, whether the status of the document flag F10 is "0" is judged at step S181.

If the document flag F10 has been set to "1" i.e. a document to be fed is a second document of a pair, the processing proceeds to step S201. If the document flag F10 has been reset to "0" i.e. a document to be fed is a first document of a pair, whether the status of the wait flag F7 is at "1" is judged at step S182. If the wait flag F7 has been reset to "0", the processing proceeds to step S187. If the wait flag F7 has been set to "1" i.e. the leading edge of the first document has been already registered, then, at step S183, whether the status of the discharge flag F9 is at "0" is judged. If the discharge flag F9 has been set to "1", which means that the document discharge process is under way for a pair of documents and the transport motor has been already turned on, the processing proceeds to step S185. If the discharge flag F9 has been reset to "0", the transport motor is turned on at step S184; the pinch roller motor 123 is turned on at step S185; the wait flag F7 is reset to "0" at step S187. The processing then proceed to step S187. Thus, the feeding of a first document from the leading edge registering position toward the platen glass 19 is resumed (refer to FIG. 3*c*).

At step S187, whether the status of the sensor SE2 is "off-edge" is judged. If the status of the sensor SE2 has been "off-edge"; at step S188, whether the first document size is smaller than the half of the entire exposure area is judged. A copy operation in the dual feeding mode, as above-mentioned, is preferably performed by properly forming the images of the two documents on one sheet. Therefore, the combined size of the serially placed pair of documents on the platen glass 19 should be smaller than the exposure area determined based on the copy sheet size and the magnification. At the same time, the size of each document should be the same and smaller than the half of the entire exposure area. For example, if the sheet is the longitudinal positioned A3 size and the magnification is 1.000, the exposure area is 420 mm. Thus, the size of each document should be less than 210 mm (half of the exposure area) in the document feeding direction i.e. the latitudinal orientation A4 size, B5 size and A5 size, and longitudinal orientation A5 size.

Thus, if the document size is judged at step S188, to be larger than the half of the entire exposure area, the document image is not properly copied to one sheet. Accordingly, at step S206, the document inhibition signal is output onto the first CPU 201, and, at step S207, the ADF feeding flag F4 is reset to "0"; at step S208, the discharge flag F9 is set to "1" in order to instruct the document to be discharged. The processing then returns to the main routine If the document size is judged to be smaller than the half of the entire exposure area, then, at step S189, whether the status of the sensor SE1 is on is judged. If the status is not on i.e. the second document of a pair is not in the document tray 111, and the document presently fed is the final document to be copied, then, at step S190, the document flag F10 is set to "1" in order to process the document as a second document of a pair, thereby at step S191, the feeding flag F2 is reset to "0", and the processing proceeds to step S209.

If the status of the sensor SE1 is already on at the previously mentioned step 8189 i.e. a second document of a pair is in the document tray 111, a switchback timer is set at step S192. The counting duration of the switchback timer corresponds with a duration between the time when the trailing edge of a document is detected by the sensor SE2 and the time when the document completely passes through the nipping portion between the pinch rollers 121 and 122.

At step S193, whether the counting duration of the switchback timer has elapsed is judged. If the duration has not elapsed, the processing proceeds to step S198. If the duration has elapsed, the transport motor and the pinch roller motor 123 are turned off at step S194 (refer to FIG. 3*d*). At step S195, the transport motor is turned on for the reverse movement to feed the first document backward to the pinch rollers 121 and 122. At step S196, the leading edge register start flag F6 is set to "1" to prepare the leading edge registering for the second document. Simultaneously, the reverse timer is set at step S197, and the processing proceeds to step S198. The counting duration of the reverse timer is a duration from the start of the reverse feeding of a document to the time when the trailing edge of the document becomes in contact with the nipping portion between the pinch rollers 121 and 122 that register the trailing edge.

At step S198, once the counting duration of the reverse timer elapses, then, at step S199, the transport motor turns off to stop its reverse rotation, thereby at step S200, the document flag F10 is set to "1" in order to process the second document onwards. Thus, the trailing edge of the first document being in contact with the nipping portion between the pinch rollers 121 and 122 are registered, thereby the document waits further process.

Next, at step S201, whether the status of the wait flag F7 is at "1" is judged i.e. whether the leading edge registering process for the second document has finished is judged. If the wait flag F7 has been reset to "0", the processing proceeds to step S204. If the wait flag F7 has been set to "1" i.e. the leading edge registering for the second document has completed in the above-mentioned subroutine at step S104 (refer to step S149), the transport motor and the motor 123 are turned on at step S202; the wait flag F7 is reset to "0" at step S203 and then the processing proceeds to step S204. Thus, the first and second documents are sequentially fed onto the platen glass 19 (refer to FIGS. 3*g* and 3*h*).

At step S204, whether the status of the sensor SE2 is "off-edge" is judged. If the current status is not "off-edge", the processing proceeds to step S210. If the status has been "off-edge", whether the size of the second document is same as the size of the first document is judged at step S205, when the trailing edge of the second document passes the sensor SE2. If the second document size is not same as the first document size, that is, a problem may occur when the pair of documents have different sizes, the document inhibition signal is output to the first CPU 201 at step S206; the ADF feeding flag F4 is reset to "0" at step S207; the discharge flag F9 is set to "1" at step S208 to instruct that the documents to be discharged. Then, the processing returns to the main routine. If the first and second documents are same in size, the stop timer is set at step S209 and the processing proceeds to step S210. The stop timer is identical with that set at step S167. At step S210, once the counting duration of the stop timer elapses, then, at step S211, the transport motor and the pinch roller motor 123 are turned off; at step S212, the document setting complete signal is output to the first CPU 201; and at step S213, the setting complete flag F8 is set to "1". Thus, the pair of documents are serial-sequentially fed onto the specified position on the platen glass 19 and positioned there (refer to FIG. 3*i*).

Next, at step S214, whether the status of sensor SE1 is on is judged. If the current status is not on i.e. the follows documents are in the document tray 111; at step S215, the leading edge register flag F5 and the leading edge register start flag F6 are set to "1" in order to process of the leading edge registering the next document as a first document of a pair. Then, at step S216, the ADF feeding flag F4 is reset to "0", thus this subroutine is completed.

Figure 17:
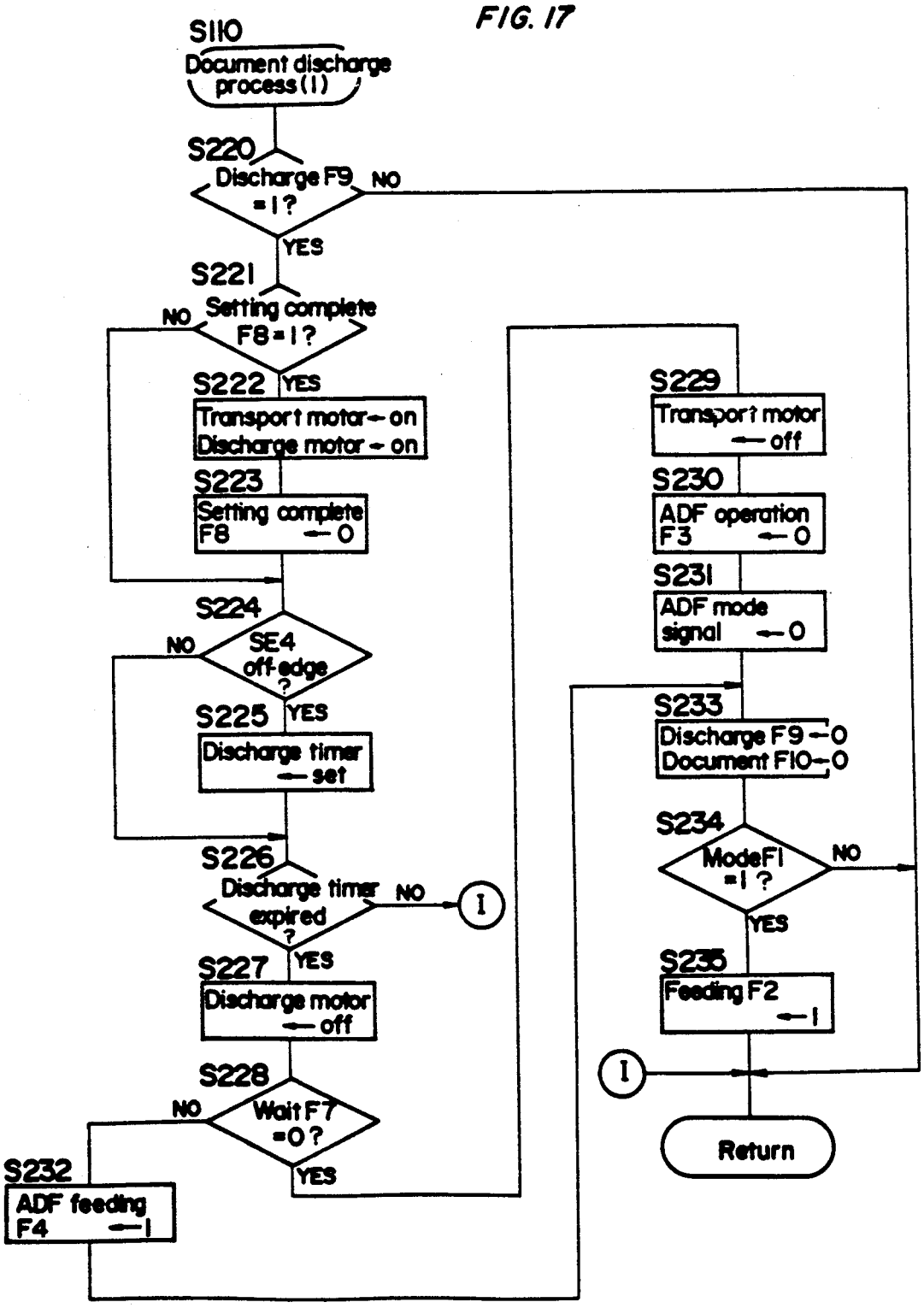

FIG. 17 is a flow chart showing the subroutine at step S110 in the main routine of the second CPU 202, wherein the document discharge process (1) in the single feeding mode is executed. This process is executed when the single feeding mode is selected, or when the final document of the odd number of documents is fed in the dual feeding mode, or a first document is judged to be improper for the copying in the dual feeding mode (judged "NO" at step S188).

First, at step S220, whether the status of the discharge flag F9 is at "1" is judged. The discharge flag F9 is set to "1" once the document replace signal is output when the image exposure-scanning for a predetermined number of copies completes. Accordingly, when the status of the discharge flag F9 remains set to "0", the processing immediately returns to the main routine. If the discharge flag F9 has been set to "1", whether the status of the setting complete flag F8 is at "1" is judged at step S221. If the setting complete flag F8 is reset to "0", the processing proceeds to step S224. If the setting complete flag F8 has been set to "1", the transport motor and the discharge motor are turned on at step S222, thereby the setting complete flag F8 is reset to "0" at step S223, and the processing then proceeds to step S224. Thus, the discharge of a document positioned on the platen glass 19 is initiated.

At step S224, whether the status of the sensor SE4 is "off-edge" is judged i.e. whether the trailing edge of a document has passed the sensor SE4 is judged. If the status is not "off-edge", the processing proceeds to step S226. If the status has been "off-edge", the discharge timer is set at step S225 and the processing proceeds to step S226. The counting duration of the discharge timer corresponds with a duration from when the trailing edge of the document is detected by the sensor SE4 and to when the document passes through the discharge rollers 133 and 134. Accordingly, at step S226, the counting duration of the discharge timer elapses; and at step S227, the discharge motor is turned off. Thus, a document is discharged onto the discharge tray 135.

Next, at step S228, whether the status of the wait flag F7 is at "0" is judged i.e. whether the next document is waiting at the leading edge registering position is judged. If the wait flag F7 has been set to "1", then, at step S232, the ADF feeding flag F4 is set to "1" in order to execute the feeding process, thereby the processing proceeds to step S233. If the wait flag F7 has been reset to "0" i.e. a document discharged is the final document of the stacked documents to be copied, the transport motor is turned off at step S229. Then, at step S230, the ADF operation flag F3 is reset to "0"; at step S231, the ADF mode signal is reset to "0" and output to the first CPU 201: and the processing proceed to step S233.

At step S233, the discharge flag F9 and the document flag F10 are reset to "0"; at step S234, whether the status of the mode flag F1 is at "1" is judged. If the mode flag F1 has been reset to "0" i.e. the single feeding mode is executed, the processing immediately returns to the main routine. If the mode flag F1 has been set to "1" i.e. the dual feeding mode is executed, at step S235, the feeding mode flag F2 is set to "1", the processing returns to the main routine.

Figure 18:
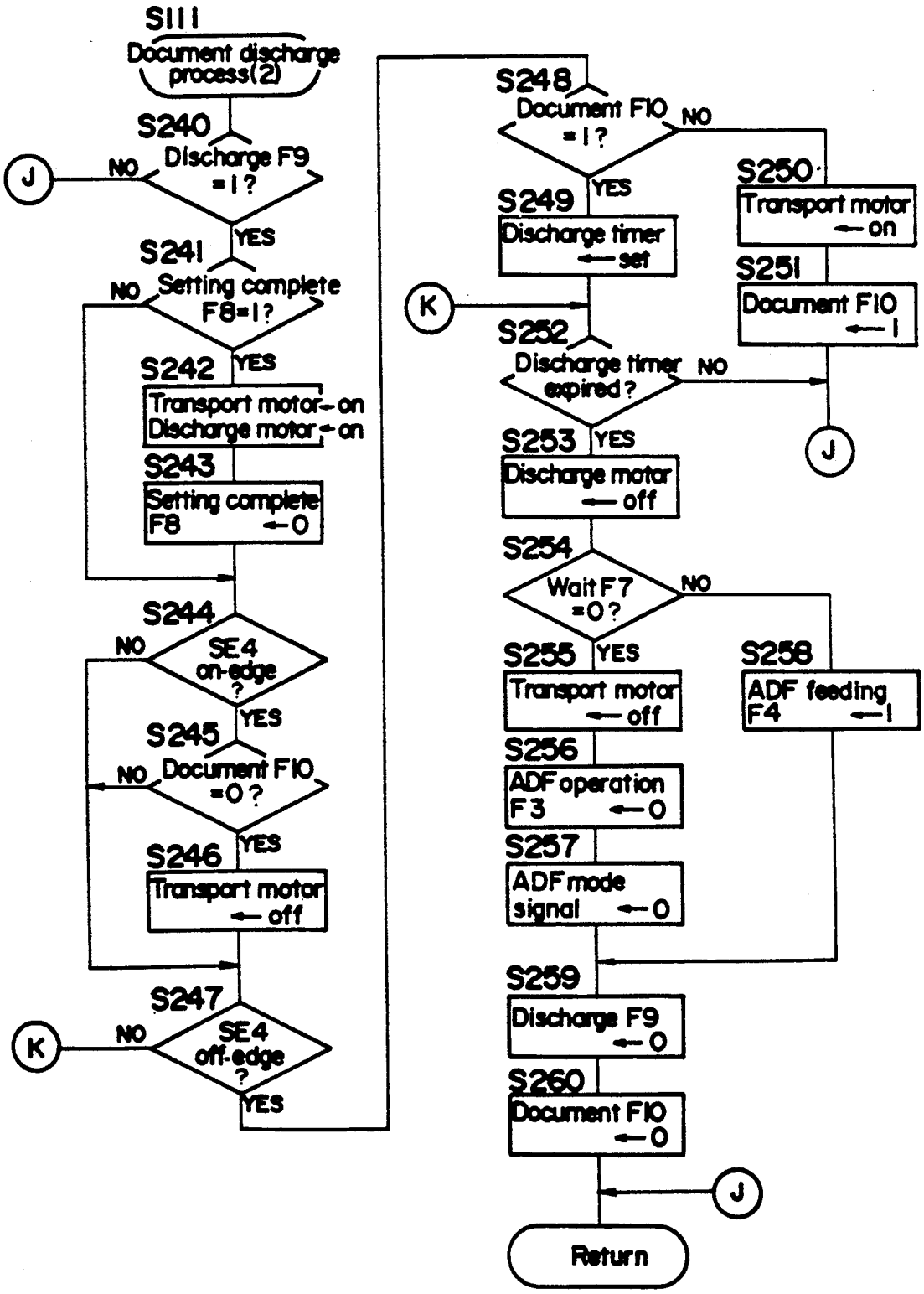

FIG. 18 is a flow chart showing the subroutine at step S111 in the main routine of the second CPU 202, where the document discharge process (2) in the dual feeding mode is executed. In this subroutine, the transport belt 125 temporarily is stopped once a first document is nipped between the discharge rollers 131 and 132 while being discharged, in order to allow a second document temporarily maintain a position on the platen glass 19 and make an opening among a pair of documents, enabling the pair of documents to be orderly discharged onto the discharge tray 135.

Figure 4A:
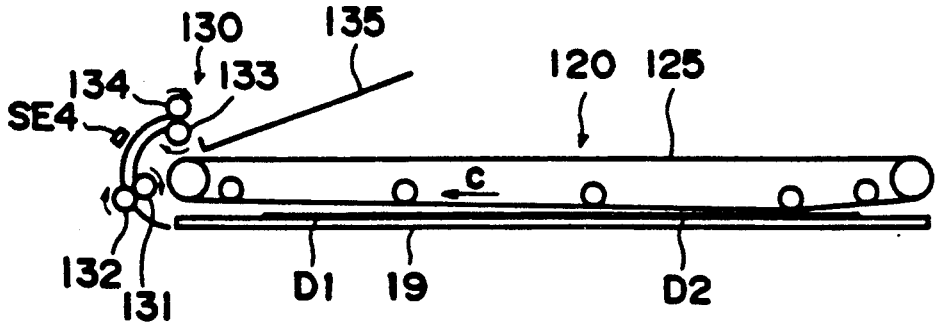
FIG. 4*a* through FIG. 4*e* are explanatory drawings showing the document discharging operation.
Figure 4B:
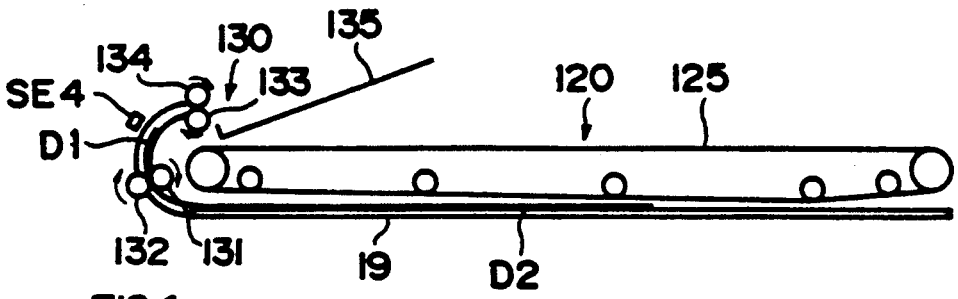
Figure 4C:
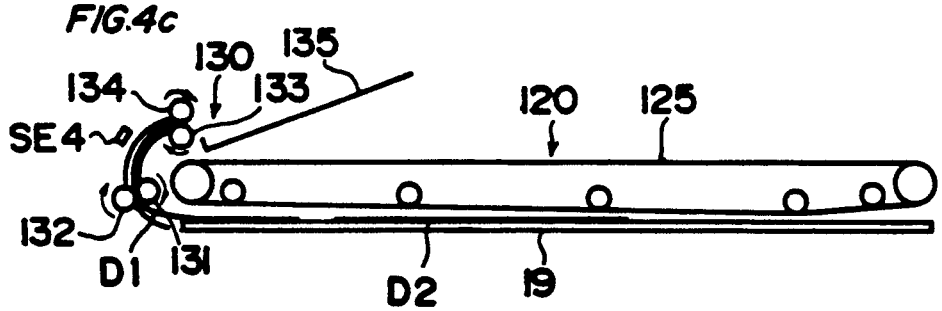
Figure 4D:
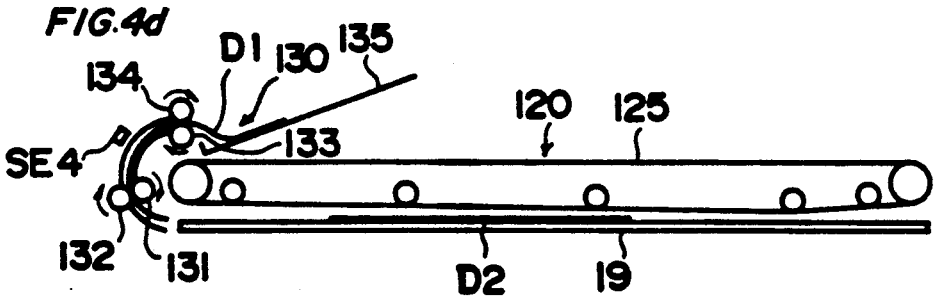
Figure 4E:
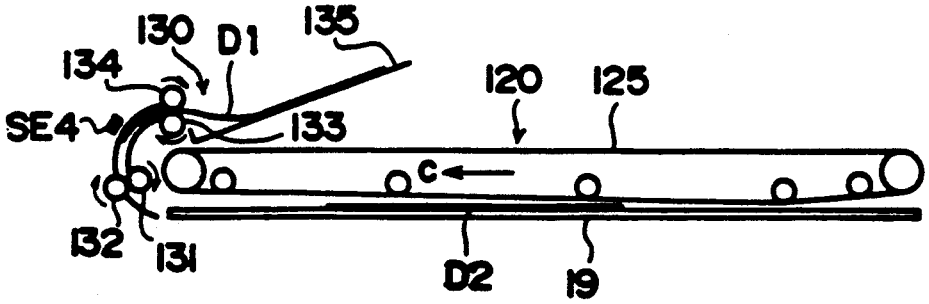

More specifically, step S240 through step S243 are identical with the previously mentioned step S220 through S223, whereby when the discharge flag F9 and the setting complete flag F8 are set to "1", the discharging is initiated (refer to FIG. 4*a*). At step S244, whether the status of the sensor SE4 is "on-edge" is judged. If the status is not "on-edge", the processing proceeds to step S247. If the status has been "on-edge", then, at step S245, whether the status of the document flag F10 is at "0" is judged. If the document flag F10 has been reset to "0" i.e. if the document of which leading edge has been detected at step S224 by the sensor SE4 is a first document of a pair, the transport motor is turned off at step S246, and the processing proceeds to step S247. Thus, the first document alone is discharged while the second document maintains its position on the platen glass 19 (refer to FIGS. 4b, 4c and 4d).

At step S247, whether the status of the sensor SE4 is "off-edge" is judged. If the status is not "off-edge", the processing proceeds to step S252. If the status has been "off-edge", then, whether the status of the document flag F10 is at "1" is judged at step S248. When the document flag F10 has been reset to "0" i.e. the document of which trailing edge is detected by SE4 at step S247 is the first document, then, the transport motor is turned on at step S250, and the document flag F10 is set to "1" at step S251, thereby the processing returns to the mainroutine. Thus, discharging the second document remaining on the platen glass 19 is initiated (refer to FIG. 4e).

At the previously mentioned step S248, if the document flag F10 is judged to be set to "1" i.e. the document of which trailing edge is detected at step S247 by the sensor SE4 is the second document, the discharge timer is set at step S249, thereby the processing proceeds to step S252.

Step S252 through step S257 are identical with the previously mentioned step S226 through step S231. At these steps, the discharge motor is turned off when the duration of the discharge timer elapses (judged "YES" at step S252; step S253), thereby the feeding process for the next document is initiated (judged "NO" at step S254; step S258), or, if the final document has been discharged, the termination process is executed (judged "YES" at step S254; steps S255, S256 and S257). Subsequently, at step S259, the discharge flag F9 is reset to "0", and at step S260, the document flag F10 is reset to "0", then this subroutine is completed.

Figure 19:
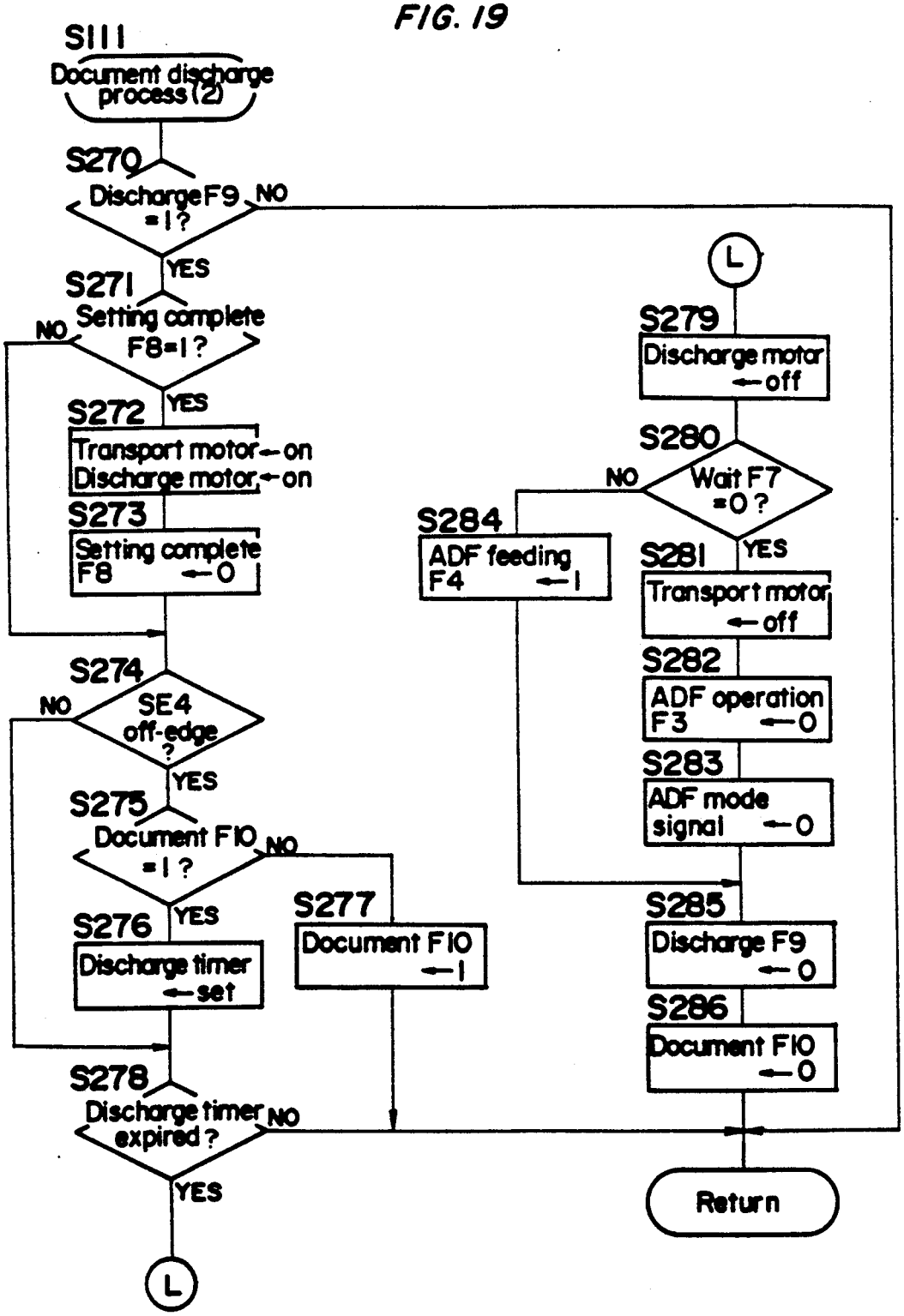

FIG. 19 is a flow chart showing the subroutine at step S111 in the main routine of the second CPU 202, wherein the other document discharge process (2) in the dual feeding is executed. In this subroutine, the document feeding speed of the discharge rollers 131 through 134 is set larger than that of the transport belt 125 so that the a pair of documents are orderly discharged onto the discharge tray 135 with an appropriate interval between them. More specifically, step S270 through step S273 are identical with the previously mentioned step S240 through step S243 and step S220 through step S223, whereby the discharge flag F9 and the setting complete flag F8 are set to "1", the discharging is initiated.

Figure 5B:
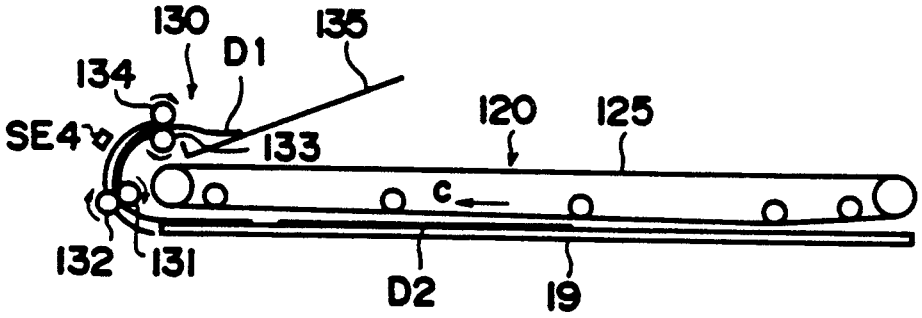
Figure 5C:
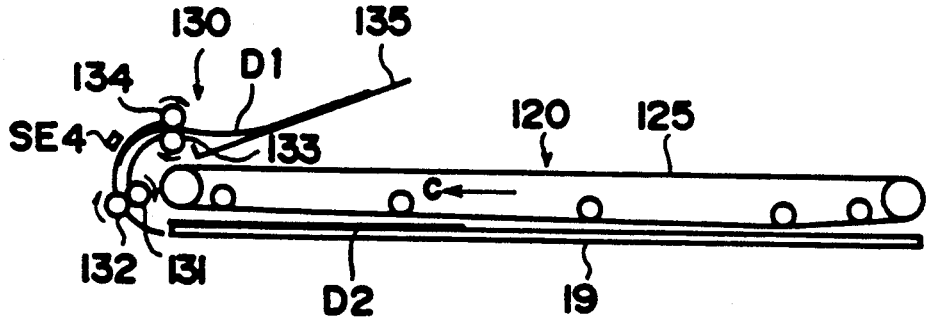

In this case, the document feeding speed of the discharge rollers 131 through 134 is set larger than that of the transport belt 125 so that an opening between a pair of documents gradually enlarges (refer to FIGS. 5a and 5b).

Next, at step S274, whether the status of the sensor SE4 is "off-edge" is judged. If the status is not "off-edge", the processing proceeds to step S278. If the status has been "off-edge", then, at step S275, whether the status of the document flag F10 is at "1" is judged. If the document flag F10 has been reset to "0" i.e. if the document of which trailing edge has detected at step S274 by the sensor SE4 is the first document of a pair, then, at step S277, the document flag is F10 is set to "1", thereby the processing returns to the main routine Next time this subroutine is called, and, if the document flag F10 is judged to have been set to "1" at step S275 i.e. the document of which trailing edge has been detected at step S274 by the sensor SE4 is the second document of a pair, then, at step S276, the discharge timer is set.

Step S278 through step S286 are identical with the previously mentioned step S252 through step S260. At these steps, the discharge motor is turned off when the duration of the discharge timer elapse (judged "YES" at step S278; step S279), thereby the feeding process for the next document is initiated, and this subroutine is completed (judged "NO" at step S280; steps S284, S285 and S286), or, if the final document is discharged, the termination process is executed (judged "YES" at step S280; steps S281, S282, S283, S285 and S286).

[Second Embodiment]

Figure 20A:
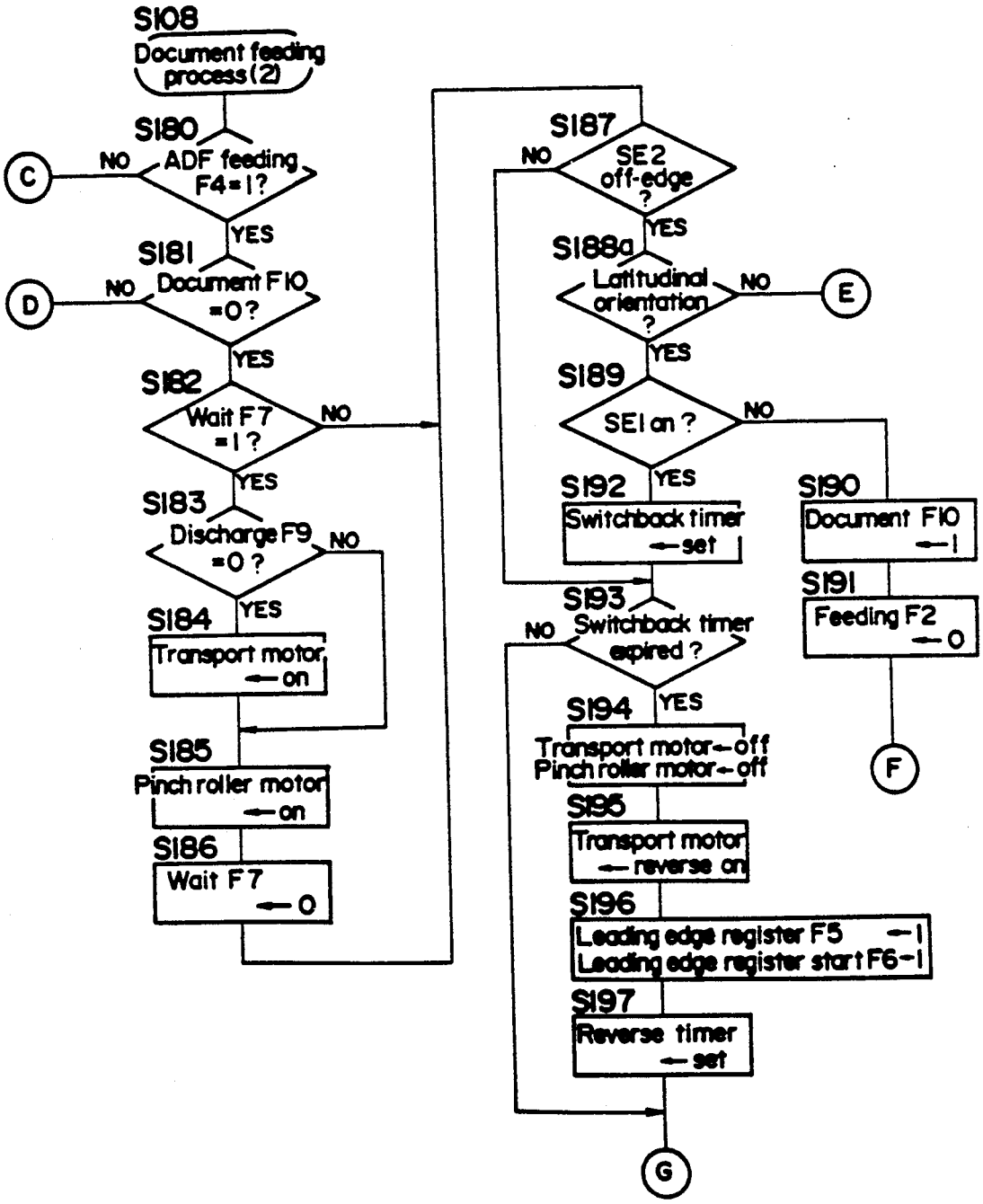
FIGS. 20*a* and 20*b* are flow charts showing a subroutine for the document feeding process (2) executed in a second embodiment of the present invention.
Figure 20B:
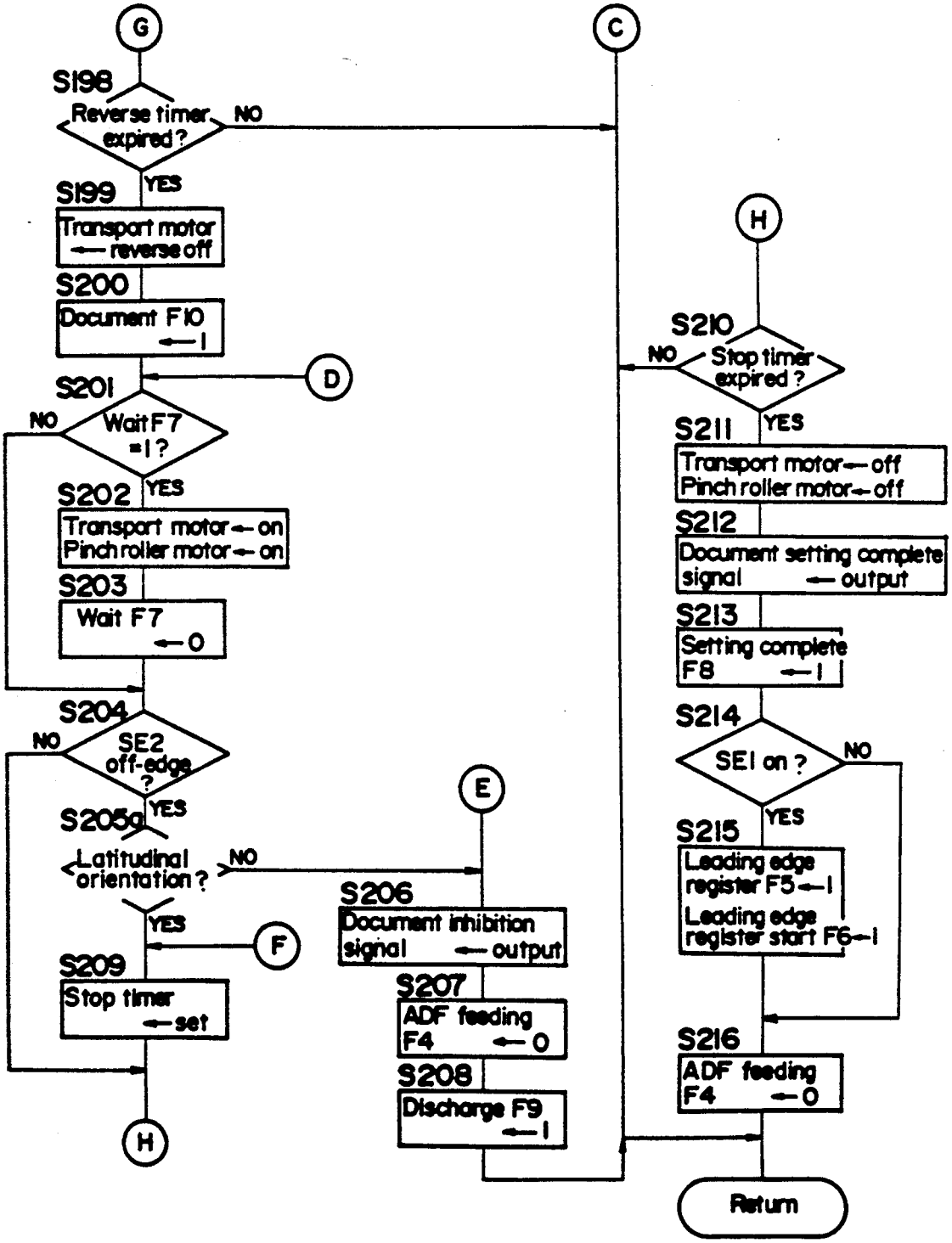

In this second embodiment, processing executed in the subroutine at step S108 alone has been replaced with the subroutine shown in FIG. 20a and 20b, and other processing is identical with above described in FIG. 8 through FIG. 19 in the first embodiment.

Referring now to FIG. 20a and 20b, at steps S188a and S205a, whether the latitudinal orientation of the document feeding is to be performed is judged, at the timing when the trailing edges of the first and second documents have passed the sensor SE2. If the documents are performed in the longitudinal orientation, the document image becomes too large to be copied to one sheet. Thus, at steps S206, S207 and S208, the document inhibition signal is output, the ADF feeding flag F4 is reset to "0" and the discharge flag F9 is set to "1".

Other processing procedures in this subroutine are identical with above described in FIGS. 16a and 16b in the first embodiment.

More specifically, in this second embodiment, the sizes of the first and second documents are detected in the dual feeding mode, as described previously, whereby if at least either of the documents is longitudinal orientation, the copying operation is inhibited. Therefore, the combinations of two document sizes which can be copied in the dual feeding mode involve the following three types of document sizes; latitudinal orientation A5 size, B5 size and A4 size. As in Table 4a given below, the six combinations of the above document sizes are available.

TABLE 4a

| Document Combination in Dual Feeding Mode | | | |
|---|---|---|---|
| | Document Size | | |
| | A5 La.O. | B5 La.O. | A4 La.O. |
| Document Size | | | |
| A5 Lo.O. | | | |
| A5 La.O. | A5 La.O. & A5 La.O. | | |
| B5 La.O. | B5 La.O. & A5 La.O. | B5 La.O. & B5 La.O. | |
| A4 La.O. | A4 La.O. & A5 La.O. | A4 La.O. & B5 La.O. | A4 La.O. & A4 La.O. |

(Lo.O. shows longitudinal orientation)
(La.O. shows latitudinal orientation)

Further, in the dual feeding mode executed in this embodiment, only the documents are fed in the latitudinal orientation can be copied, as described previously for the AMS mode. Accordingly, in the AMS mode in conjunction with the dual feeding mode, the optimum magnification is determined, based on the size twice as great as the larger one of the pair of documents. The following Table 2c exhibits the correlation among the document sizes, copy sheet sizes in the case of the AMS mode performed in conjunction with the dual feeding mode, as well as the magnifications determined based on the document sizes and copy sheet sizes.

For example, when the size of a copy sheet is the longitudinal positioned A4 and the combination of the document sizes includes the latitudinal orientation A4 and latitudinal orientation B5, the pair of documents are deemed to be two latitudinal orientation A4s. Consequently, the optimum magnification is arithmetically determined to be 0.707 and this magnification is designated. When the size of a copy sheet is the longitudinal positioned B6 and the combination of the document sizes includes the latitudinal orientation B5 and A5, the optimum magnification cannot be reached, and the system encourages an operator to manually set a magnification.

TABLE 2c

| | Duel Feeding Mode, By AMS (only latitudinal orientation) | | | | | | |
|---|---|---|---|---|---|---|---|
| | Sheet Size selected by Operator | | | | | | |
| | A6 Lo.P. | B6 Lo.P. | A5 Lo.P. | B5 Lo.P. | A4 Lo.P. | B4 Lo.P. | A3 Lo.P. |
| Combination of Document Sizes | | | | | | | |
| A5 La.O. & A5 La.O. | M | M | 0.707 | 0.866 | 1.000 | 1.225 | 1.414 |
| B5 La.O. & A5 La.O. | M | M | M | 0.707 | 0.816 | 1.000 | 1.154 |
| B5 La.O. & B5 La.O. | M | M | M | 0.707 | 0.816 | 1.000 | 1.154 |
| A4 La.O. & A5 La.O. | M | M | M | M | 0.707 | 0.866 | 1.000 |
| A4 La.O. & B5 La.O. | M | M | M | M | 0.707 | 0.866 | 1.000 |
| A4 La.O. & A4 La.O. | M | M | M | M | 0.707 | 0.866 | 1.000 |

Effective Magnification on Machine Ranges 0.640–1.430
(M shows manual mode)
(Lo.P. shows longitudinal positioned)
(La.O. shows latitudinal orientation)

In contrast, when performing copying operation in the dual feeding mode, only the documents are fed in the latitudinal orientation can be copied, as described previously for the AMS mode in this embodiment. Therefore, in the APS mode in conjunction with the dual feeding mode, the size of the optimum copy sheet is determined by multiplying the value twice as large as the size of the larger document among the pair of documents by the magnification. Table 3c given below exhibits the correlation among the document sizes, magnification, as well as the copy sheet sizes that are determined and designated based on the document sizes and the magnification, relative to the operation in the APS mode in conjunction with the dual feeding mode.

For example, when the combination of the document sizes is the latitudinal orientation A4 and A5, and the magnification is 0.707, the optimum copy sheet size in the dual feeding mode is determined as the longitudinal positioned A4, and the sheet feeder storing the longitudinal positioned A4 sheets is automatically selected. When the combination of the document sizes is the latitudinal orientation A4 and B5, the optimum copy sheet size cannot be determined, even if the magnification of 1.008 to 1.430 is designated. Consequently, the system encourages an operator to manually select a relevant sheet feeder.

TABLE 3c

| | Duel Feeding Mode, By APS (only latitudinal orientation) | | | | | | |
|---|---|---|---|---|---|---|---|
| | Magnification selected by Operator | | | | | | |
| | 0.640–0.711 | 0.712–0.823 | 0.824–0.871 | 0.872–1.007 | 1.008–1.159 | 1.160–1.231 | 1.232–1.430 |
| Combination of Document Sizes | | | | | | | |
| A5 La.O. & A5 La.O. | A5 Lo.P. | B5 Lo.P. | B5 Lo.P. | A4 Lo.P. | B4 Lo.P. | B4 Lo.P. | A3 Lo.P. |
| B5 La.O. & A5 La.O. | B5 Lo.P. | A4 Lo.P. | B4 Lo.P. | B4 Lo.P. | A3 Lo.P. | M | M |
| B5 La.O. & B5 La.O. | B5 Lo.P. | A4 Lo.P. | B4 Lo.P. | B4 Lo.F. | A3 Lo.P. | M | M |
| A4 La.O. & A5 La.O. | A4 Lo.P. | B4 Lo.P. | B4 Lo.P. | A3 Lo.P. | M | M | M |
| A4 La.O. & B5 La.O. | A4 Lo.P. | B4 Lo.P. | B4 Lo.P. | A3 Lo.P. | M | M | M |
| A4 La.O. & A4 La.O. | A4 Lo.P. | B4 Lo.P. | B4 Lo.P. | A3 Lo.P. | M | M | M |

Effective Magnification on Machine Ranges 0.640–1.430
(M shows manual mode)
(Lo.P. shows longitudinal positioned)
(La.O. shows latitudinal orientation)

[Third Embodiment]

Figure 21A:
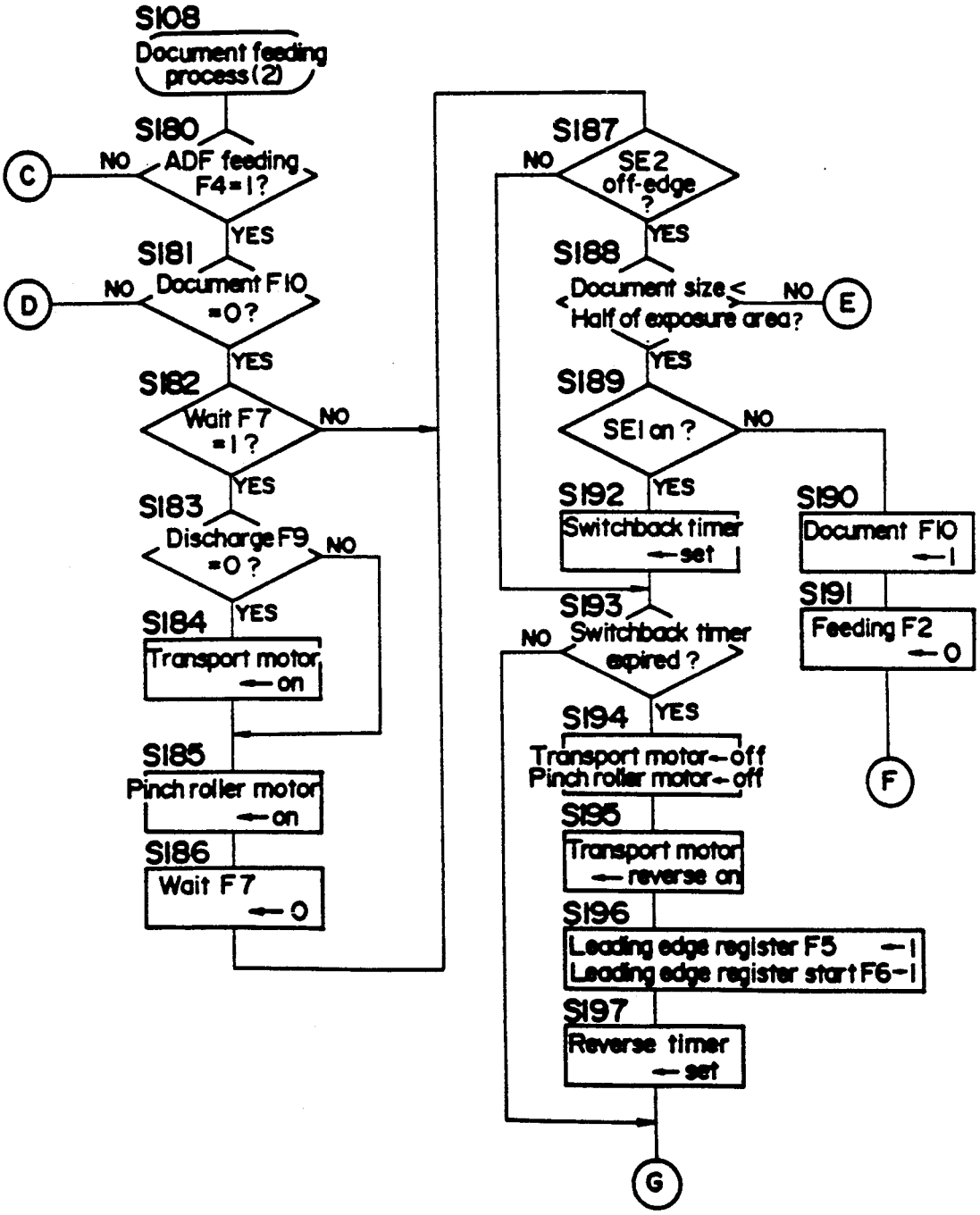
FIGS. 21*a* and 21*b* are flow charts showing a subroutine for the document feeding process (2) executed in a third embodiment of the present invention.
Figure 21B:
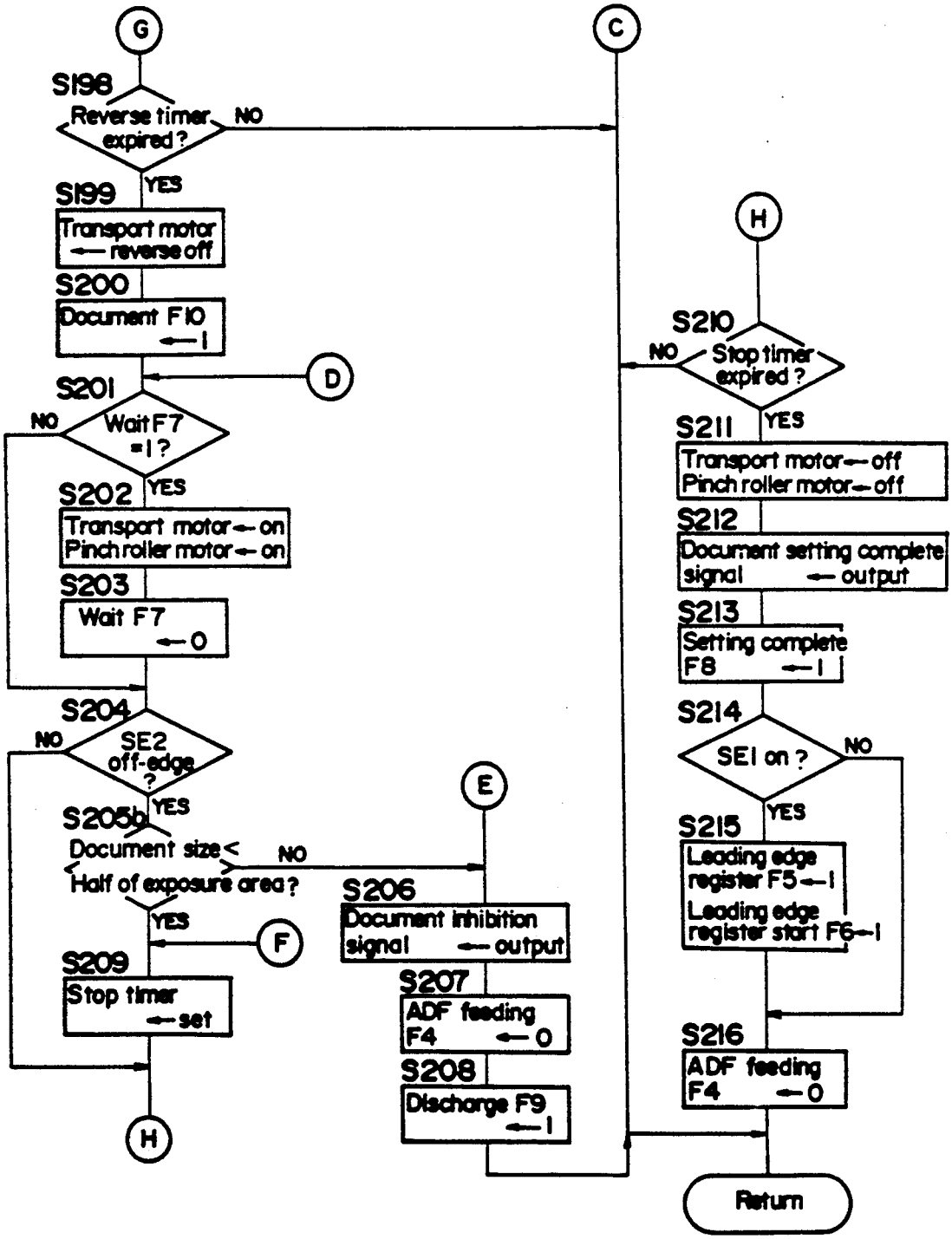

In this embodiment, as the same above second embodiment processing executed in the subroutine at step S108 alone has been replaced with the subroutine shown in FIG. 21*a* and 21*b*, and other processing is identical with above described in FIG. 8 through FIG. 19 in the first embodiment.

Referring now to FIG. 21*a* and 21*b*, at steps S188*b* and S205*b*, whether the sizes of the first and second documents are smaller than the half of the entire exposure area (the maximum document image scanning area which can be scanned by the optical system 20) is judged, at the timing when the trailing edges of the first and second documents have passed the sensor SE2. If the sizes of the first and second documents are larger than the half of the entire exposure area, the document image becomes too large to be copied to one sheet. Thus, at steps S206, S207 and S208, the document inhibition signal is output, the ADF feeding flag F4 is reset to "0" and the discharge flag F9 is set to "1".

Other processing procedures in this subroutine are identical with above described in FIGS. 16*a* and 16*b* in the first embodiment.

More specifically, in this third embodiment, the sizes of the first and second documents are detected in the dual feeding mode, as described previously, whereby if at least either of the document size is larger than the half of the entire exposure area, the copying operation is inhibited. Therefore, the combinations of two document sIzes which can be copied in the dual feeding mode involve the following four types of document sizes; longitudinal orientation A5 size, latitudinal orientation A5 size, B5 size and A4 size. As in Table 4*b* given below, the ten combinations of the above document sizes are available.

TABLE 4b

| Document Combination in Dual Feeding Mode | | | | |
|---|---|---|---|---|
| | Document Size | | | |
| | A5 Lo.O. | A5 La.O. | B5 La.O. | A4 La.O. |
| Document Size | | | | |
| A5 Lo.O. | A5 Lo.O. & A5 Lo.O. | | | |
| A5 La.O. | A5 La.O. & A5 Lo.O. | A5 La.O. & A5 La.O. | | |
| B5 La.O. | B5 La.O. & A5 Lo.O. | B5 La.O. & A5 La.O. | B5 La.O. & B5 La.O. | |
| A4 La.O. | A4 La.O. & A5 Lo.O. | A4 La.O. & A5 La.O. | A4 La.O. & B5 La.O. | A4 La.O. & A4 La.O. |

(Lo.O. shows longitudinal orientation)
(La.O. shows latitudinal orientation)

Further, in the dual feeding mode executed in this embodiment, the first and second document sizes are detected, if at least either of the document size is larger than the half of the entire exposure area, the copying operation is inhibited. Accordingly, in the AMS mode in conjunction with the dual feeding mode, the optimum magnification is a value determined by dividing the half length of the sheet in its transporting direction, if both documents are of the same orientation relative to the feeding direction, by the length of the larger document size its feeding direction (one of the document when the pair of documents are of the same size). When the two documents are feeding in different orientations relative to the document feeding direction, the optimum magnification is calculated by dividing the length of the sheet in its feeding direction by the length of the serially placed a pair of documents in its feeding direction. The following Table 2*d* exhibits the correlation among the document sizes, copy sheet sizes in the case of the AMS mode performed in conjunction with the dual feeding mode, as well as the magnifications determined based on the document sizes and copy sheet sizes.

For example, when the size of a copy sheet is the longitudinal positioned A4 and the combination of the document sizes includes the latitudinal orientation A4 and longitudinal orientation B5, the optimum magnification is arithmetically determined to be 0.757 and this magnification is designated. When the size of a copy sheet is the longitudinal positioned B5 and the combination of the document sizes includes the latitudinal orientation A4 and longitudinal orientation A5, the optimum magnification cannot be reached, and the system encourages an operator to manually set a magnification.

TABLE 2d

| Duel Feeding Mode, By AMS | | | | | | | |
|---|---|---|---|---|---|---|---|
| | Sheet Size selected by Operator | | | | | | |
| | A6 Lo.P. | B6 Lo.P. | A5 Lo.P. | B5 Lo.P. | A4 Lo.P. | B4 Lo.P. | A3 Lo.P. |
| Combination of Document Sizes | | | | | | | |
| A5 Lo.O. & A5 Lo.O. | M | M | M | M | 0.707 | 0.866 | 1.000 |
| A5 La.O. & A5 Lo.O. | M | M | M | 0.717 | 0.829 | 1.017 | 1.173 |
| A5 La.O. & A5 La.O. | M | M | 0.707 | 0.866 | 1.000 | 1.225 | 1.414 |
| B5 La.O. & A5 Lo.O. | M | M | M | 0.655 | 0.757 | 0.928 | 1.071 |
| B5 La.O. & A5 La.O. | M | M | M | 0.707 | 0.816 | 1.000 | 1.154 |
| B5 La.O. & B5 La.O. | M | M | M | 0.707 | 0.816 | 1.000 | 1.154 |
| A4 La.O. & A5 Lo.O. | M | M | M | M | 0.707 | 0.866 | 1.000 |
| A4 La.O. & A5 La.O. | M | M | M | M | 0.707 | 0.866 | 1.000 |
| A4 La.O. & B4 La.O. | M | M | M | M | 0.707 | 0.866 | 1.000 |
| A4 La.O. & A4 La.O. | M | M | M | M | 0.707 | 0.866 | 1.000 |

Effective Magnification on Machine Ranges 0.640-1.430
(M shows manual mode)
(Lo.P. shows longitudinal positioned)
(Lo.O. shows longitudinal orientation)
(La.O. shows latitudinal orientation)

In contrast, when performing copying operation in the dual feeding mode, copying operation is inhibited when the size, if at least, one of the pair of documents is larger than the half of the entire exposure area, as described previously for the AMS mode in this embodiment. Therefore, in the APS mode in conjunction with the dual feeding mode, the size of the optimum copy sheet is determined by multiplying the value twice as large as the length of the larger document (or, one of them, when the pair of documents are of the same size) in its feeding direction by the magnification, when the pair of documents have common orientation. In addition, when the pair of documents are differently oriented, the size of the optimum copy sheet is calculated by multiplying the length of the serially placed pair of documents in its feeding direction by the magnification. Table 3*d* given below exhibits the correlation among the document sizes, magnification, as well as the copy sheet sizes that are determined and designated based on the document sizes and the magnification, relative to the operation in the APS mode in conjunction with the dual feeding mode.

For example, when the combination of the document sizes is the latitudinal orientation A4 and A5, and the magnification is 0.816, the optimum copy sheet size in the dual feeding mode is determined as the longitudinal positioned A4, and the sheet feeder storing the longitudinal positioned A4 sheets is automatically selected. When the combination of the document sizes is the latitudinal orientation A4 and the longitudinal orientation 85, the optimum copy sheet size cannot be determined, even if the magnification of 1.008 to 1.430 is designated. Consequently, the system encourages an operator to manually select a relevant sheet feeder.

TABLE 3d

| | Duel Feeding Mode, By APS | | | | | | |
|---|---|---|---|---|---|---|---|
| | Magnification selected by Operator | | | | | | |
| | 0.640–0.711 | 0.712–0.823 | 0.824–0.871 | 0.872–1.007 | 1.008–1.159 | 1.160–1.231 | 1.232–1.430 |
| Combination of Document Sizes | | | | | | | |
| A5 Lo.O. & A5 Lo.O. | A4 Lo.P. | B4 Lo.P. | B4 Lo.P. | A3 Lo.P. | M | M | M |
| A5 La.O. & A5 Lo.O. | B5 Lo.P. | B5 Lo.P. | A4 Lo.P. | B4 Lo.P. | B4 Lo.P. | A3 Lo.P. | M |
| A5 La.O. & A5 La.O. | A5 Lo.P. | B5 Lo.P. | B5 Lo.P. | A4 Lo.P. | B4 Lo.P. | B4 Lo.P. | A3 Lo.P. |
| B5 La.O. & A5 Lo.O. | B5 Lo.P. | A4 Lo.P. | B4 Lo.P. | B4 Lo.P. | A3 Lo.P. | M | M |
| B5 La.O. & A5 La.O. | B5 Lo.P. | A4 Lo.P. | B4 Lo.P. | B4 Lo.P. | A3 Lo.P. | M | M |
| B5 La.O. & B5 La.O. | B5 Lo.P. | A4 Lo.P. | B4 Lo.P. | B4 Lo.P. | A3 Lo.P. | M | M |
| A4 La.O. & A5 Lo.O. | A4 Lo.P. | B4 Lo.P. | B4 Lo.P. | A3 Lo.P. | M | M | M |
| A4 La.O. & A5 La.O. | A4 Lo.P. | B4 Lo.P. | B4 Lo.P. | A3 Lo.P. | M | M | M |
| A4 La.O. & B5 La.O. | A4 Lo.P. | B4 Lo.P. | B4 Lo.P. | A3 Lo.P. | M | M | M |
| A4 La.O. & A4 La.O. | A4 Lo.P. | B4 Lo.P. | B4 Lo.P. | A3 Lo.P. | M | M | M |

Effective Magnification on Machine Ranges 0.640–1.430
(M shows manual mode)
(Lo.P. shows longitudinal positioned)
(Lo.O. shows longitudinal orientation)
(La.O. shows latitudinal orientation)

[Fourth Embodiment]

Figure 22A:
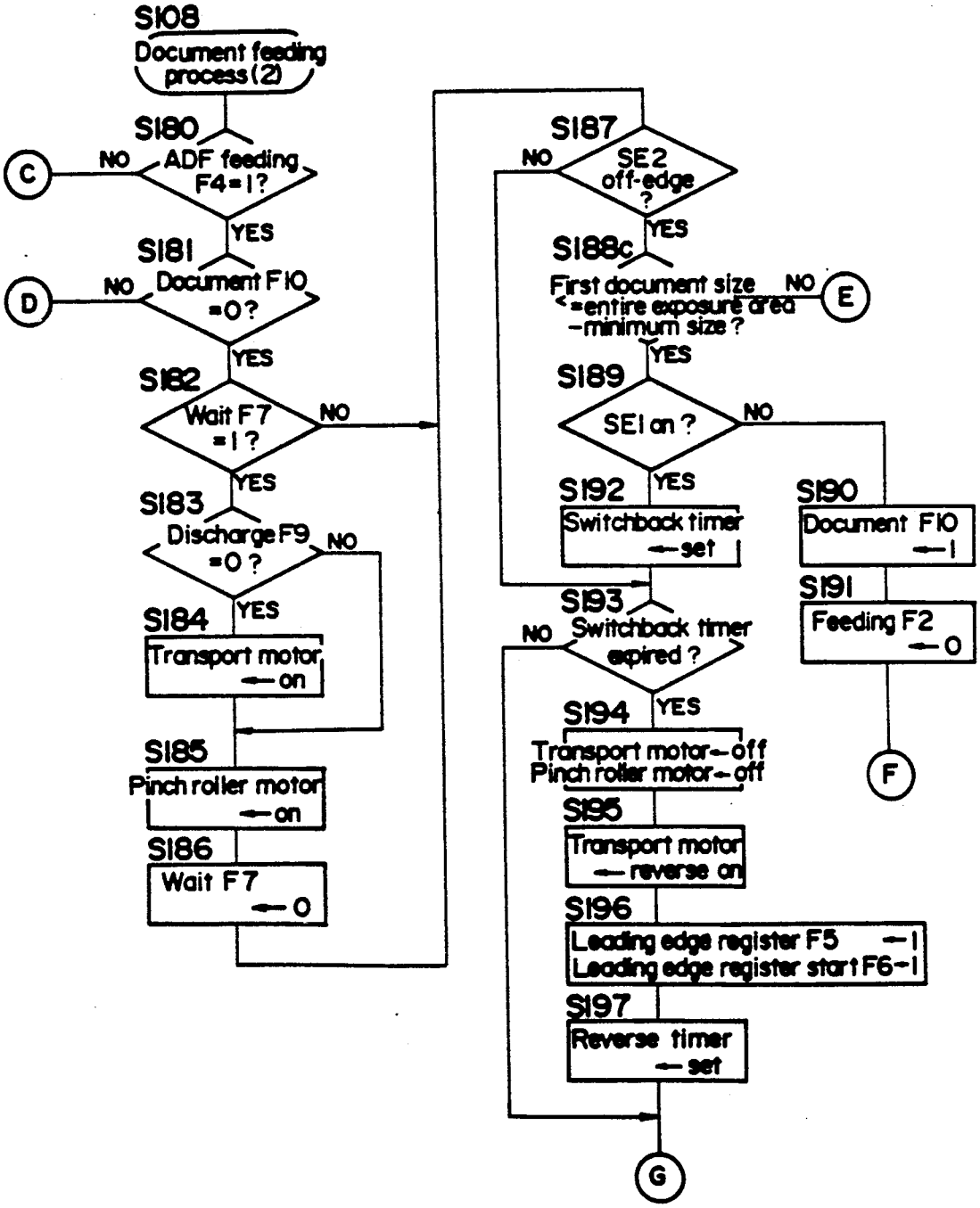
FIGS. 22*a* and 22*b* are flow charts showing a subroutine for the document feeding process (2) executed in a fourth embodiment of the present invention.
Figure 22B:
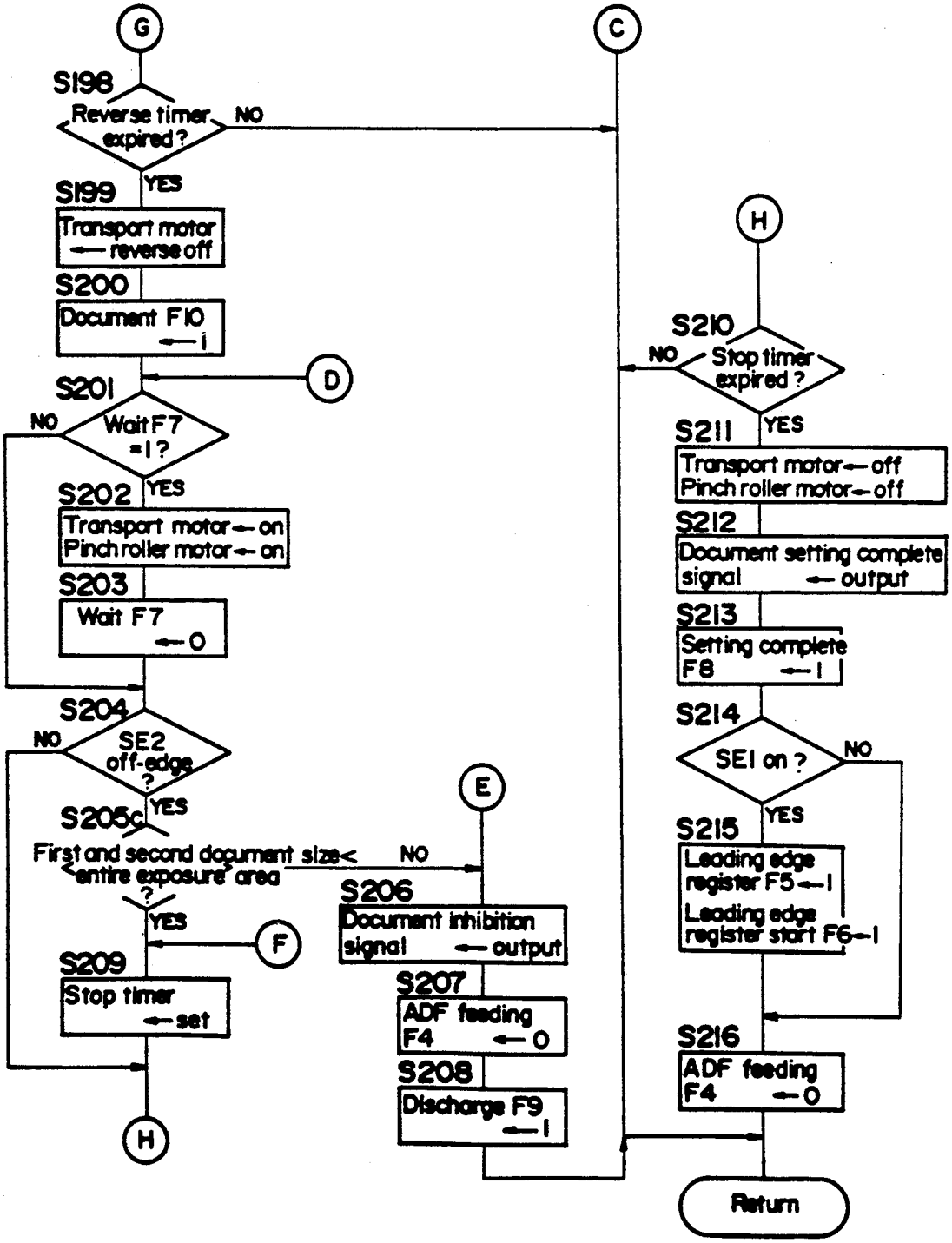
Figure 23A:
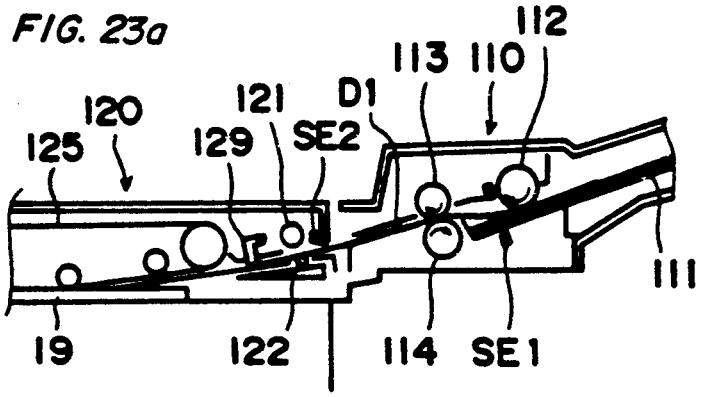
FIG. 23*a* through FIG. 23*d* are explanatory drawings showing the document feeding operation in other embodiment of the present invention.
Figure 23B:
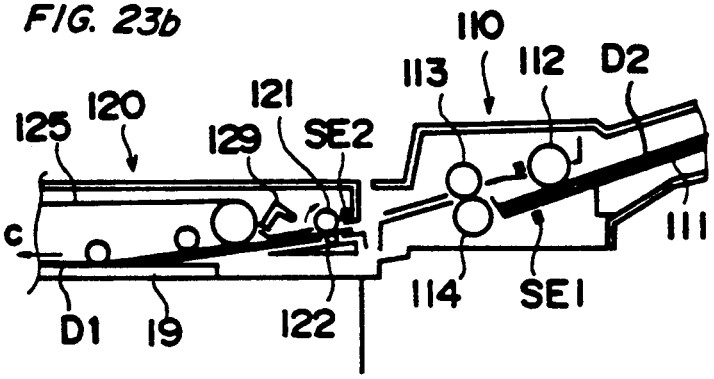
Figure 23C:
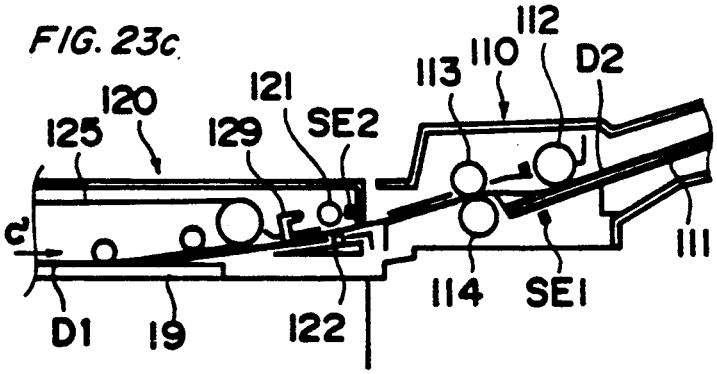
Figure 23D:
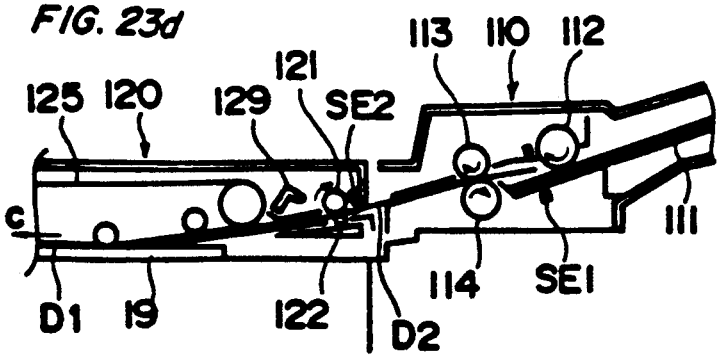

In this embodiment, as the same above second and third embodiments, processing executed in the subroutine at step S108 alone has been replaced with the subroutine shown in FIG. 22*a* and 22*b*, and other processing is identical with above described in FIG. 8 through FIG. 19 in the first embodiment.

In this subroutine shown in FIGS. 22*a* and 22*b*, the dual document deeding in performed only in the following two cases: when the size of the first document is smaller than the value calculated by subtracting the minimum document size from the entire exposure area; and the size of the serially-placed two documents in the document feeding direction is smaller than the entire exposure area. Otherwise, the copying operation is inhibited upon feeding documents, even if a document with a size other than those described above is fed, thereby the documents are subsequently discharged onto the document tray 135.

More specifically, referring now to FIG. 22*a* and 22*b*, at steps S188*c* and S205*c*, whether the size of the first document is smaller than the value calculated by subtracting the minimum document size from the entire exposure area is judged, at the timing when the trailing edge of the first document has passed the sensor SE2. If the first document size is larger than the value calculated by subtracting the minimum document size (corresponding with the longitudinal orientation B5) from the entire exposure area (corresponding with the longitudinal orientation A3), the serially-placed pair of documents are not properly copied to one copy sheet, regardless of the second document size. Thus, at steps S206, S207 and S208, the document inhibition signal is output, the ADF feeding flag F4 is reset to "0" and the discharge flag F9 is set to "1".

Further, at step S205*c*, whether the size of the serially-placed pair of documents in the document feeding direction is smaller than the entire exposure area is judged, at the timing when the trailing edge of the second document has passed the sensor SE2. If the size of the pair of documents is larger than the entire exposure area, the inhibition signal is generated at step S206, the ADF feeding flag F4 is reset to "0" at step S207, and discharge flag F9 is set to "1" at step S208. Because, the combined document images of the serially-placed pair of documents are not properly copied to one copy sheet.

Other processing procedures in this subroutine are identical with above described in FIGS. 16*a* and 16*b* in the first embodiment.

More specifically, in this fourth embodiment, as described previously, when the size of the first document is smaller than the value calculated by subtracting the minimum document size from the entire exposure area, and the size of the serially-placed two documents in the document feeding direction is smaller than the entire exposure area, the copying operation is inhibited. Accordingly, 11 combinations of document sizes described in Table 4*c* are possibly used, wherein the copying operation is performed in the dual feeding mode for the pair of documents, under the inhibition conditions for this embodiment, considering the various sizes ranging from the longitudinal orientation A5 to the longitudinal orientation A3.

TABLE 4c

| | Document Combinations in Dual Feeding Mode | | | | | | | |
|---|---|---|---|---|---|---|---|---|
| | Document Size | | | | | | | |
| | A5 Lo.O. | A5 La.O. | B5 Lo.O. | B5 La.O. | A4 Lo.O. | A4 La.O. | B4 Lo.O. | A3 Lo.O. |
| Document Size | | | | | | | | |
| A5 Lo.O. | | | | | | | | |
| A5 La.O. | | | | | | | | |
| B5 Lo.O. | X | | X | | | | | |
| B5 La.O. | | | X | | | | | |
| A4 Lo.O. | X | X | X | X | X | | | |
| A4 La.O. | | | | X | X | | | |
| B4 Lo.O. | X | X | X | X | X | X | X | |

TABLE 4c-continued

| | Document Combinations in Dual Feeding Mode | | | | | | | |
|---|---|---|---|---|---|---|---|---|
| | Document Size | | | | | | | |
| | A5 Lo.O. | A5 La.O. | B5 Lo.O. | B5 La.O. | A4 Lo.O. | A4 La.O. | B4 Lo.O. | A3 Lo.O. |
| A3 Lo.O. | X | X | X | X | X | X | X | X |

... Combination of document which can be copied
X ... Combination of document which cannot be copied
(Lo.O. shows longitudinal orientation)
(La.O. shows latitudinal orientation)

Accordingly, in the AMS mode in conjunction with the dual feeding mode, the optimum magnification is a value determined by dividing the half length of the sheet in its transporting direction, if both documents are of the same orientation relative to the feeding direction, by the length of the larger document size its feeding direction (one of the document when the pair of documents are of the same size). When the two documents are feeding in different orientations relative to the document feeding direction, the optimum magnification is calculated by dividing the length of the sheet in its feeding direction by the length of the serially placed the pair of documents in its feeding direction. The following Table 2e exhibits the correlation among the document sizes, copy sheet sizes in the case of the AMS mode performed in conjunction with the dual feeding mode, as well as the magnifications determined based on the document sizes and copy sheet sizes.

For example, when the size of a copy sheet is the longitudinal positioned A4 and the combination of the document sizes includes the latitudinal orientation A4 and longitudinal orientation B5, the optimum magnification is arithmetically determined to be 0.707 and this magnification is designated. When the size of a copy sheet is the longitudinal positioned B6 and the combination of the document sizes includes the latitudinal orientation A4 and longitudinal orientation A5, the optimum magnification cannot be reached, and the system encourages an operator to manually set a magnification.

In contrast, accordingly in the APS mode in conjunction with the dual feeding mode, the size of the optimum copy sheet is determined by multiplying the value twice as large as the length of the larger document (or, one of them, when the pair of documents are of the same size) in its feeding direction by the magnification, when the pair of documents have common orientation. In addition, when the pair of documents are differently oriented, the size of the optimum copy sheet is calculated by multiplying the length of the serially placed pair of documents in its feeding direction by the magnification. Table 3e given below exhibits the correlation among the document sizes, magnification, as well as the copy sheet sizes that are determined and designated based on the document sizes and the magnification, relative to the operation in the APS mode in conjunction with the dual feeding mode.

For example, when the combination of the document sizes is the latitudinal orientation B5 and the longitudinal orientation A5, and the magnification is 0.928, the optimum copy sheet size in the dual feeding mode is determined as the longitudinal positioned A4, and the sheet feeder storing the longitudinal positioned A4 sheets is automatically selected. When the combination of the document sizes is the latitudinal orientation A4 and the longitudinal orientation B5, the optimum copy sheet size cannot be determined, even if the magnification of 1.008 to 1.430 is designated. Consequently, the system encourages an operator to manually select a relevant sheet feeder.

TABLE 2e

| | Duel Feeding Mode, By AMS | | | | | | |
|---|---|---|---|---|---|---|---|
| | Sheet Size selected by Operator | | | | | | |
| | A6 Lo.P. | B6 Lo.P. | A5 Lo.P. | B5 Lo.P. | A4 Lo.P. | B4 Lo.P. | A3 Lo.P. |
| Combination of Document Sizes | | | | | | | |
| A5 Lo.O. & A5 Lo.O. | M | M | M | M | 0.707 | 0.866 | 1.000 |
| A5 La.O. & A5 Lo.O. | M | M | M | 0.717 | 0.829 | 1.017 | 1.173 |
| A5 La.O. & A5 La.O. | M | M | 0.707 | 0.866 | 1.000 | 1.225 | 1.414 |
| B5 Lo.O. & A5 La.O. | M | M | M | M | 0.733 | 0.898 | 1.037 |
| B5 La.O. & A5 Lo.O. | M | M | M | 0.655 | 0.757 | 0.928 | 1.071 |
| B5 La.O. & A5 La.O. | M | M | M | 0.707 | 0.816 | 1.000 | 1.154 |
| B5 La.O. & B5 La.O. | M | M | M | 0.707 | 0.816 | 1.000 | 1.154 |
| A4 La.O. & A5 Lo.O. | M | M | M | M | 0.707 | 0.866 | 1.000 |
| A4 La.O. & A5 La.O. | M | M | M | M | 0.707 | 0.866 | 1.000 |
| A4 La.O. & B5 La.O. | M | M | M | M | 0.707 | 0.866 | 1.000 |
| A4 La.O. & A4 La.O. | M | M | M | M | 0.707 | 0.866 | 1.000 |

Effective Magnification on Machine Ranges 0.640–1.430
(M shows manual mode)
(Lo.P. shows longitudinal positioned)
(Lo.O. shows longitudinal orientation)
(La.O. shows latitudinal orientation)

TABLE 3e

| | Duel Feeding Mode, By APS | | | | | | |
|---|---|---|---|---|---|---|---|
| | Magnification selected by Operator | | | | | | |
| | 0.640–0.711 | 0.712–0.823 | 0.824–0.871 | 0.872–1.007 | 1.008–1.159 | 1.160–1.231 | 1.232–1.430 |
| Combination of Document Sizes | | | | | | | |

TABLE 3e-continued

| | Duel Feeding Mode, By APS | | | | | | |
|---|---|---|---|---|---|---|---|
| | Magnification selected by Operator | | | | | | |
| | 0.640–0.711 | 0.712–0.823 | 0.824–0.871 | 0.872–1.007 | 1.008–1.159 | 1.160–1.231 | 1.232–1.430 |
| A5 Lo.O. & A5 Lo.O. | A4 Lo.P. | B4 Lo.P. | B4 Lo.P. | A3 Lo.P. | M | M | M |
| A5 La.O. & A5 Lo.O. | B5 Lo.P. | B5 Lo.P. | A4 Lo.P. | B4 Lo.P. | B4 Lo.P. | A3 Lo.P. | M |
| A5 La.O. & A5 La.O. | A5 Lo.P. | B5 Lo.P. | B5 Lo.P. | A4 Lo.P. | B4 Lo.P. | B4 Lo.P. | A3 Lo.P. |
| B5 Lo.O. & A5 La.O. | A4 Lo.P. | A4 Lo.P. | B4 Lo.P. | B4 Lo.P. | A3 Lo.P. | M | M |
| B5 La.O. & A5 Lo.O. | B5 Lo.P. | A4 Lo.P. | B4 Lo.P. | B4 Lo.P. | A3 Lo.P. | M | M |
| B5 La.O. & A5 La.O. | B5 Lo.P. | A4 Lo.P. | B4 Lo.P. | B4 Lo.P. | A3 Lo.P. | M | M |
| B5 La.O. & B5 La.O. | B5 Lo.P. | A4 Lo.P. | B4 Lo.P. | B4 Lo.P. | A3 Lo.P. | M | M |
| A4 La.O. & A5 Lo.O. | A4 Lo.P. | B4 Lo.P. | B4 Lo.P. | A3 Lo.P. | M | M | M |
| A4 La.O. & A5 La.O. | A4 Lo.P. | B4 Lo.P. | B4 Lo.P. | A3 Lo.P. | M | M | M |
| A4 La.O. & B5 La.O. | A4 Lo.P. | B4 Lo.P. | B4 Lo.P. | A3 Lo.P. | M | M | M |
| A4 La.O. & A4 La.O. | A4 Lo.P. | B4 Lo.P. | B4 Lo.P. | A3 Lo.P. | M | M | M |

Effective Magnification on Machine Ranges 0.640–1.430
(M shows manual mode)
(Lo.P. shows longitudinal positioned)
(Lo.O. shows longitudinal orientation)
(La.O. shows latitudinal orientation)

[Other Embodiments]

In the above-mentioned each embodiment, the means for registering the leading and trailing edges of a document are the pinch rollers 121 and 122. However, as shown in FIG. 23*a* through FIG. 23*d*, a gate 129 may be used instead. In this embodiment, the gate 129 is disposed in the down stream side of the document feeding path, and is freely movable either forward or rearward, wherein the upper pinch roller 121 is capable of being pressed onto or detached from the lower pinch roller 122.

With this arrangement, once the dual feeding mode is selected and the ADF start switch SSW is turned on, the upper pinch roller 121 is detached from the lower pinch roller 122 and the gate 129 is inserted into the feeding path. Documents stacked on the document tray 111 are fed one by one, starting with the uppermost document onward, by the rotation of the pick up roller 112, wherein one document is separated from the other by the separation rollers 113 and 114. The leading edge of a document passes through the pinch rollers 121 and 122, and comes into contact with the gate 129 and undergoes the leading edge registering (refer to FIG. 23*a*). Then, the gate 129 retreats from the feeding path, and the upper pinch roller 121 is pressed onto the lower pinch roller 122 and rotated. At the same time, the transport belt 125 is driven forward. Accordingly, a document is transported until its leading edge has passed the gate 129 (refer to FIG. 23*b*).

Next, when the gate 129 is inserted into the feeding path, the upper pinch roller 121 is detached from the lower pinch roller 122. Simultaneously, the transport belt 125 is driven in the reverse direction shown by an arrow c', thereby the first document D1 is transported backward, and the trailing edge thereof comes into contact with the gate 129, so that the trailing edge registering is achieved (refer to FIG. 23*c*). While the first document D1 undergoes the trailing edge registering, the second document D2 on the document tray 111 is fed and subjected to the leading edge registering. Thus, the document D1 of which trailing edge registered as well as the document D2 of which leading edge registered are positioned sequentially, intervened by the gate 129.

Once this condition is attained, the gate 129 retreats from the feeding path, and the upper pinch roller 121 is pressed onto the lower pinch roller 122 and rotated. At the same time, the transport belt 125 is driven forward and a pair of the documents D1 and D2 are sequentially fed onto the platen glass 19 (refer to FIG. 23*d*). When the trailing edge of the second document D2 reaches a specified position on the platen glass 19 i.e. the position where exposure scanning using optical system 20 is started, the pinch rollers 121, 122 and the transport belt 125 are stopped.

Additionally, the process described above for setting a document on the specified position on the platen glass 19 is a controlling process that stops document feeding based on the trailing edge detection signal of the sensor. However, such a controlling process may be replaced by a switchback system wherein a document is transported slightly rearward by using a step shape or a movable stopper being disposed in a specified position. More specifically, according to such an arrangement, a document is first fed to the specified position, and then, transported rearward by the reverse movement of the transport belt 125 until the trailing edge of a document comes into contact with the step shape or stopper, thereby the document is placed in the specified position.

Further, to serially place a pair of documents onto the platen glass 19, various means other than the above described may be adopted. For example, "the serial double feeding method" may be used, wherein the document separation device feeds the second document consecutively to the first document. Alternatively, another method, wherein a pair of the transport belts are arranged in tandem in the document feeding direction, may be employed. In this case, a pair of documents are sequentially discharged onto the document tray 135 with a proper interval in between the first document and second document, by delaying the timing of discharging with the transport belt that supports the second document, or by slowing the speed of this transport belt.

Although the present invention has described in connection with the preferred embodiments thereof, it is to be noted that various changes and modifications are apparent to those skilled in the art. Such changes and modifications are to be understood as included within the scope of the present invention as defined by the appended claims, unless they depart therefrom.

We claim:

1. A copying apparatus comprising:

transporting means for sequentially feeding a pair of original documents and serially placing them onto a platen in the document feeding direction, said transporting means including detect means for detecting the sizes of the documents fed by said transporting means;

illuminating means for illuminating the pair of original documents on the platen;

image forming means for copying the images of the documents which were serially placed on said platen and illuminated by said illuminating means to a copy sheet; and inhibition means for inhibiting the illuminating operation as well as the image forming operation when the sizes of the pair of documents are different.

2. A copying apparatus comprising:

transporting means for sequentially feeding a pair of original documents and serially placing them onto a platen in the document feeding direction;

image forming means for copying the images of the documents serially placed on said platen to a copy sheet;

detect means for detecting the sizes of documents fed by said transporting means;

inhibition means for inhibiting the image forming operation when the sizes of the pair of documents are different; and means for discharging the pair of documents from said platen when the sizes of the pair of documents are different.

3. A copying apparatus comprising:

transporting means for sequentially feeding a pair of original documents and serially placing them onto a platen in the document feeding direction;

image forming means for copying the image of the documents serially placed on said platen to a copy sheet;

detect means for detecting the sizes of documents bed by said transporting means; and inhibition means for inhibiting the image forming operation when the size of a first document is larger than the half of said platen.

4. A copying apparatus as claimed in claim 3, wherein said inhibition means further inhibits the operation of feeding a second document onto said platen when the size of a first document is larger than the half of said platen.

5. A copying apparatus as claimed in claim 4, further comprises means for discharging a first document from said platen when the size of the first document is larger than the half of said platen.

6. A copying apparatus comprising:

a rectangular platen;

transporting means for operating in a mode where a pair of original documents are sequentially fed through the shorter side of a platen onto it and serially placed on said platen in the document feeding direction;

image forming means for copying the image of the documents serially placed on said platen to a copy sheet;

detect means for detecting the sizes of documents fed by said transporting means; and inhibition means for inhibiting the image forming operation when either of document is a size where the longer side thereof in parallel to the longer side of said platen.

7. A copying apparatus as claimed in claim 6, wherein said inhibition means further inhibits the operation of feeding a second document onto said platen when a first document is a size where the longer side thereof in Parallel to the longer side of said platen.

8. A copying apparatus as claimed in claim 7, further comprises means for discharging a first document from said platen when the first document is a size where the longer side thereof in parallel to the longer side of said platen.

9. A copying apparatus as claimed in claim 8, wherein said discharge means discharges a pair of documents from said platen when a second document is a size where the longer side thereof in parallel to the longer side of said platen.

10. A copying apparatus comprising:

transporting means for sequentially feeding a pair of original documents and serially placing them onto a platen in the document feeding direction;

image forming means for copying the image of the documents serially placed on said platen to one copy sheet;

detect means for detecting the sizes of documents fed by said transporting means; and inhibition means for inhibiting the image forming operation when either of document size is a larger than the half of said platen.

11. A copying apparatus as claimed in claim 10, wherein said inhibition means further inhibits the operation of feeding a second document onto said platen when the size of a first document is larger than the half of said platen.

12. A copying apparatus as claimed in claim 11, further comprises means for discharging a first document from said platen when the size of the first document is larger than the half of said platen.

13. A copying apparatus as claimed in claim 12, wherein said discharge means discharges a pair of documents from said platen when the size of a second document is larger than the half of said platen.

14. A copying apparatus comprising:

transporting means for sequentially feeding a pair of original documents and serially placing them onto a platen in the document feeding direction;

image forming means for copying the image of the documents serially placed on said platen to a copy sheet;

detect means for detecting the sizes of documents fed by said transporting means; and inhibition means for inhibiting the operation of feeding a second document onto said platen when the value calculated by adding the size of a first document and the minimum size of document transportable by said transporting means is larger than the size of said platen.

15. A copying apparatus as claimed in claim 14, wherein said inhibition means further inhibits the image forming operation when the value calculated adding the size of a first document and the minimum size of document transportable by said transport means is larger than the size of said platen.

16. A copying apparatus as claimed in claim 15, further comprises means for discharging a first document from said platen when the value calculated by adding the size of the first document and the minimum size of document transportable by transport means is larger than the size of said platen.

17. A copying apparatus comprising:

transporting means for sequentially feeding a pair of original documents and serially placing them onto a platen in the document feeding direction;

image forming means for copying the image of the documents serially placed on said platen to a copy sheet;

detect means for detecting the sizes of documents fed by said transporting means; and inhibition means for inhibiting the image forming operation when the value calculated by adding the size of a first and second documents is larger than the size of said platen.

18. A copying apparatus as claimed in claim 17, further comprises means for discharging a pair of documents from said platen when the value calculated by adding the sizes of the first and second documents is larger than the size of said platen.

19. A method of operating a copying apparatus including a document feeding means for feeding and placing original documents onto a platen, means for illuminating the original documents on the platen and image forming means for copying the images of the original documents which were placed on the platen and illuminated by the illuminating means, the method comprising the steps of:

sequentially feeding a pair of original documents and serially placing them onto the platen in the document feeding direction;

detecting the sizes of the documents being fed by said document feeding means; and inhibiting the illuminating operation as well as the image forming operation when the sizes of the pair of documents are different.

20. A method of operating a copying apparatus including a document feeding means for feeding and placing original documents onto a platen, means for illuminating the original documents to the platen and image forming means for copying the images of the original documents which were placed on the platen and illuminated by the illuminating means, the method comprising the steps of:

sequentially feeding a pair of original documents and serially placing them onto the platen in the document feeding direction;

detecting the sizes of the documents being fed by said document feeding means; and inhibiting the illuminating operation as well as the image forming operation when the size of the first document is larger than half of said platen.

21. A method of operating a copying apparatus including a document feeding means for feeding and placing original documents onto a platen, means for illuminating the original documents on the platen and image forming means for copying the images of the original documents which were placed on the platen and illuminated by the illuminating means, the method comprising the steps of:

sequentially feeding a pair of original documents and serially placing them onto the platen in the document feeding direction;

detecting the sizes of the documents being fed by said document feeding means; and inhibiting the illuminating operation as well as the image forming operation when either one of the documents is placed with its longer side parallel to the longer side of said platen.

22. A method of operating a copying apparatus including a document feeding means for feeding and placing original documents onto a platen, means for illuminating the original documents on the platen and image forming means for copying the images of the original documents which were placed on the platen and illuminated by the illuminating means, the method comprising the steps of:

sequentially feeding a pair of original documents and serially placing them onto the platen in the document feeding direction;

detecting the sizes of the documents being fed by said document feeding means; and inhibiting the illuminating operation as well as the image forming operation when either one of the documents is larger than half of said platen.

23. A method of operating a copying apparatus including a document feeding means for feeding and placing original documents onto a platen, means for illuminating the original documents on the platen, and image forming means for copying the images of the original documents which were placed on the platen and illuminated by the illuminating means, the method comprising the steps of:

sequentially feeding a pair of original documents and serially placing them onto the platen in the document feeding direction;

detecting the sizes of the documents being fed by said document feeding means; and inhibiting the feeding operation of the second document onto the platen when the value calculated by adding the size of a first document and the minimum size of document transportable by said document feeding means is larger than the size of said platen.

24. A method of operating a copying apparatus including a document feeding means for feeding and placing original documents onto a platen, means for illuminating the original documents on the platen and image forming means for copying the image of the original documents which were placed on the platen and illuminated by the illuminating means, the method comprising the steps of:

sequentially feeding a pair of original documents and serially placing them onto the platen in the document feeding direction;

detecting the sizes of the documents being fed by said document feeding means; and inhibiting the illuminating operation as well as the image forming operation when the value calculated by adding the size of a first document and a second document is larger than the size of said platen.

25. A method of operating a copying apparatus including a document feeding means for feeding and placing original documents onto a platen, means for illuminating the original documents on the platen and image forming means for copying the images of the original documents which were placed on the platen and illuminated by the illuminating means, the method comprising the steps of:

sequentially feeding a pair of original documents and serially placing them onto the platen in the document feeding direction;

detecting the size of the documents being fed by said document feeding means before the documents are placed on the platen; and inhibiting the image forming operation when the sizes of the pair of documents are different.

* * * * *

UNITED STATES PATENT AND TRADEMARK OFFICE

CERTIFICATE OF CORRECTION

PATENT NO. : 5,005,055

DATED : April 2, 1991

INVENTOR(S) : Hirokazu Matsuo, et al

It is certified that error appears in the above-identified patent and that said Letters Patent is hereby corrected as shown below:

Column 39, line 32 "bed" is changed to --fed--.

Column 39, line 66, "Parallel" is changed to --parallel--.

Signed and Sealed this

Twenty-second Day of December, 1992

*Attest:*

DOUGLAS B. COMER

*Attesting Officer*

*Acting Commissioner of Patents and Trademarks*